US010132555B2

(12) United States Patent
Yasaka et al.

(10) Patent No.: US 10,132,555 B2
(45) Date of Patent: Nov. 20, 2018

(54) REFRIGERATOR

(71) Applicant: Samsung Electronics Co., Ltd., Suwon-si (KR)

(72) Inventors: Yoshio Yasaka, Yokohama (JP); Kentaro Kan, Yokohama (JP); Katsumi Takenaka, Yokohama (JP); Makoto Shibuya, Yokohama (JP); Chan Young Park, Suwon-si (KR); Hyun Uk Park, Suwon-si (KR); Tae-In Eom, Hwaseong-si (KR); Young Kyun Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/286,216

(22) Filed: Oct. 5, 2016

(65) Prior Publication Data

US 2017/0097185 A1 Apr. 6, 2017

(30) Foreign Application Priority Data

Oct. 5, 2015 (JP) ..... 2015-197377
Oct. 13, 2015 (JP) ..... 2015-202100
(Continued)

(51) Int. Cl.
*F25D 23/02* (2006.01)
*E05F 15/614* (2015.01)
*E06B 3/36* (2006.01)

(52) U.S. Cl.
CPC ..... *F25D 23/028* (2013.01); *E05F 15/614* (2015.01); *E06B 3/367* (2013.01);
(Continued)

(58) Field of Classification Search
CPC ..... F25D 23/028; E05B 3/367; E05F 15/614
(Continued)

(56) References Cited

U.S. PATENT DOCUMENTS

2010/0141107 A1 6/2010 Kim et al.
2010/0283366 A1* 11/2010 Lucas ..... E05D 3/022 312/401
2010/0283367 A1* 11/2010 Coleman ..... E05D 3/022 312/405

FOREIGN PATENT DOCUMENTS

CN 104121748 10/2014
JP 7-161110 6/1995
(Continued)

OTHER PUBLICATIONS

International Search Report dated Jan. 20, 2017 in corresponding International Patent Application No. PCT/KR2016/011138.
Extended European Search Report dated Jun. 29, 2018 in European Patent Application No. 16853883.3.

*Primary Examiner* — James O Hansen
(74) *Attorney, Agent, or Firm* — Staas & Halsey LLP

(57) ABSTRACT

Provided herein is a door opening and closing apparatus capable of reducing torque of a motor required for removing an adhesive force between a door and a housing. The door opening and closing apparatus includes a motor configured to output power for opening and closing a door, a power transmission apparatus configured to transmit the power of the motor to a hinge by rotation of a plurality of driving gears, and an auxiliary apparatus configured to generate an auxiliary force for moving the door at a closing position toward an opening position, where the auxiliary force is generated at the auxiliary apparatus by the power of the motor before the power of the motor is transmitted to the hinge through the power transmission apparatus.

15 Claims, 66 Drawing Sheets

(30) Foreign Application Priority Data

| | | |
|---|---|---|
| Oct. 26, 2015 | (JP) | 2015-209684 |
| Nov. 26, 2015 | (JP) | 2015-230997 |
| Feb. 25, 2016 | (JP) | 2016-34241 |
| Mar. 28, 2016 | (JP) | 2016-63403 |
| Apr. 7, 2016 | (JP) | 2016-077275 |
| Sep. 13, 2016 | (KR) | 10-2016-0118112 |

(52) U.S. Cl.
CPC ..... *E05Y 2201/434* (2013.01); *E05Y 2201/71* (2013.01); *E05Y 2400/32* (2013.01); *E05Y 2900/31* (2013.01)

(58) Field of Classification Search
USPC ..... 312/401, 402, 405, 319.5, 319.7, 326
See application file for complete search history.

(56) References Cited

FOREIGN PATENT DOCUMENTS

| | | |
|---|---|---|
| JP | 2002-257466 | 9/2002 |
| JP | 2003-240424 | 8/2003 |
| JP | 2004-286311 | 10/2004 |
| JP | 2006-23041 | 1/2006 |
| JP | 2015-117893 | 6/2015 |
| JP | 2016-102608 | 6/2016 |
| KR | 10-0813916 | 3/2008 |
| KR | 10-2014-0037474 | 3/2014 |
| KR | 10-1537377 | 7/2015 |
| KR | 10-2015-0125822 | 11/2015 |
| KR | 10-1578354 | 12/2015 |

* cited by examiner

FORWARD ROTATION STATE

BRAKE STATE

REVERSE ROTATION STATE

REFRIGERATOR

CROSS-REFERENCE TO RELATED APPLICATIONS

This application claims the benefit of Japanese Application No. 2015-197377, filed Oct. 5, 2015; Japanese Application No. 2015-202100, filed Oct. 13, 2015; Japanese Application No. 2015-209684, filed Oct. 26, 2015; Japanese Application No. 2015-230997, filed Nov. 26, 2015; Japanese Application No. 2016-34241, filed Feb. 25, 2016; Japanese Application No. 2016-63403, filed Mar. 28, 2016; Japanese Application No. 2016-077275, filed Apr. 7, 2016, each in the Japanese Intellectual Property Office, and Korean Application No. 10-2016-0118112, filed Sep. 13, 2016, in the Korean Intellectual Property Office, the disclosures of which are incorporated herein by reference.

BACKGROUND

1. Field

Embodiments of the present disclosure relate to a refrigerator with an improved structure for opening and closing a door.

2. Description of the Related Art

In general, a refrigerator is an apparatus that keeps food fresh by having a storage compartment and a cold air supplier configured to supply cold air to the storage compartment.

A temperature of the storage compartment is maintained within a predetermined temperature range required for keeping food fresh.

The storage compartment of the refrigerator is provided to have a front surface thereof opened, and the open front surface is opened and closed by a door to maintain the temperature of the storage compartment.

For example, the storage compartment is divided into a freezer compartment at the right and a refrigerator compartment at the left by a partition, and the freezer compartment and the refrigerator compartment are opened and closed by a freezer compartment door and a refrigerator compartment door, respectively.

SUMMARY

Therefore, it is an aspect of the present disclosure to provide a refrigerator including a door opening and closing apparatus capable of reducing torque of a motor required to remove an adhesive force between a door and a housing, in a case of a door that is automatically opened and closed.

Additional aspects of the disclosure will be set forth in part in the description which follows and, in part, will be obvious from the description, or may be learned by practice of the disclosure.

According to an embodiment of the present disclosure, a refrigerator includes a motor configured to output power for opening and closing a door, a power transmission apparatus configured to transmit the power of the motor to a hinge by rotation of a plurality of driving gears, and an auxiliary apparatus configured to generate an auxiliary force for moving the door at a closing position toward an opening position, where the auxiliary force is generated at the auxiliary apparatus by the power of the motor before the power of the motor is transmitted to the hinge via the power transmission apparatus.

With such a door opening and closing apparatus, since the door at the closing position is moved toward the opening position by the auxiliary force in a state in which the power of the motor is not transmitted to the hinge, torque of the motor required to remove an adhesive force between the door and a housing may be reduced such that the motor may be made smaller.

The refrigerator may further include a power transmission state transition apparatus configured to transition between a power transmitting state in which the power of the motor is transmitted to the hinge and a power non-transmitting state in which the power of the motor is not transmitted to the hinge.

By using such an apparatus, a power transmission state may be mechanically transitioned without using electrical connection of a switching device and the like.

As a detailed embodiment, a configuration in which the plurality of driving gears have a door-side gear configured to rotate by interlocking with opening and closing of the door, a motor-side gear configured to rotate by interlocking with the motor, a center gear connected to the motor-side gear, and a pair of idler gears configured to be engaged with the center gear and remain at predetermined relative positions, and the power transmission state transition apparatus has a swing apparatus configured to interlock with forward rotation or reverse rotation of the center gear to revolve around a rotation shaft of the center gear together with the pair of idler gears may be given.

As a detailed operation, an aspect in which, according to revolution of the swing apparatus, the pair of idler gears move among a forward rotation power transmitting position at which an idler gear at one side is engaged with the door-side gear to move the door toward the opening position, a reverse rotation power transmitting position at which an idler gear at the other side is engaged with the door-side gear to move the door toward the closing position, and a power non-transmitting position at which neither of the pair of idler gears is engaged with the door-side gear may be considered.

With the configuration described above, since the pair of idler gears may be moved among the power transmitting positions and the power non-transmitting position by moving the pair of idler gears along a flat surface perpendicular to the rotation shaft of the center gear by the swing apparatus, a clutch apparatus and the like configured to move the pair of idler gears in a height direction is unnecessary such that the power transmission apparatus may be compactly formed in the height direction.

Meanwhile, according to the power transmission apparatus described above related to the present disclosure, since the pair of idler gears move by interlocking with rotation of the center gear, the pair of idler gears may move by the power of the motor such that an actuator exclusively used for switching between the power transmitting state and the power non-transmitting state may become unnecessary.

Here, a principle in which the pair of idler gears move by interlocking with rotation of the center gear will be described.

When the center gear rotates by the power of the motor, a tangential force is applied to each of the pair of idler gears via a portion engaged with the center gear. Due to the tangential force, torque that attempts to revolve around the center gear is generated at the pair of idler gears. Thus, the pair of idler gears move along the flat surface perpendicular to the rotation shaft of the center gear.

Consequently, when the door at the closing position is being moved toward the opening position, to prevent the pair of idler gears from being engaged with the door-side gear before the adhesive force between the door and the housing is removed by the auxiliary force, the door opening and closing apparatus may regulate revolution of the swing apparatus so that neither of the idler gears is engaged with the door-side gear, and the refrigerator may further include a power non-transmitting state maintenance apparatus configured to maintain the power non-transmitting state.

As a detailed embodiment, a configuration in which the power non-transmitting state maintenance apparatus has an abutting portion installed at a mounting member to rotate together with the mounting member and an abutted portion abutted by the abutting portion to regulate the revolution of the swing apparatus before the pair of idler gears reach the forward rotation power transmitting position when the pair of idler gears move toward the forward rotation power transmitting position according to rotation of the mounting member may be given.

The swing apparatus may have the mounting member configured to have the pair of idler gears mounted thereon and rotate about the rotation shaft of the center gear and a rotation load member configured to be interposed between the mounting member and the pair of idler gears and assign load to rotation of each of the pair of idler gears.

In this way, since the rotation load member makes each of the pair of idler gears difficult to rotate, the torque generated at the pair of idler gears due to rotation of the center gear increases, and the movement of the pair of idler gears along the flat surface may be facilitated.

As a detailed embodiment of the auxiliary apparatus, a configuration in which the auxiliary apparatus has a sliding member installed at an upper portion of the door and configured to slide by interlocking with rotation of the driving gears and an auxiliary force assigning member installed to be rotatable about a circumference of a predetermined rotation shaft by interlocking with sliding of the sliding member and configured to come into contact with the housing by the rotation along the circumference of the rotation shaft to assign the auxiliary force to the door may be given.

To generate the auxiliary force by transmitting the power of the motor to the auxiliary apparatus, the refrigerator may include a power conversion apparatus interposed between the auxiliary apparatus and the power transmission apparatus to convert power directed in a rotating direction of the driving gears into power for moving the auxiliary apparatus.

As a detailed embodiment of the power conversion apparatus, a configuration in which the power conversion apparatus has a ratchet apparatus configured to not transmit the power of the motor to the auxiliary apparatus when the motor rotates in the reverse direction and moves the door toward the closing position and transmit the power of the motor to the auxiliary apparatus when the motor rotates in the forward direction and moves the door toward the opening position may be given.

With such a configuration, since the ratchet apparatus is used, the auxiliary force may be generated when the door at the closing position is moved toward the opening position, and interference with a movement of the door by the power conversion apparatus may be prevented when the door is moved toward the closing position.

As a detailed embodiment of the ratchet apparatus, a configuration in which the ratchet apparatus has a ratchet mounted on the sliding member and a presser configured to rotate by interlocking with the driving gears, where the presser comes into contact with the ratchet and presses the ratchet such that the sliding member slides when the motor rotates in the forward direction, and the ratchet moves away from the presser when the presser comes into contact with the ratchet such that the sliding member does not slide when the motor rotates in the reverse direction, may be given.

The ratchet may have the abutted portion described above, the abutting portion described above may abut the abutted portion to regulate the revolution of the swing apparatus when the motor rotates in the forward direction while the door is at the closing position, and then the presser may press the ratchet such that the sliding member slides and allows the door to move toward the opening position by the auxiliary force.

In this way, since the ratchet apparatus described above may be used as a configuration for generating the auxiliary force before the power of the motor is transmitted to the hinge, the adhesive force may be removed at the power non-transmitting state without a complex configuration.

When the sliding member and the like constituting the auxiliary apparatus is visible to a user while the door is being moved toward the opening position, it is not beneficial in terms of appearance of the refrigerator.

Consequently, the auxiliary apparatus may have a returning member configured to return the sliding member that has moved due to the ratchet being pressed by the presser and a pressed surface pressed by the abutting portion when the sliding member is being returned by the returning member, where the ratchet may move away from the presser due to the abutting portion pressing the pressed surface, and then the presser rotates without being interfered by the ratchet.

With such a configuration, since the sliding member may be returned to the original state and the presser may rotate without being interfered by the sliding member after the adhesive force between the door and the housing is removed, the sliding member may not be visible to the user, and the appearance of the refrigerator may be improved.

In addition, a door opening and closing apparatus related to the present disclosure is for opening and closing a door of the refrigerator and may include a motor, a plurality of driving gears configured to rotate by interlocking with the motor, a chipped tooth gear mounted on a hinge shaft of a hinge rotatably supporting the door and configured to rotate about the hinge shaft, a chipped tooth gear rotation apparatus configured to interlock the chipped tooth gear with opening and closing of the door to allow the chipped tooth gear to rotate between a contacting position at which the chipped tooth gear comes into contact with the driving gears and a non-contacting position at which the chipped tooth gear does not come into contact with the driving gears, and an auxiliary apparatus configured to generate an auxiliary force for moving the door at a closing position toward an opening position, where the chipped tooth gear remains at the non-contacting position by the chipped tooth gear rotation apparatus while the door is at the closing position, and, when the door at the closing position moves toward the opening position by the auxiliary force, the chipped tooth gear rotation apparatus interlocks the chipped tooth gear with the movement and rotates the chipped tooth gear from the non-contacting position to the contacting position.

With the door opening and closing apparatus configured as above, since the chipped tooth gear rotation apparatus allows the chipped tooth gear to remain at the non-contacting position when the auxiliary apparatus is generating the auxiliary force, an adhesive force between the door and a housing may be removed while the driving gears and the chipped tooth gear are not engaged such that torque required for removing the adhesive force may be reduced.

In addition, when the door at the closing position moves toward the opening position, since the chipped tooth gear rotation apparatus moves the chipped tooth gear from the non-contacting position to the contacting position, the driving gears and the chipped tooth gear may be securely engaged by configuring the driving gears engaged with the chipped tooth gear as a gear having teeth formed along the entire circumference, for example. In this way, compared to a configuration in which a chipped tooth gear is used as the driving gears, problems that may be caused by manually opening the door or an increase of the complexity of control may be prevented such that a more practical door opening and closing apparatus may be provided.

As an embodiment that considerably increases advantageous effects of the present disclosure, a configuration in which the driving gears engaged with the chipped tooth gear have teeth formed along the entire circumference may be given.

However, when the motor is installed at an upper portion of the housing, a link member lying across the housing-side to the door-side is installed, for example, to transmit the power of the motor to the door, thereby causing a problem of worsening the appearance of the refrigerator. In addition, when the link member is used, there is a risk that a user's hand may be stuck in the link member.

Consequently, to solve the problem, the motor may be installed at an upper portion of the door.

As a detailed embodiment of the chipped tooth gear rotation apparatus, a configuration in which the chipped tooth gear rotation apparatus has a chipped tooth gear pressing member configured to press the chipped tooth gear from the non-contacting position toward the contacting position and a rotating member installed to be rotatable about a circumference of a rotation shaft and pressed by the chipped tooth gear by the rotation along the circumference of the rotation shaft to rotate the chipped tooth gear from the contacting position to the non-contacting position may be given.

As another detailed embodiment of the chipped tooth gear rotation apparatus, a configuration in which the chipped tooth gear rotation apparatus has a link member connected to the chipped tooth gear and configured to move between an abutting position at which the link member abuts an abutted portion fixed to the housing-side and a separating position at which the link member is spaced apart from the abutted portion by a magnetic force and a regulating member installed at the door-side to come into contact with the link member when the door is at the closing position to regulate movement of the link member, where the regulating member allows the link member to remain at one of the abutting position and the separating position while the door is at the closing position, and, when the door moves toward the opening position by the auxiliary force, the regulating member moves away from the link member, the link member moves to the other of the abutting position and the separating position by the magnetic force, and the chipped tooth gear moves from the non-contacting position to the contacting position, may be given.

To use the magnetic force by a simple configuration, the abutted portion may be a hinge plate mounted on the housing, the link member may have a magnet abutting the hinge plate when the link member is at the abutting position, and the link member may move from the separating position to the abutting position such that the chipped tooth gear moves from the non-contacting position to the contacting position.

A configuration in which the plurality of driving gears of the door opening and closing apparatus have a door-side gear configured to rotate by interlocking with opening and closing of the door, a motor-side gear configured to rotate by interlocking with the motor, a center gear connected to the motor-side gear, and a pair of idler gears configured to be engaged with the center gear and remain at predetermined relative positions, the door opening and closing apparatus further includes a swing apparatus configured to interlock with forward rotation or reverse rotation of the center gear to revolve around a rotation shaft of the center gear together with the pair of idler gears, and, according to revolution of the swing apparatus, the pair of idler gears move among a forward rotation power transmitting position at which the idler gear at one side is engaged with the door-side gear, a reverse rotation power transmitting position at which the idler gear at the other side is engaged with the door-side gear, and a power non-transmitting position at which neither of the pair of idler gears is engaged with the door-side gear may be preferable.

With such a door opening and closing apparatus, since the pair of idler gears may be moved among the power transmitting positions and the power non-transmitting position by moving the pair of idler gears along a flat surface perpendicular to the rotation shaft of the center gear by the swing apparatus, a clutch apparatus configured to move the pair of idler gears in a height direction is unnecessary such that the power transmission apparatus may be compactly formed in the height direction.

In addition, according to the power transmission apparatus described above related to the present disclosure, since the pair of idler gears move by interlocking with rotation of the center gear, the pair of idler gears may move by the power of the motor such that an actuator exclusively used for switching between the power transmitting state and the power non-transmitting state may become unnecessary.

In addition, a principle in which the pair of idler gears move by interlocking with rotation of the center gear is the same as described above.

Consequently, to make the pair of idler gears remain at the power non-transmitting position at which neither of the pair of idler gears is engaged with the door-side gear, the door opening and closing apparatus may further include a power non-transmitting state maintenance apparatus configured to regulate movement of the pair of idler gears due to the swing apparatus to maintain the power non-transmitting state in which neither of the pair of idler gears is engaged with the door-side gear.

As a detailed embodiment, a configuration in which the swing apparatus has a mounting member configured to have the pair of idler gears mounted thereon and rotate about a rotation shaft of the motor-side gear, and the power non-transmitting state maintenance apparatus has an idler gear pressing member configured to press the mounting member at a middle position at which the pair of idler gears remain at the power non-transmitting position, where, when the motor stops, the idler gear pressing member presses the mounting member at the middle position such that the pair of idler gears move to the power non-transmitting position, and, when the motor operates, the pair of idler gears revolve by resisting a pressing force of the idler gear pressing member to move to the forward rotation power transmitting position or the reverse rotation power transmitting position may be preferable.

With the power non-transmitting state maintenance apparatus configured as above, the power non-transmitting state may be maintained using a light-weight or low-cost configuration.

Meanwhile, in a case in which the power non-transmitting state is switched to the power transmitting state, when the idler gear at one or the other side is engaged with the door-side gear, a tangential force may be applied from the center gear and the door-side gear to the idler gear at one or the other side via portions engaged with the center gear and the door-side gear. In this regard, when the power non-transmitting state is switched to the power transmitting state, the torque applied to the idler gear may be increased, and the torque may resist the pressing force of the idler gear pressing member such that the power transmitting state is maintained.

The swing apparatus may have a rotation load member interposed between the mounting member and the pair of idler gears and configured to assign load to rotation of each of the pair of idler gears.

In this way, since the rotation load member makes each of the pair of idler gears difficult to rotate, the torque generated at the pair of idler gears due to rotation of the center gear may increase, and the movement of the pair of idler gears along the flat surface may be facilitated.

To make sure that the idler gear at one or the other side is engaged with the door-side gear by moving the pair of idler gears about the center gear, the angle formed between the door-side gear, the idler gear engaged with the door-side gear, and the center gear may be 90° to 130°.

As a detailed embodiment of the auxiliary apparatus, a configuration in which the auxiliary apparatus has a sliding member installed across one end to the other end at an upper portion of the door and configured to slide by interlocking with rotation of the driving gears and an auxiliary force assigning member installed to be rotatable about a circumference of a predetermined rotation shaft by interlocking with sliding of the sliding member and configured to come into contact with the housing by the rotation along the circumference of the rotation shaft to assign the auxiliary force to the door may be given.

Here, in consideration of maintenance and repair, some refrigerators nowadays are configured so that a door is widely open (e.g., by 160°).

In one of such refrigerators, when the chipped tooth gear described above is attempted to be installed at the hinge shaft, an area in which a tooth is installed at the chipped tooth gear may be limited (e.g., to a 130° position) for better design since the appearance of the refrigerator worsens when the tooth of the chipped tooth gear is visible while the door is widely open.

However, with such a configuration, when the door moves toward the opening position while the chipped tooth gear is engaged with the driving gears due to, e.g., a large number of articles stored at the door, the door may be widely open due to inertia and cause the driving gears to be disengaged from the chipped tooth gear in some cases. Then, a problem in that the door cannot be automatically closed even after the engagement is removed may occur.

Consequently, the door opening and closing apparatus related to the present disclosure may further include a return apparatus configured to move the door toward the closing position so that, when the driving gears are disengaged from the chipped tooth gear due to the movement of the door toward the opening position, the disengaged driving gears are engaged with the chipped tooth gear again.

With such a configuration, the return apparatus may allow the disengaged driving gears to be engaged with the chipped tooth gear again such that the door may be automatically opened and closed again after the driving gears are engaged with the chipped tooth gear.

As a result, even when a user has widely opened the door to insert or take out a stored article, for example, the tooth of the chipped tooth gear does not protrude toward an exterior surface of the refrigerator such that design of the refrigerator is not degraded. Also, even when the door is widely open more than necessary due to a large number of articles stored at the door, the driving gears may be engaged with the chipped tooth gear, and the door may be automatically closed.

As a detailed embodiment of the return apparatus, a configuration in which the return apparatus has a bending member having an elastic force and a contacting member configured to come into contact with the bending member to allow the bending member to be bent, where one of the bending member and the contacting member integrally rotates with the door while the other is fixed, the bending member and the contacting member come into contact due to the movement of the door toward the opening position and cause the bending member to be bent, and the door is moved toward the closing position due to the restoring force of the bending member, may be given.

The bending member may be formed such that an angle between a tangential line coming into contact with a rotational trajectory of a contact point between the bending member and the contacting member and passing through a center of rotation of the bending member and a straight line passing through an intersection point between a virtual circle drawn with the bending member as a center according to a predetermined bending degree of the bending member and the tangential line is 30° to 60°.

With such a configuration, when the bending member is in contact with a contact surface, the restoring force of the bending member may be decomposed using a rotational force of the door. That is, since the door may be rotated toward the closing position by the restoring force of the bending member once the bending member comes into contact with the contact surface and before the bending member moves away from the contact surface, the restoring force does not have to be instantaneously generated. In this way, since the return apparatus does not have to be large, and a cam mounted on the hinge shaft, for example, may be used as the contacting member, the contacting member and the like may not be exposed.

To prevent worsening the appearance of the refrigerator, one of the bending member and the contacting member may be mounted on a lower side of the door, and the other may be fixed to a lower side of the hinge shaft or a lower side of the housing.

Here, so far, a door controlling device configured to automatically open and close the door has been controlling an applied voltage of the motor to be a predetermined value to control a movement speed of the door to be a desired speed.

However, with the controlling method described above, the movement speed of the door actually cannot be controlled to a desired speed since load to the motor changes according to a number of articles such as food stored at the door even when a voltage of the same size is applied to the motor.

Meanwhile, to provide a refrigerator in which movement of the door is more precisely and uniformly controlled compared to the related art, the inventor of the present disclosure has noticed that a back electromotive force voltage generated when the motor rotates is inversely proportional to the movement speed of the door.

That is, a door opening and closing apparatus related to the present disclosure may further include a door controlling device configured to control a motor for moving the door of the refrigerator to automatically move the door, and the door controlling device may include an induced voltage detector configured to detect an induced voltage generated when the motor is rotating and an applied voltage controller configured to control the voltage applied to the motor so that a value detected by the induced voltage detector becomes a target value predetermined according to an opening angle of the door.

In this way, since the induced voltage of the motor is controlled to become the target value of the induced voltage predetermined according to the opening angle of the door, the movement speed of the door may be a speed according to the target value and may be controlled to a desired speed regardless of a number of articles stored at the door.

As a more detailed embodiment, a configuration in which a movement range of the door is divided into a plurality of contiguously divided ranges, and the target value is set for each of the divided ranges may be given.

Here, to detect the opening angle of the door, a state in which the opening angle is zero should be set. Specifically, an aspect in which the opening angle of the door is zero when the motor has begun moving or the user has pressed a door opening switch may be considered.

However, since time taken for the door to begin opening once the motor has begun moving or the user has pressed the door opening switch is not necessarily the same every time, a variation may occur in the detected opening angle according to the aspect described above.

Consequently, to more precisely detect the opening angle of the door, the door controlling device may further include a zero setter configured to set the opening angle as a zero when the applied voltage for moving the door toward the opening position has become a predetermined threshold value while the door is closed and an opening angle detector configured to detect the opening angle from the opening angle set as a zero by the zero setter.

With such a configuration, since the opening angle is zeroed when the applied voltage has become a predetermined threshold value, a variation may not occur in the detected opening angle even when a movement amount of the door once the motor has begun moving until the door begins opening changes such that the opening angle may be precisely detected.

As an embodiment for allowing the opening angle of the door to be detected using a simple and low-cost configuration, a configuration in which an encoder or a rotary switch is installed at the driving gears interposed between the motor and the door and configured to rotate by interlocking with the motor, and the opening angle detector detects the opening angle based on an output from the encoder or the rotary switch may be given.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
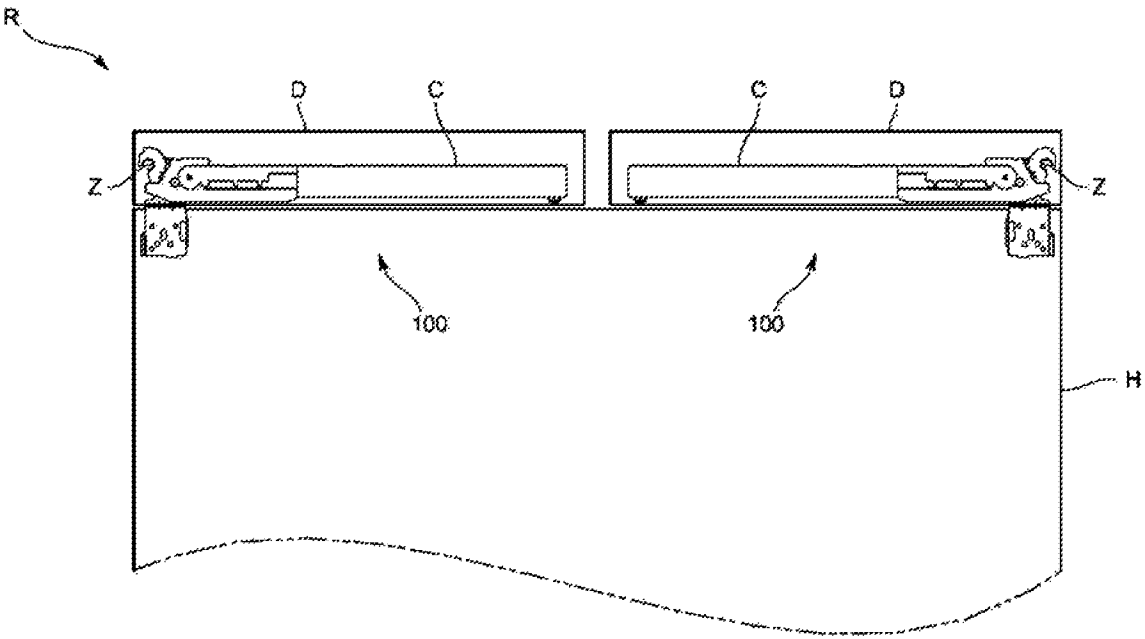
FIG. 1 is a view schematically illustrating a configuration of a refrigerator according to a first embodiment.

Embodiments disclosed herein and elements illustrated in the drawings are merely exemplary examples of the present disclosure, and various modified examples that may substitute for the embodiments and the drawings of the present disclosure may be present at the time of applying the present application.

In addition, the same reference numerals or marks used throughout the drawings of the present disclosure represent parts or elements performing substantially the same functions.

In addition, terms used herein are used for describing embodiments and are not intended to restrict and/or limit the present disclosure. A singular expression includes a plural meaning unless clearly defined otherwise in the context. In the present disclosure, terms such as "include" and "have" are used to indicate that a feature, a number, a step, an operation, an element, a part used herein or a combination thereof exists and do not preclude existence of or a possibility of adding one or more other features, numbers, steps, operations, elements, parts, or combinations thereof.

In addition, terms used herein including ordinal numbers such as "first" and "second" may be used to describe various elements, but the elements are not limited by the terms, and the terms are only used for a purpose of distinguishing one element from another element. For example, a first element may be referred to as a second element, and, likewise, a second element may also be referred to as a first element without departing from the scope of the present disclosure. The term "and/or" includes a combination of a plurality of listed related items or any one item among the plurality of listed related items.

In addition, "upper side," "upward," "lower side," and "downward" used herein are for describing upper and lower directions of a refrigerator according to an embodiment of the present disclosure. That is, a side corresponding to an upper portion of the refrigerator is referred to as an upper side, and a portion below the upper side is referred to as a lower side.

In addition, "front" and "rear" used herein refer to a direction in which an opening and a door of the refrigerator according to an embodiment of the present disclosure is disposed and the opposite side, respectively.

First Embodiment

Hereinafter, a first embodiment of a door opening and closing apparatus 100 related to the present disclosure will be described with reference to the drawings.

First, a refrigerator R related to the embodiment will be described.

As illustrated in FIG. 1, the refrigerator R includes a housing H with an open front surface and left and right doors D installed at an opening of the housing H, wherein each of the doors D is rotatably supported by a hinge shaft Z of a hinge.

The door opening and closing apparatus 100 is for independently opening each of the doors D of the refrigerator R described above and is installed at an upper portion of each of the left and right doors D here.

In the embodiment, the door opening and closing apparatuses 100 are horizontally symmetrical to each other. Hereinafter, only the door opening and closing apparatus 100 for opening and closing the right door D in FIG. 1 will be representatively described.

Figure 2:
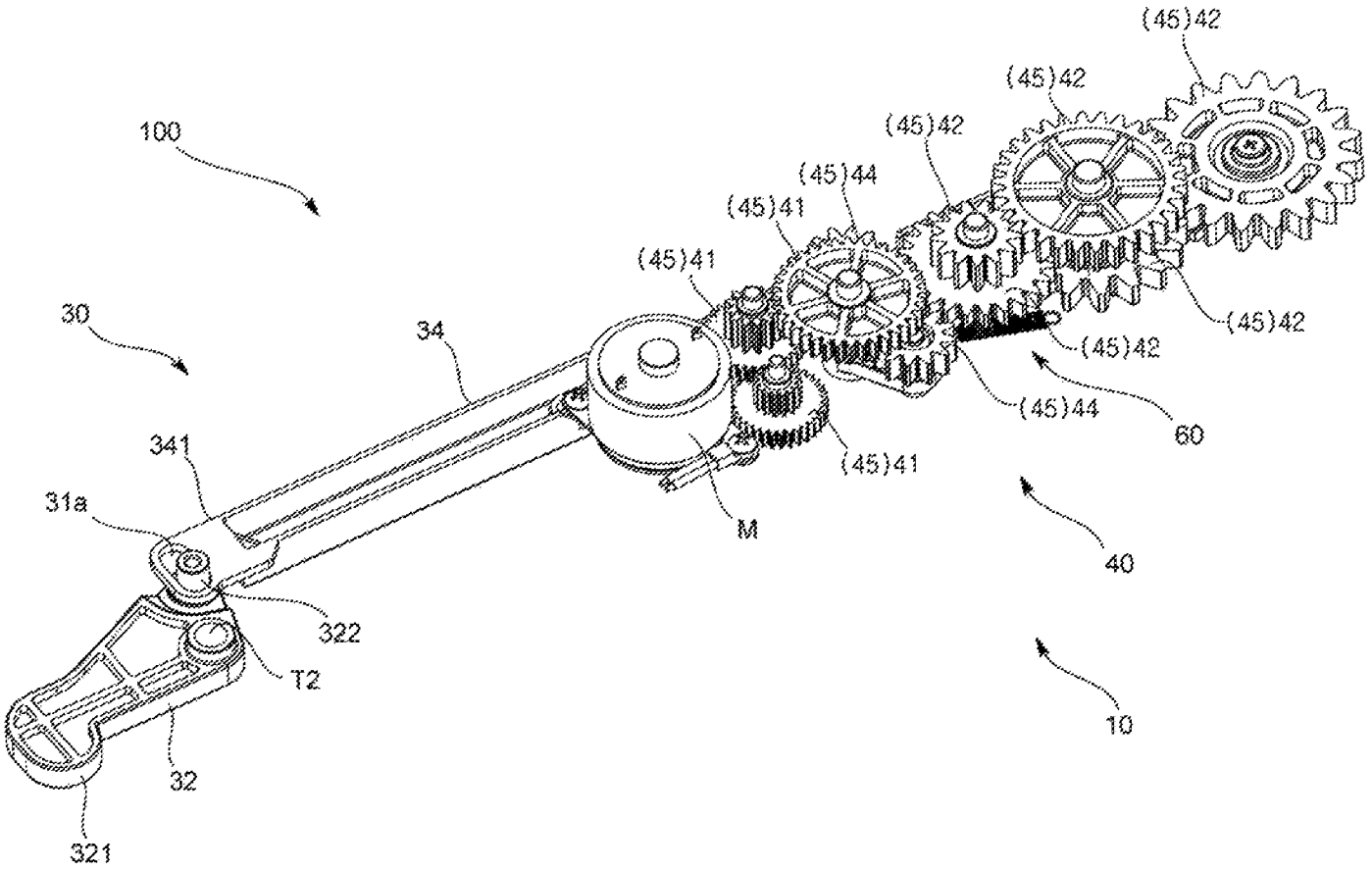
FIG. 2 is a view from the top of a door opening and closing apparatus according to the first embodiment.
Figure 3:
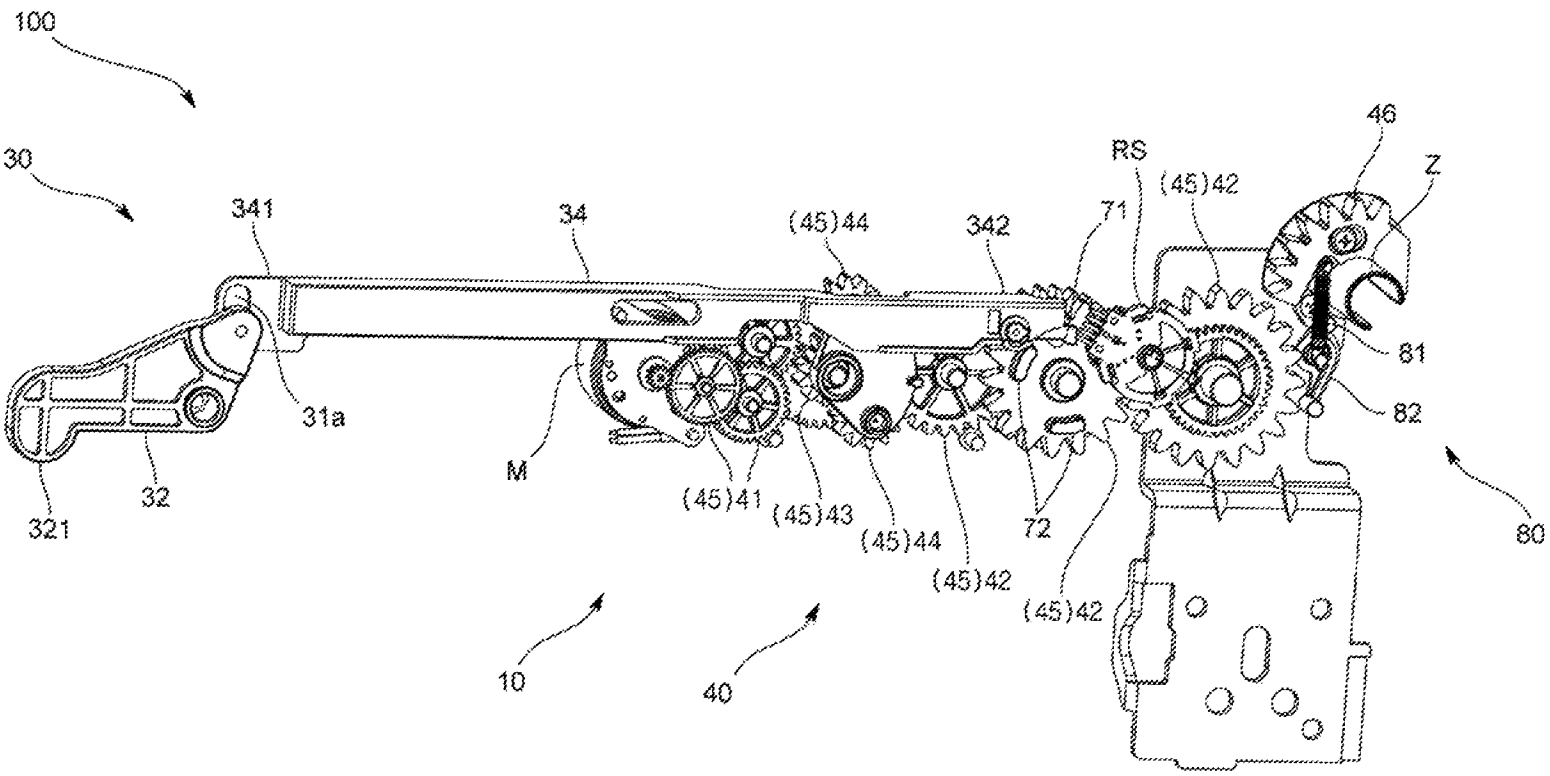
FIG. 3 is a view from the bottom of the door opening and closing apparatus according to the first embodiment.

As illustrated in FIGS. 1 to 3, the door opening and closing apparatus 100 includes a casing C installed at an upper surface of the door D, a driving apparatus 10 housed in the casing C, and an auxiliary apparatus 30 configured to assist the door D at a closing position being opened.

Hereinafter, each of the elements will be described.

<Casing>

To prevent appearance of the refrigerator R from degrading, the casing C houses substantially the entire portion of the driving apparatus 10 and the auxiliary apparatus 30 as illustrated in FIG. 1. Here, the casing C is installed in a longitudinal direction from one end to the other end of the door D.

<Driving Apparatus>

The driving apparatus 10 outputs power for opening and closing the door D and transmits the power to the door D.

Specifically, as illustrated in FIGS. 2 and 3, the driving apparatus 10 has a motor M and a power transmission apparatus 40 configured to transmit power of the motor M to the door D via the hinge shaft Z.

In addition, FIG. 2 is a view from the top of the driving apparatus 10, and FIG. 3 is a view from the bottom of the driving apparatus 10.

The motor M is installed at an upper portion of the door D, is housed in the casing C, and receives a control signal from a controller which is not illustrated and then rotates in a forward direction or a reverse direction.

In the embodiment, the motor M is configured so that the door D may be opened and closed with a predetermined speed variation, based on a control signal from the controller.

The power transmission apparatus 40 is interposed between the motor M and the hinge shaft Z. Particularly, as illustrated in FIG. 3, the power transmission apparatus 40 includes a plurality of driving gears 45 configured to rotate by interlocking with the motor M and a chipped tooth gear 46 mounted on the hinge shaft Z.

In addition, all of the plurality of driving gears 45 have teeth formed along the entire circumference.

Here, the power transmission apparatus 40 according to the embodiment is configured to switch between a power transmitting state in which the power of the motor M is transmitted to the hinge shaft Z and a power non-transmitting state in which the power is not transmitted to the hinge shaft Z so that the door D may either automatically or manually be opened and closed.

In more detail, as illustrated in FIGS. 2 to 4C, the power transmission apparatus 40 has a motor-side gear 41 configured to rotate by interlocking with the motor M, a door-side gear 42 configured to rotate by interlocking with opening and closing of the door D, a center gear 43 connected to the motor-side gear 41, and a pair of idler gears 44 engaged with the center gear 43 (hereinafter, to distinguish each of the pair of idler gears 44, each of the pair of idler gears 44 is also referred to as an idler gear 44*a* at one side and an idler gear 44*b* at the other side), as a part of the plurality of driving gears 45.

In the embodiment, each of the motor-side gear 41 and the door-side gear 42 is disposed in plurality, and the plurality of motor-side gears 41 and the plurality of door-side gears 42 are serially connected.

Of the plurality of motor-side gears 41, the motor-side gear 41 disposed closest to the motor is connected to a rotation shaft of the motor M, and the motor-side gear 41 disposed closest to the door is connected to a rotation shaft of the center gear 43.

In addition, of the plurality of door-side gears 42, the door-side gear 42 disposed closest to the motor is engaged with the idler gears 44, and the door-side gear 42 disposed closest to the door is engaged with the chipped tooth gear 46.

Figure 4A:
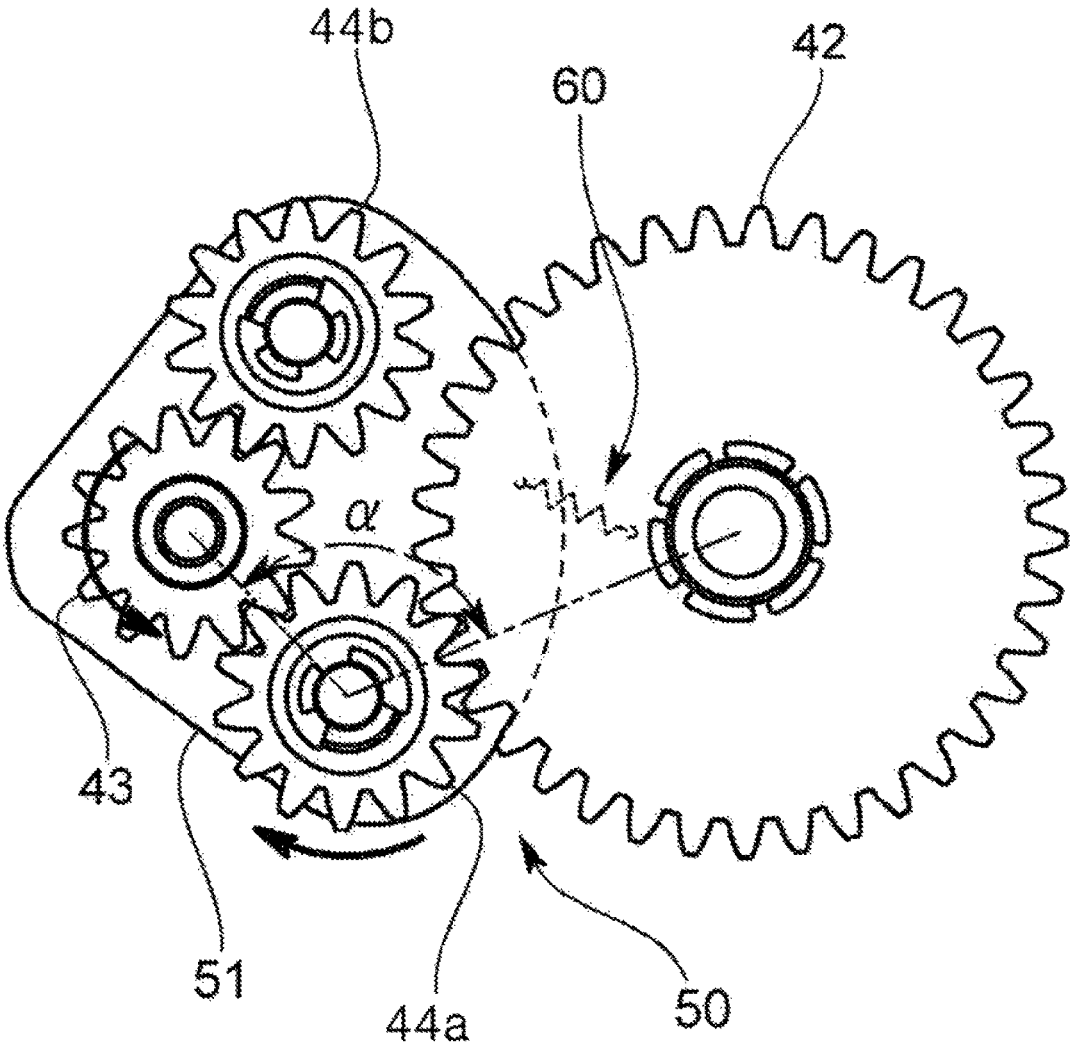
FIGS. 4A, 4B and 4C (4A to 4C) are views schematically illustrating a power transmitting state and a power non-transmitting state according to the first embodiment.
Figure 4B:
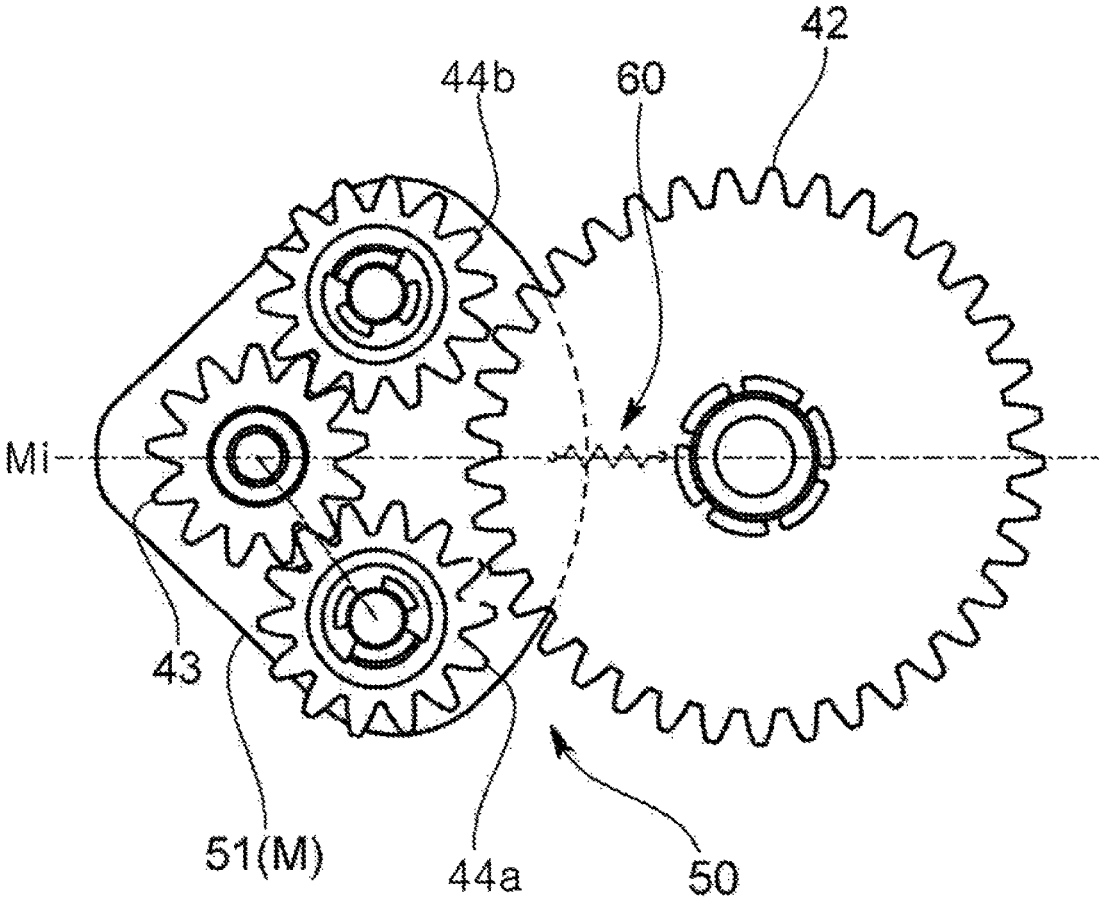
Figure 4C:
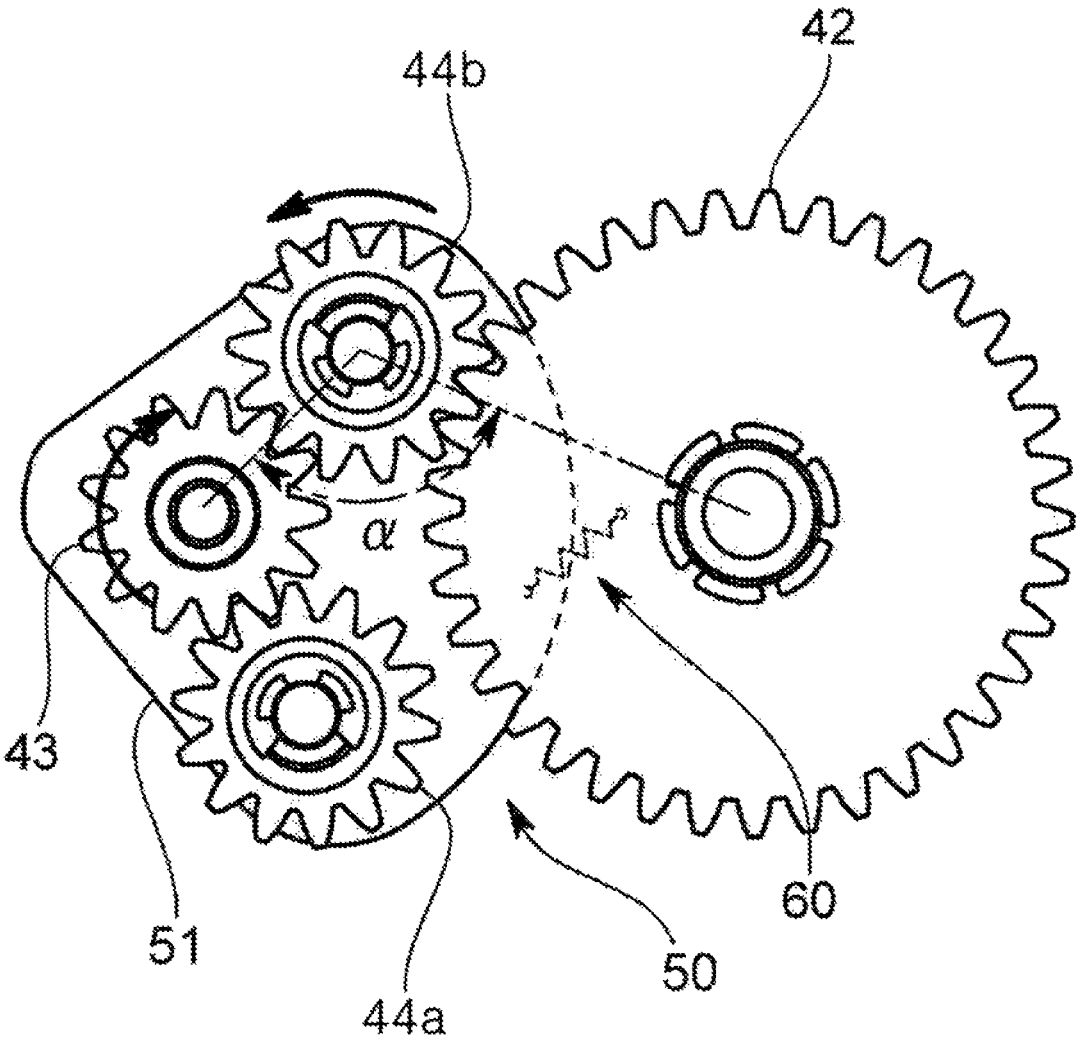
Figure 5:
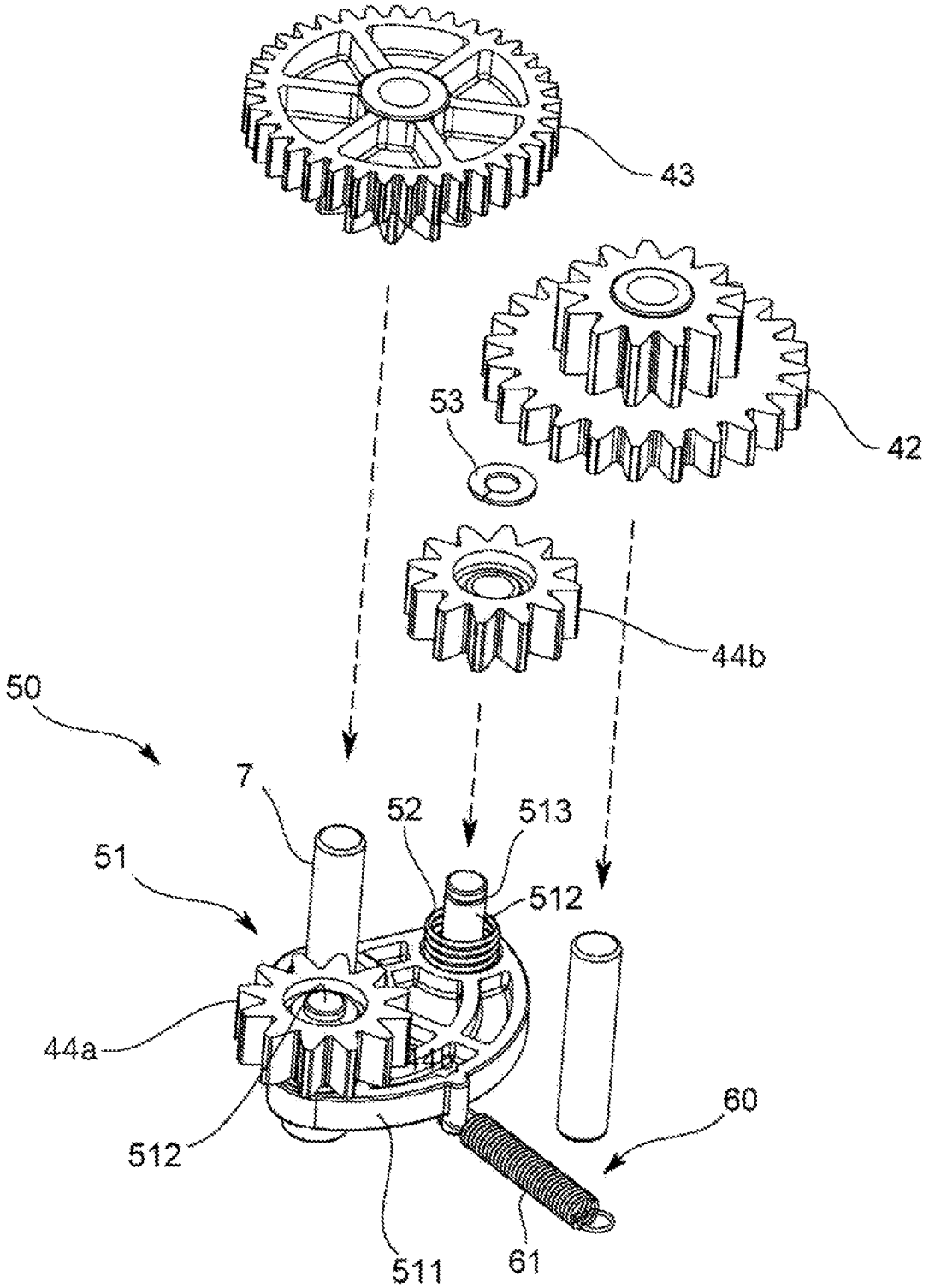
FIG. 5 is a view schematically illustrating a swing apparatus according to the first embodiment.

As illustrated in FIGS. 4A to 5, the pair of idler gears 44 engaged with the center gear 43 are disposed to therebetween have a straight line connecting the rotation shaft of the center gear 43 to a rotation shaft of the door-side gear 42 and rotate by interlocking with the center gear 43.

In addition, as illustrated in FIGS. 4A to 5, the power transmission apparatus 40 further includes a swing apparatus 50 configured to move the pair of idler gears 44 about the center gear 43 and along a flat surface perpendicular to the rotation shaft of the center gear 43 by rotation of the center gear 43 and a power non-transmitting state maintenance apparatus 60 configured to maintain the power non-transmitting state in which neither of the idler gears 44 is engaged with the door-side gear 42.

As illustrated in FIGS. 4A to 4C, the swing apparatus 50 moves the pair of idler gears 44 between a forward rotation power transmitting position at which the idler gear 44*a* at one side is engaged with the door-side gear 42 (FIG. 4A), a reverse rotation power transmitting position at which the idler gear 44*b* at the other side is engaged with the door-side gear 42 (FIG. 4C), and a power non-transmitting position at which neither of the pair of idler gears 44 is engaged with the door-side gear 42 (FIG. 4B).

The swing apparatus 50 according to the embodiment allows the pair of idler gears 44 to revolve along a circumference of the rotation shaft of the center gear 43 and along a rotating direction of the center gear 43. In this way, the swing apparatus 50 may allow the idler gear 44*a* at one side to be engaged with the door-side gear 42 and the idler gear 44*b* at the other side to be detached from the door-side gear 42, or allow the idler gear 44*b* at the other side to be engaged with the door-side gear 42 and the idler gear 44*a* at one side to be detached from the door-side gear 42.

In more detail, as illustrated in FIG. 4A, when the center gear 43 rotates in the forward direction (here, counterclockwise when viewed from the top) by interlocking with rotation of the motor M, the pair of idler gears 44 revolve around the rotation shaft of the center gear 43 counterclockwise when viewed from the top such that the idler gear 44*a* at one side is engaged with the door-side gear 42. In this way, the door opening and closing apparatus 100 according to the embodiment is in an automatically opening mode in which the door D is automatically opened by the power of the motor M.

Meanwhile, as illustrated in FIG. 4C, when the center gear 43 rotates in the reverse direction (here, clockwise when viewed from the top) by interlocking with rotation of the motor M, the pair of idler gears 44 revolve around the rotation shaft of the center gear 43 clockwise when viewed from the top such that the idler gear 44*b* at the other side is engaged with the door-side gear 42. In this way, the door opening and closing apparatus 100 according to the embodiment is in an automatically closing mode in which the door D is automatically closed by the power of the motor M.

In the automatically opening mode and the automatically closing mode described above, the door-side gear 42, the idler gear 44 at one or the other side engaged with the door-side gear 42, and the center gear 43 are disposed so that an angle $\alpha$ formed therebetween is 90° to 130°. In the embodiment, the angle $\alpha$ is designed to be 110° to 120°.

Next, a detailed configuration of the swing apparatus 50 will be described.

As illustrated in FIG. 5, the swing apparatus 50 includes a mounting member 51 configured to rotate about the rotation shaft of the center gear 43 and have the idler gears mounted thereon and a rotation load member 52 interposed between the mounting member 51 and the idler gears 44 and configured to assign a load to rotation of each of the idler gears 44.

The mounting member 51 includes a flat plate member 511 at which all of the center gear 43 and the pair of idler gears 44 are installed and an idler gear mounting shaft 512 configured to vertically stand on the flat plate member 511 and have the idler gears 44 mounted thereon.

A through-hole (not illustrated) through which a center gear mounting shaft 7, on which the center gear 43 is mounted passes is formed at the mounting member 51. By allowing the mounting member 51 to pass through the center gear mounting shaft 7 via the through-hole, the mounting member 51 is rotatable about the center gear mounting shaft 7.

The rotation load member 52 assigns a load to rotation of the idler gears 44 to generate torque that revolves the pair of idler gears 44 along the circumference of the rotation shaft of the center gear 43. Here, the rotation load member 52 is an elastic member such as a spring configured to pass through the idler gear mounting shaft 512 and apply an upward force along the rotation shaft to the idler gears 44.

In the embodiment, as illustrated in FIG. 5, the rotation load member 52 is fitted to the idler gear mounting shaft 512, the idler gear 44 is fitted to the idler gear mounting shaft 512 above the rotation load member 52, and a pressing member 53 configured to press the idler gear 44 is fitted to the idler gear mounting shaft 512 above the idler gear 44 so that an upward force is applied by the rotation load member 52 on the idler gear.

In addition, the pressing member 53 is configured to be coupled to a recessed groove 513 formed in a circumferential direction of an outer circumferential surface of the idler gear mounting shaft 512.

Next, the power non-transmitting state maintenance apparatus 60 will be described.

As illustrated in FIGS. 4A to 5, the power non-transmitting state maintenance apparatus 60 includes an idler gear pressing member 61 configured to press the mounting member 51 at a middle position Mi at which the pair of idler gears 44 remain at the power non-transmitting position.

The idler gear pressing member 61 is an elastic member such as a spring configured to press the mounting member 51 toward the door-side gear 42 disposed closest to the motor by having one end mounted on the mounting member 51 and the other end mounted on a fixing member (unillustrated) fixed to the casing, for example.

In more detail, as illustrated in FIG. 4B, the idler gear pressing member 61 is installed so that the one end and the other end thereof are disposed on a straight line connecting the center of the center gear 43 to the center of the door-side gear 42, i.e., on a straight line perpendicular to a straight line connecting centers of the pair of idler gears 44, with the mounting member 51 at the middle position Mi.

According to the power transmission apparatus 40 configured as above, the door D may be automatically or manually opened and closed by switching between the power transmitting state and the power non-transmitting state.

Hereinafter, an operation when the power transmission apparatus 40 is switched to the power transmitting state or the power non-transmitting state will be described.

First, in the power non-transmitting state, as illustrated in FIG. 4B, the mounting member 51 is pressed at the middle position Mi by the idler gear pressing member 61, and neither of the idler gears 44 is engaged with the door-side gear 42.

Here, when a predetermined voltage is applied to the motor M to drive the motor M, the center gear 43 rotates, and a tangential force is applied to the pair of idler gears 44 via a portion engaged with the center gear 43.

Then, as illustrated in FIGS. 4A to 4C, the tangential force opposes the pressing force of the idler gear pressing member 61, the pair of idler gears 44 revolve along the circumference of the rotation shaft of the center gear 43, and the idler gear 44 at one or the other side moves to the forward rotation power transmitting position or the reverse rotation power transmitting position to be engaged with the door-side gear 42 and is switched from the power non-transmitting state to the power transmitting state.

Meanwhile, in the power transmitting state, when the motor M is stopped, since the mounting member 51 is pressed again at the middle position Mi by the idler gear pressing member 61, the pair of idler gears 44 move to the power non-transmitting direction and is switched from the power transmitting state to the power non-transmitting state.

<Auxiliary Apparatus>

Next, the auxiliary apparatus 30 will be described.

The auxiliary apparatus 30 generates an auxiliary force for opening the door D. Here, the auxiliary apparatus 30 is installed across one end side to the other end side at an upper portion of the door D and is housed in the casing C.

Specifically, as illustrated in FIGS. 2 and 3, the auxiliary apparatus 30 includes a sliding member 34 configured to be slidable by interlocking with rotation of the driving gears 45 and an auxiliary force assigning member 32 installed to be rotatable about a circumference of a predetermined rotation shaft T2 by interlocking with sliding of the sliding member 34, configured to come into contact with the housing H by the rotation along the circumference of the rotation shaft T2, and configured to assign the auxiliary force to the door D.

The sliding member 34 is configured to extend in the longitudinal direction and be slidable in an elongating direction thereof, has the auxiliary force assigning member 32 installed at one end 341, and has the other end 342 to which power is transmitted from the power transmission apparatus 40.

Figure 6:
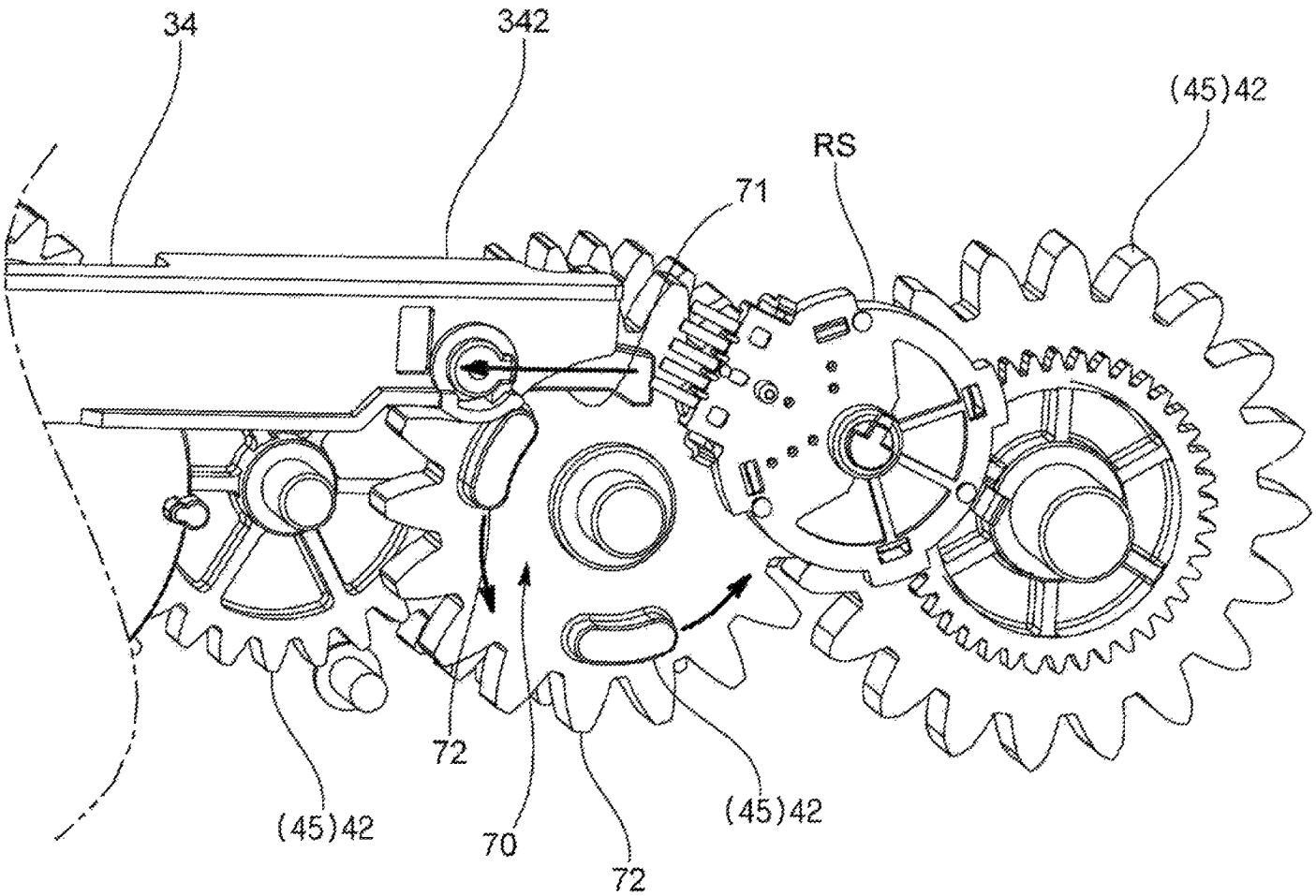
FIG. 6 is a view schematically illustrating a power conversion apparatus according to the first embodiment.

In the embodiment, as illustrated in FIG. 6, a power conversion apparatus 70 configured to convert power directed in a rotating direction of the driving gears 45 (the door-side gears 42) to power directed in the elongating direction of the sliding member 34 is interposed between the sliding member 34 and the power transmission apparatus 40.

The power conversion apparatus 70 uses a so-called ratchet apparatus and includes a hook 71 installed at the other end 342 of the sliding member 34 and a plurality of protrusions 72 (in this case, three) installed at, for example, a back surface of the driving gear 45 (the door-side gear 42) disposed near the other end 342.

Due to such configuration, any one of the protrusions 72 presses the hook 71 by rotation of the driving gear 45, and the power directed in the rotating direction of the driving gear 45 is transmitted to the sliding member 34 as the power directed in the elongating direction of the sliding member 34 via the hook 71 such that the sliding member 34 slides in the elongating direction.

As illustrated in FIGS. 2 and 3, the auxiliary force assigning member 32 has a penetrating member 322 configured to pass through a through-hole 31*a* formed at the one end 341 of the sliding member 34, and the penetrating member 322 is configured to be mounted on the sliding member 34 by being fitted into the through-hole 31*a*.

The auxiliary force assigning member 32 further includes a collider 321 configured to collide with the front surface of the housing H by rotating along the circumference of the rotation shaft T2.

Due to such configuration, the sliding member 34 slides from the other end 342 toward the one end 341 such that the penetrating member 322 serves as effort force and the collider 321 serves as load, and the auxiliary force acts on the door D such that the door D and the housing H may be demagnetized.

<Chipped Tooth Gear Rotation Apparatus>

Figure 7A:
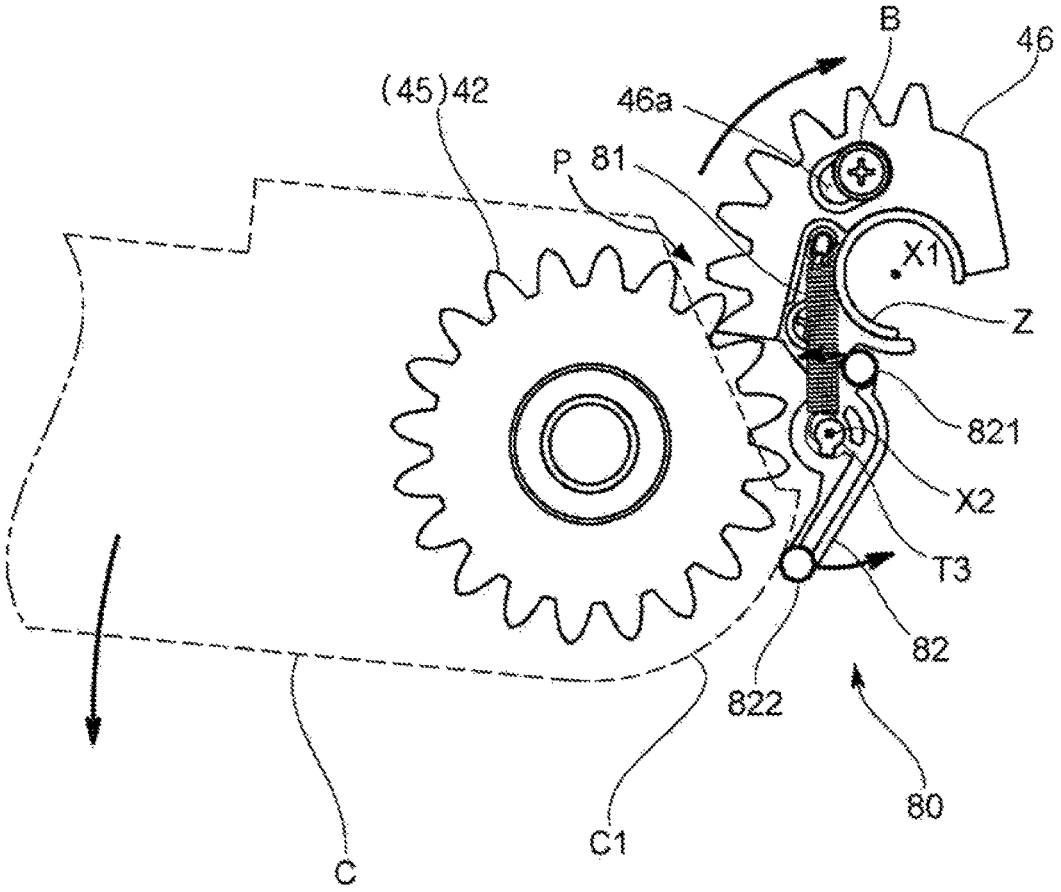
FIGS. 7A and 7B are views schematically illustrating a chipped tooth gear rotation apparatus according to the first embodiment.
Figure 7B:
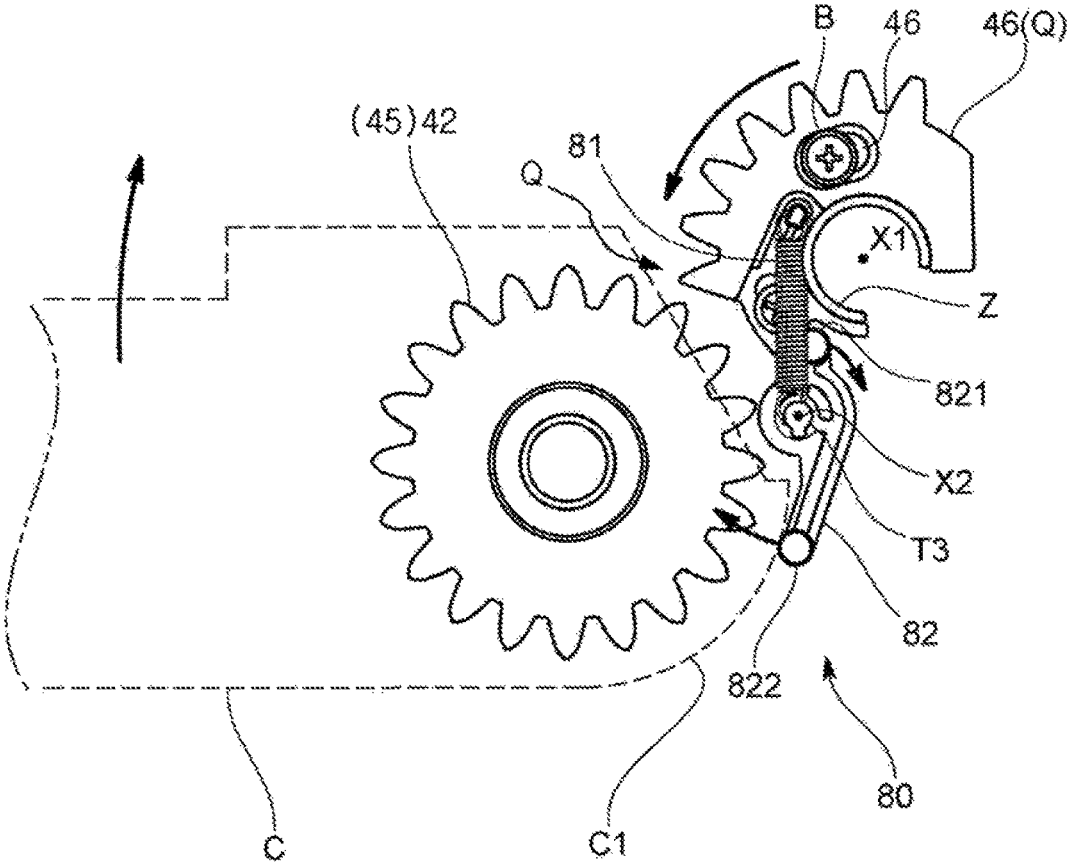

Here, the chipped tooth gear 46 according to the embodiment is installed to be rotatable about a shaft center X1 of the hinge shaft Z as illustrated in FIGS. 7A and 7B.

In addition, the door opening and closing apparatus 100 further includes a chipped tooth gear rotation apparatus 80 configured to rotate the chipped tooth gear 46 as illustrated in FIGS. 7A and 7B.

First, the chipped tooth gear 46 will be described.

The chipped tooth gear 46 is formed in a shape in which a circumferential part of the gear having teeth formed along the entire circumference is notched (here, a shape in which approximately ¾ of the teeth in the circumferential direction is notched), and teeth is formed at a part of the outer circumferential portion thereof or the whole outer circumferential portion thereof.

The chipped tooth gear 46 according to the embodiment has one or more through-holes 46*a* formed by penetrating in a thickness direction, and a retaining member B such as a shoulder screw for retaining the chipped tooth gear 46 is installed in the one or more through-holes 46*a*.

Due to the configuration described above, the chipped tooth gear 46 may rotate within a predetermined range about the shaft center X1 of the hinge shaft Z without moving in the vertical direction.

Next, the chipped tooth gear rotation apparatus 80 will be described.

As illustrated in FIGS. 7A and 7B, the chipped tooth gear rotation apparatus 80 allows the chipped tooth gear 46 to interlock with opening and closing of the door D so that the chipped tooth gear 46 rotates between a contacting position P at which the chipped tooth gear 46 comes into contact with the driving gear 45 (here, the door-side gear 42 disposed closest to the door) and a non-contacting position Q at which the chipped tooth gear 46 does not come into contact with the driving gear 45.

Here, as illustrated in FIG. 7A, the contacting position P is a position at which the chipped tooth gear 46 initially comes into contact with the driving gear 45 when the door D at the closing position has moved toward the opening position. As illustrated in FIG. 7B, the non-contacting position Q is a position at which the chipped tooth gear 46 is spaced apart from the driving gear 45 as far as possible and is a position of the chipped tooth gear 46 when the door D is at the closing position in the embodiment.

Specifically, as illustrated in FIGS. 7A and 7B, the chipped tooth gear rotation apparatus 80 includes a chipped tooth gear pressing member 81 configured to press the chipped tooth gear 46 from the non-contacting position Q toward the contacting position P and a rotating member 82 installed to be rotatable about a circumference of a rotation shaft T3 and configured to press the chipped tooth gear 46 by rotation along the circumference of the rotation shaft T3 to rotate the chipped tooth gear 46 from the contacting position P to the non-contacting position Q.

The chipped tooth gear pressing member 81 is an elastic member such as a spring having one end mounted on a back surface of the chipped tooth gear 46, for example, and the other end mounted on the rotation shaft T3 of the rotating member 82.

In addition, the other end of the chipped tooth gear pressing member 81 does not have to be necessarily mounted on the rotation shaft T3, and a mounting portion for mounting the other end of the chipped tooth gear pressing member 81 may be installed at the upper portion of the door D, separately from the rotation shaft T3.

As illustrated in FIGS. 7A and 7B, the rotating member 82 is fixed to a hinge plate (unillustrated) connecting the door D to the housing H, for example, and one end 821 thereof abuts the chipped tooth gear 46 while the other end 822 thereof abuts the casing C.

Here, the one end 821 abuts a notched end surface of the chipped tooth gear 46, for example, and the other end 822 abuts a side surface of the casing C.

In the embodiment, to allow the other end 822 to smoothly move along the side surface of the casing C by interlocking with opening and closing of the door D, at least a portion abutting the other end 822 of the side surface is formed as a guide surface C1 bent outward.

In addition, the other end 822 of the rotating member 82 does not necessarily have to abut the side surface of the casing C, and a guide surface for smoothly moving the other end 822 of the rotating member 82 may be installed at the upper portion of the door D, separately from the side surface of the casing C.

When the door D at the opening position begins to rotate about the shaft center X1 of the hinge shaft Z toward the closing position due to the configuration described above, the other end 822 of the rotating member 82 is pressed to the guide surface C1 of the casing C and thus rotates about a shaft center X2 of the rotation shaft T3 while sliding along the guide surface C1. Here, the one end 821 of the rotating member 82 presses the end surface of the chipped tooth gear 46, and the pressing force opposes the pressing force of the chipped tooth gear pressing member 81 such that the chipped tooth gear 46 is rotated from the contacting position P toward the non-contacting position Q.

Meanwhile, when the door D at the closing position begins to rotate about the shaft center X1 of the hinge shaft Z toward the opening position, the chipped tooth gear 46 rotates from the non-contacting position Q toward the contacting position P by the chipped tooth gear pressing member 81, and the chipped tooth gear 46 comes into contact with the driving gear 45. Here, the rotating member 82 rotates about the shaft center X2 of the rotation shaft T3 in a direction in which the one end 821 moves away from the chipped tooth gear 46, and, according to the rotation, the other end 822 slides along the guide surface C1 while abutting the guide surface C1.

Hereinafter, an operation of the door opening and closing apparatus 100 according to the embodiment will be described.

First, a case in which the door D at the closing position is moved toward the opening position will be described.

In this case, first, the motor M is driven by a control signal received from an unillustrated controller, and the driving gears 45 begin rotating by interlocking with each other. Here, the pair of idler gears 44 moves from the power non-transmitting position to the power transmitting position by the swing apparatus 50. In addition, the chipped tooth gear rotation apparatus 80 allows the chipped tooth gear 46 to remain at the non-contacting position Q.

Next, a rotational force of the driving gear 45 is transmitted to the sliding member 34 via the power conversion apparatus 70 interposed between the power transmission apparatus 40 and the auxiliary apparatus 30, and the sliding member 34 slides in the elongating direction. In more detail, the protrusion 72 installed at a back surface of the driving gear 45 presses the hook 71 installed at the other end 342 of the sliding member 34 by rotation of the driving gear 45 disposed near the other end 342 of the sliding member 34 such that the sliding member 34 slides.

Due to sliding of the sliding member 34, the auxiliary force assigning member 32 rotates along the circumference of the rotation shaft T2 and is pressed to the front surface of the housing H. By a reaction thereof, the door D and the housing H are demagnetized, and the door D rotates along the circumference of the hinge shaft Z from the closing position to the opening position.

When the door D rotates toward the opening position, the chipped tooth gear rotation apparatus 80 rotates the chipped tooth gear 46 about the shaft center X1 of the hinge shaft Z from the non-contacting position Q to the contacting position P. In more detail, the casing C rotates about the shaft center X1 of the hinge shaft Z together with the door D, and, by interlocking with the rotation, the chipped tooth gear 46 rotates from the non-contacting position Q to the contacting position P by the pressing force of the chipped tooth gear pressing member 81. Here, the rotating member 82 rotates about the shaft center X2 of the rotation shaft T3 in the direction in which the one end 821 moves away from the chipped tooth gear 46, and, according to the rotation, the other end 822 slides along the guide surface C1 while abutting the guide surface C1.

Then, due to the driving gear 45 rotating further, the driving gear 45 and the chipped tooth gear 46 are engaged with each other, and the door rotates toward the opening position.

Next, a case in which the door D remaining at the opening position is rotated toward the closing position will be described.

When the motor M is driven by a control signal received from a controller (unillustrated) while the door D is at a standstill, the driving gears 45 begins rotating by interlocking with each other, and the pair of idler gears 44 move from the power non-transmitting position to the power transmitting position by the swing apparatus 50.

Here, since the chipped tooth gear 46 is at the contacting position P, the power of the motor M is transmitted to the hinge shaft Z, and the door D rotates toward the closing position.

Then, when the door D reaches a predetermined opening angle, the guide surface C1 of the casing C comes into contact with the other end 822 of the rotating member 82.

By the door D further rotating toward the closing position from the position above, the rotating member 82 rotates along the circumference of the rotation shaft T3, and the one end 821 of the rotating member 82 presses the chipped tooth gear 46. In addition, the pressing force opposes the pressing force of the chipped tooth gear pressing member 81 and rotates the chipped tooth gear 46 from the contacting position P toward the non-contacting position Q.

In this way, although the power of the motor M is not transmitted to the hinge shaft Z, afterwards, the door D further rotates and reaches the closing position by inertia and a magnetic force of the housing H.

However, as described above, the chipped tooth gear 46 according to the embodiment is formed in the shape in which a circumferential part of the gear having teeth formed along the entire circumference is notched.

In this regard, when the door D is widely open by inertia due to a large number of articles stored at the door D, for example, when the door D is being moved toward the opening position while the driving gear 45 is engaged with the chipped tooth gear 46, the driving gear 45 is disengaged from the chipped tooth gear 46 in some cases. Then, after the engagement is removed, the door D cannot be automatically closed.

Consequently, the door opening and closing apparatus 100 according to the embodiment further includes a return apparatus 200 configured to move the door D toward the closing position so that, when the driving gear 45 that has been engaged with the chipped tooth gear 46 is disengaged from the chipped tooth gear 46 due to movement of the door D toward the opening position, the disengaged driving gear 45 is engaged with the chipped tooth gear 46 again.

Hereinafter, the return apparatus 200 will be described with reference to FIGS. 8 to 11B.

<Return Apparatus>

Figure 8:
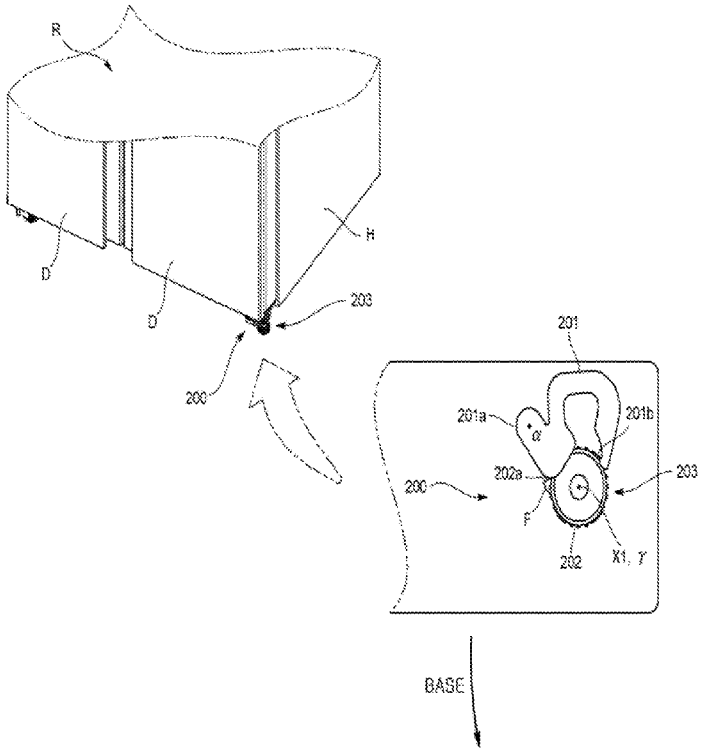
FIG. 8 is a view schematically illustrating a return apparatus according to the first embodiment.

The return apparatus 200 moves the door D in which the chipped tooth gear 46 and the driving gear 45 are disengaged toward the closing position to a position at which the chipped tooth gear 46 and the driving gear 45 are engaged. Specifically, as illustrated in FIG. 8, the return apparatus 200 includes a bending member 201 installed at a lower side of the refrigerator R and having an elastic force and a contacting member 202 configured to come into contact with the bending member 201 to allow the bending member 201 to be bent.

Figure 9A:
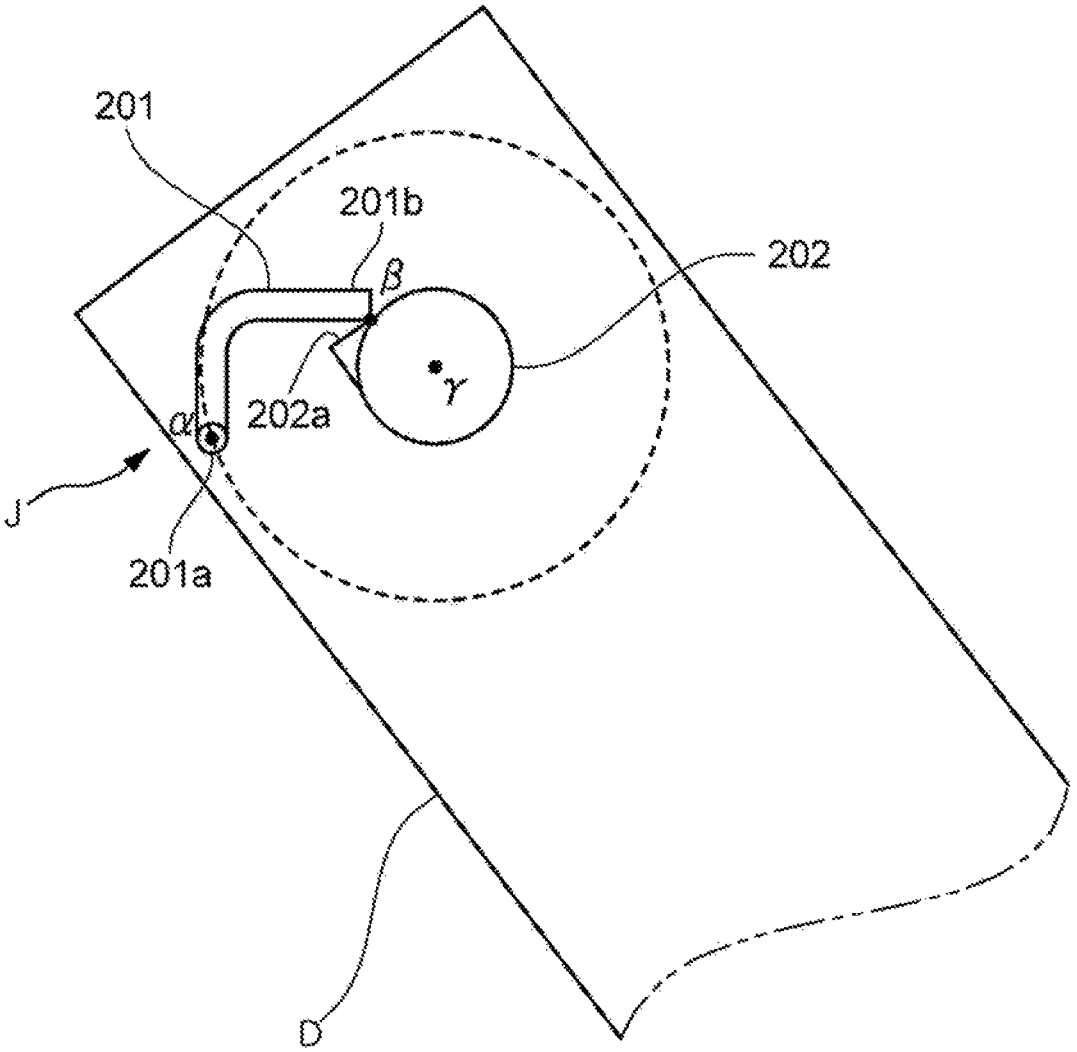
FIGS. 9A and 9B are views for describing movement of the return apparatus according to the first embodiment.
Figure 9B:
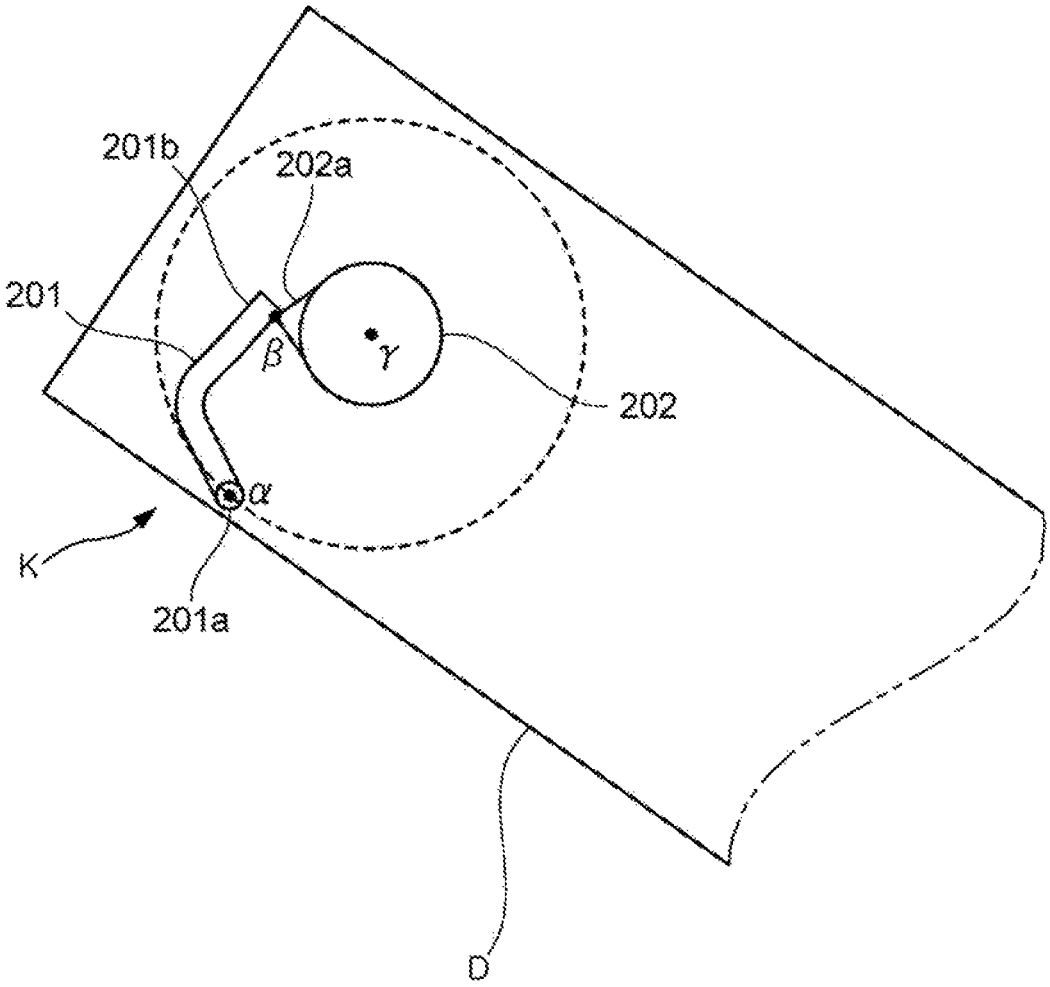

In the embodiment, the bending member 201 and the contacting member 202 are configured to be in contact with each other while the door is between a disengaging position J illustrated in FIG. 9A at which the driving gear 45 is disengaged from the chipped tooth gear 46 due to the door D moving toward the opening position and a maximal opening position K illustrated in FIG. 9B at which the opening angle of the door D is maximum.

That is, when the door D moving toward the opening position reaches the disengaging position J, the bending member 201 and the contacting member 202 which were not in contact comes into contact with each other, and the bending member 201 and the contacting member 202 continuously remain in contact with each other while the door D moves from the disengaging position J to the maximal opening position K. In addition, the opening angle of the door D at the disengaging position J is 90° or larger and is designed to be 130° here. The opening angle of the door D at the maximal opening position K may be designed to be 160°, for example.

In addition, in FIGS. 9A and 9B, the bending member 201 and the contacting member 202 are schematically illustrated for convenience of description.

The bending member 201 is mounted on the door D to integrally rotate with the door D. Here, the bending member 201 is installed at a lower surface of the door D and rotates along a circumference of a center of rotation of the door D (i.e., the shaft center X1 of the hinge shaft Z).

Specifically, the bending member 201 is a plate formed of resin and the like. Here, as the bending member 201, a plate member having a long side and extending in the longitudinal direction is bent once or more when viewed from a flat surface.

The bending member 201 may have a point 201*a* fixed to the door D installed at one end and a point 201*b* in contact with the contacting member 202 to be described below installed at the other end, and the bending member 201 may be configured to be bent by being elastically deformed around a bending center $\alpha$ at the point 201*a* by a force received from the contacting member 202.

The contacting member 202 is disposed such that the point 201*b* (here, the other end) of the bending member 201 comes into contact with the contacting member 202 by movement of the door D toward the opening position. Specifically, the contacting member 202 is non-rotatably fixed to a lower side of the hinge shaft Z or a bottom surface of the housing H.

The contacting member 202 according to the embodiment has a contact surface 202*a* with which the bending member 201 is in contact while moving according to movement of the door D toward the opening position. Here, as illustrated in FIG. 8, the contact surface 202*a* is formed using a half-opening preventing cam 203 that is already installed. In more detail, a protrusion F protruding toward outside is installed at a side surface of the half-opening preventing cam 203, and a surface of the protrusion F inclined from the side surface serves as the contact surface 202*a*.

A detailed method of designing the contact surface 202*a* will be briefly described with reference to FIGS. 10A to 11B.

Figure 10A:
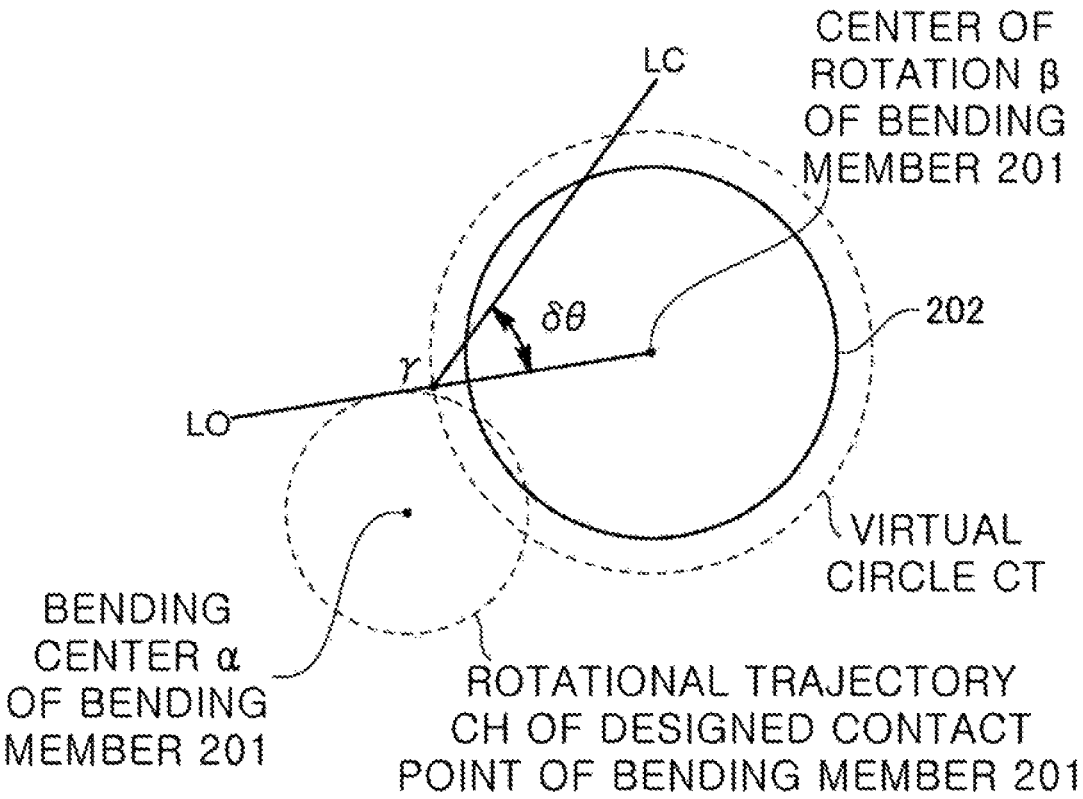
FIGS. 10A and 10B are views for describing a method of designing a contact surface according to the first embodiment.

First, as illustrated in FIG. 10A, a designed contact point between the bending member 201 and the contacting surface 202 draws a rotational trajectory CH centered around the bending center α.

Next, a tangential line LO tangent to the rotational trajectory CH and passing through the center of rotation β of the bending member 201 (e.g., the shaft center X1 of the hinge shaft Z) is drawn. In addition, the tangential line LO is at a side of the designed contact point described above with respect to the bending center α.

In addition, a straight line LC passing through an intersection point γ between a virtual circle CT centered around the center of rotation β and the tangential line LO and forming a predetermined angle δθ with the tangential line LO is drawn. Here, the radius of the virtual circle CT is set according to a preset bending degree of the bending member 201.

Figure 10B:
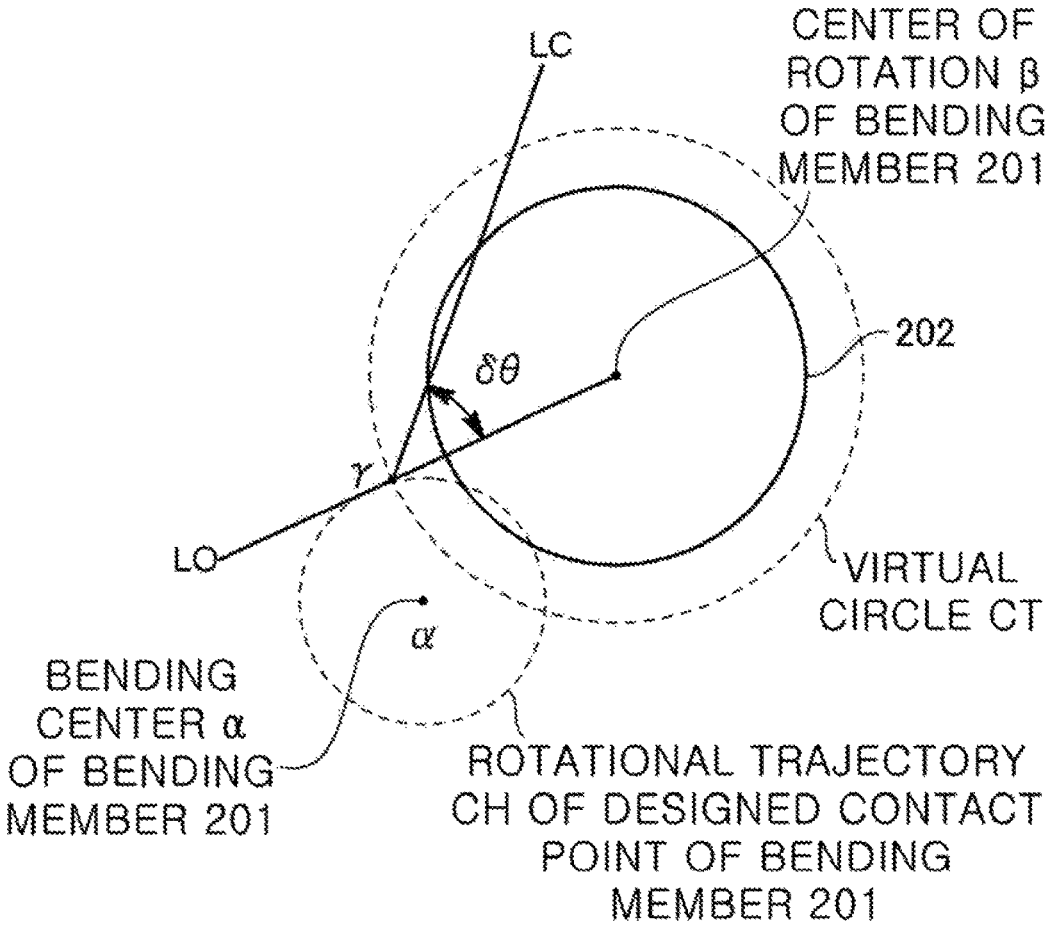

Next, as illustrated in FIG. 10B, the straight line LC is drawn using the method above with the door D at different positions between a position at which the bending member 201 begins to be in contact with the contacting member 202 and a position at which the door D is maximally open.

Figure 11A:
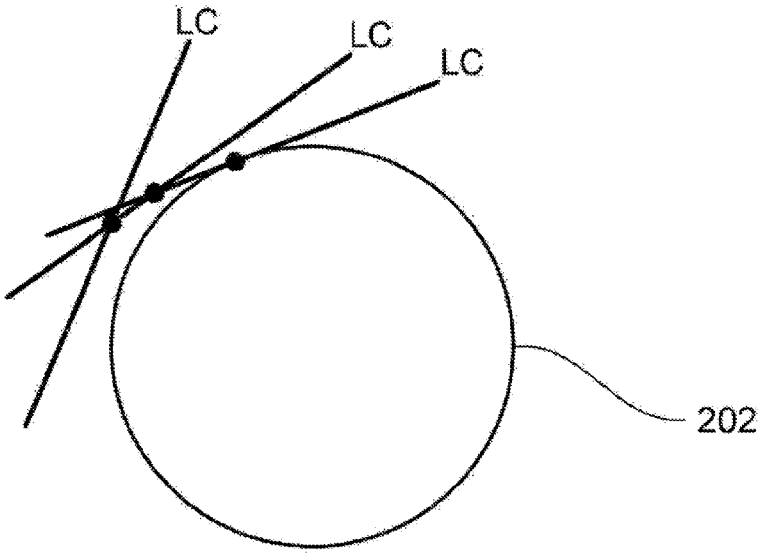
FIGS. 11A and 11B are views for describing the method of designing the contact surface according to the first embodiment.
Figure 11B:
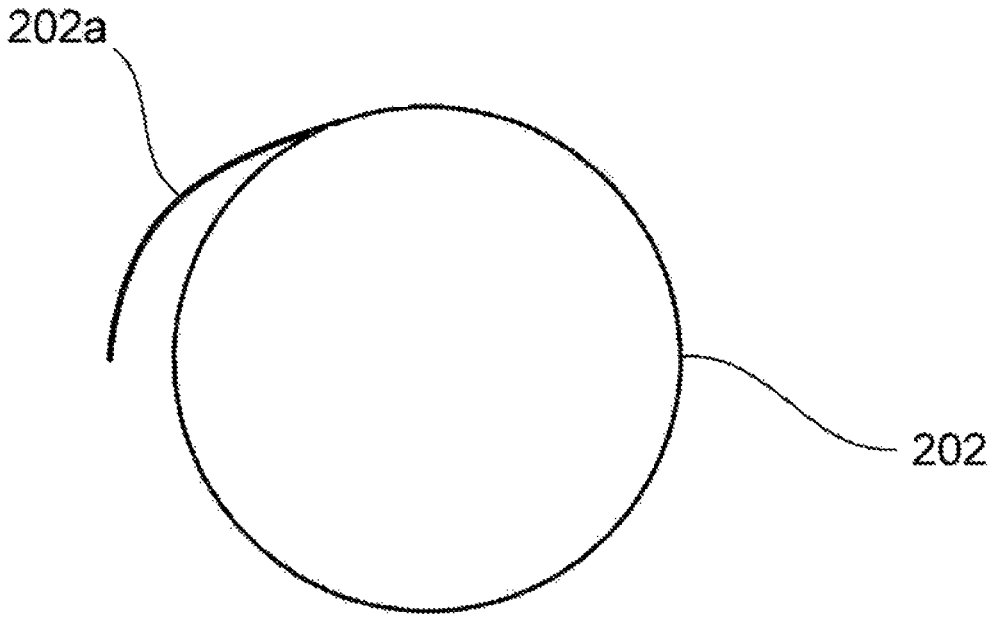

Lastly, as illustrated in FIGS. 11A and 11B, an outer edge of the contact surface 202*a* described above is designed by drawing an arc passing through an intersection point at which a plurality of straight lines LC intersect each other. In addition, design accuracy may be improved as the number of the straight lines LC increases.

In addition, the contact surface 202*a* according to the embodiment is formed such that the angle δθ formed between the tangential line LO and the straight line LC is 30° to 60°. Here, the contact surface 202*a* is formed such that the angle δθ is 45°.

Next, a door controlling device 110 configured to control movement of the door D, i.e., a movement speed of the door D, due to the door opening and closing apparatus 100 will be described.

<Door Controlling Device>

Figure 12:
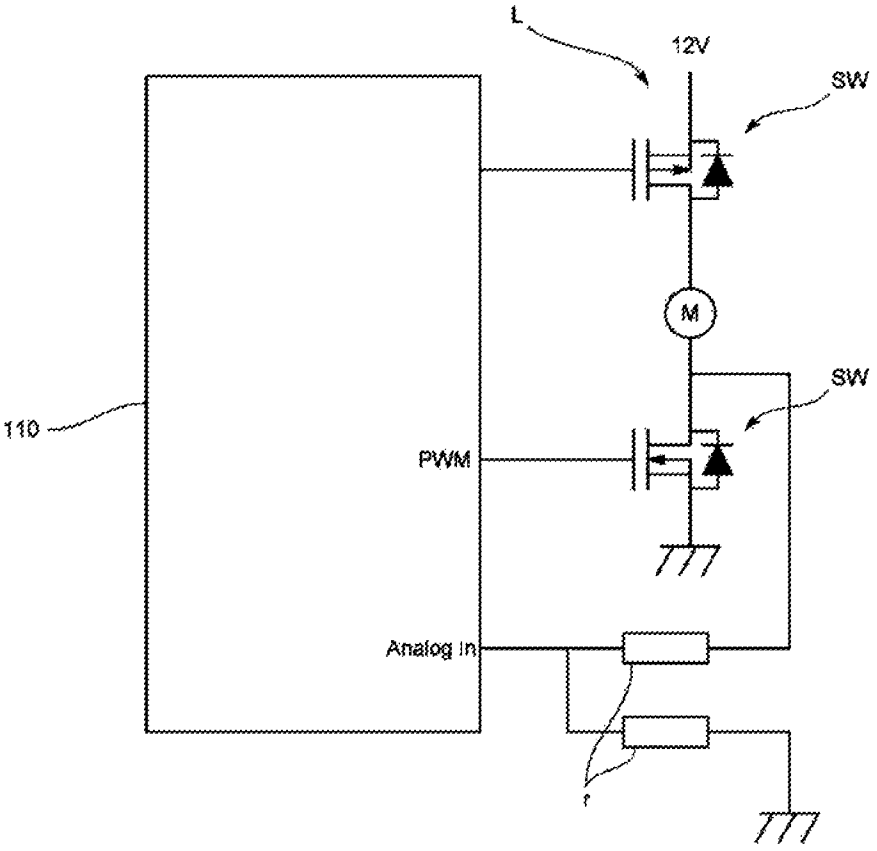
FIG. 12 is a circuit diagram schematically illustrating a door controlling device according to the first embodiment.
Figure 13:
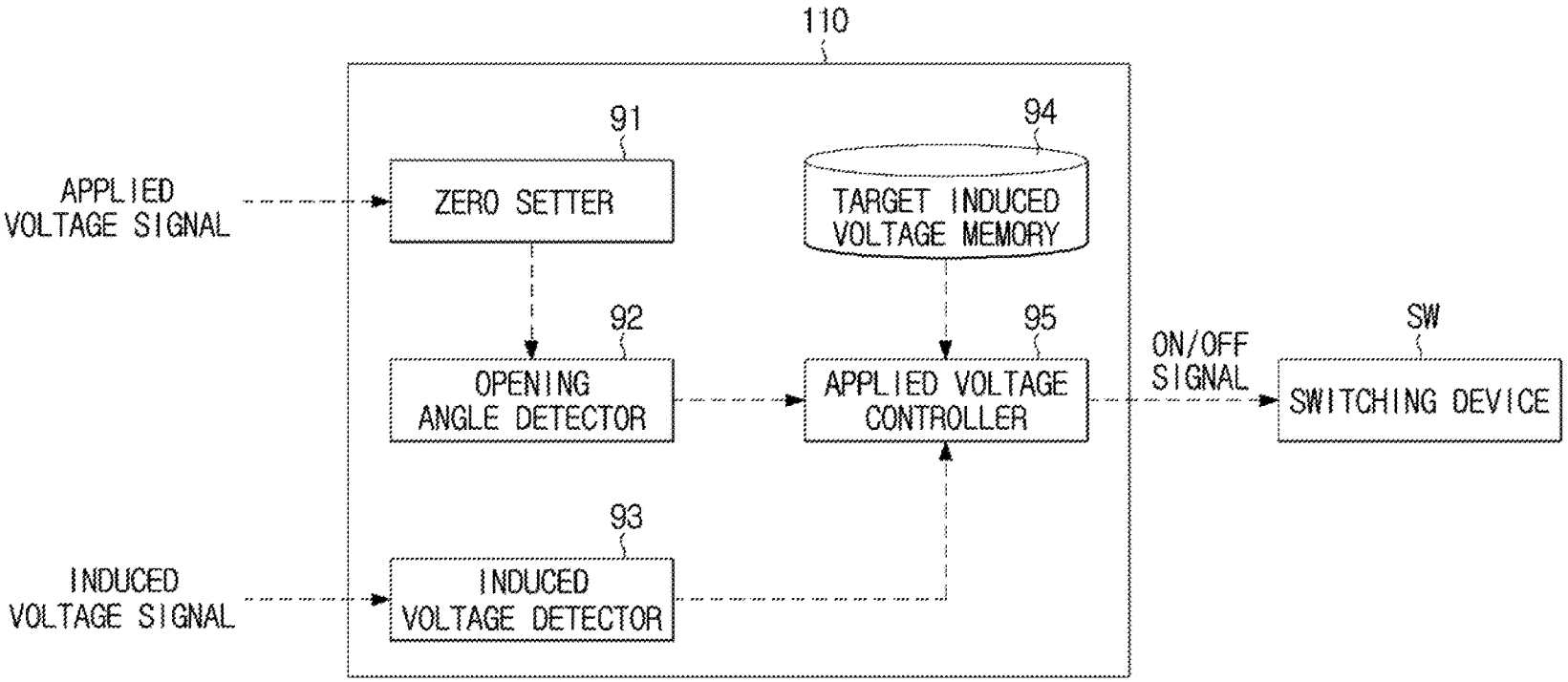
FIG. 13 is a function block diagram illustrating a function of the door controlling device according to the first embodiment.
Figure 14:
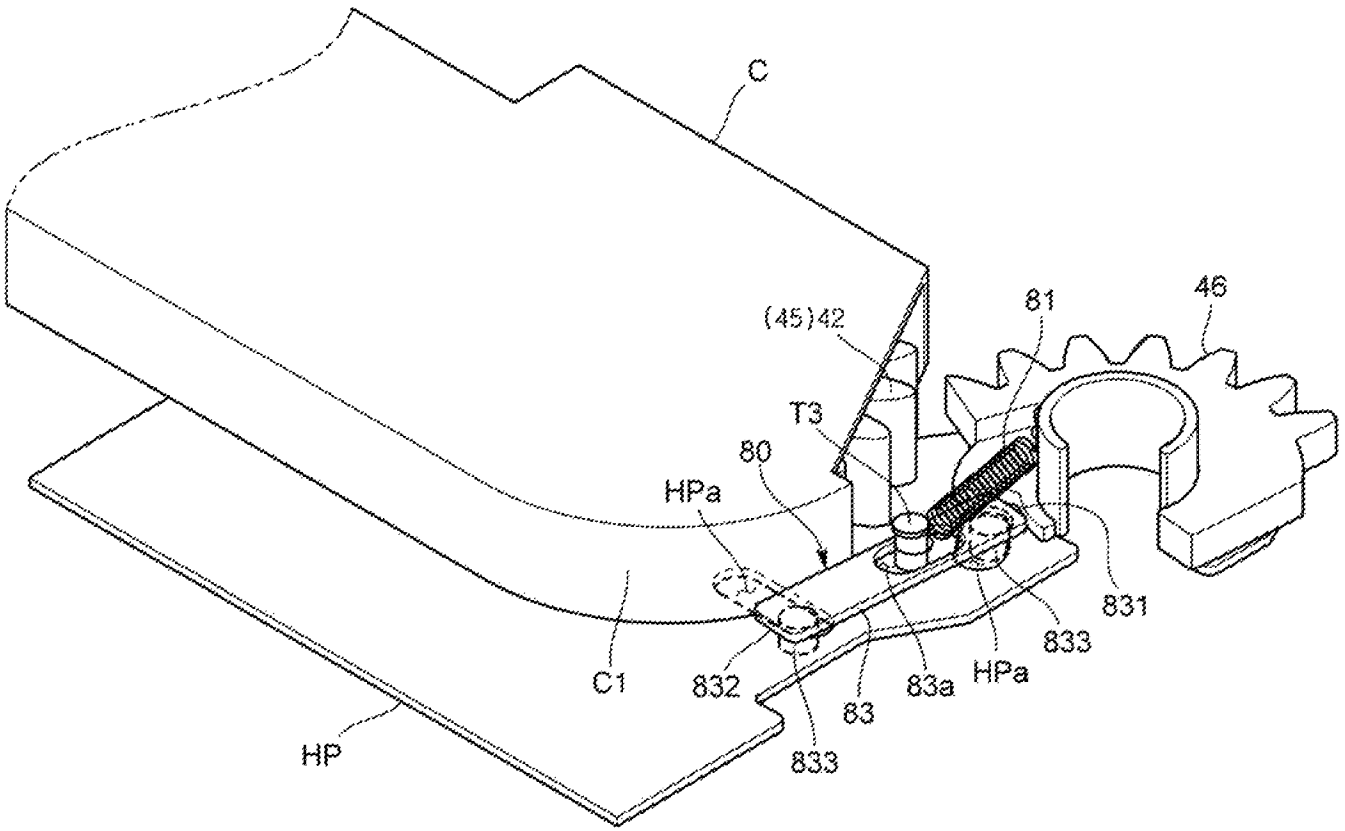
FIG. 14 is a view schematically illustrating a chipped tooth gear rotation apparatus according to a modified example of the first embodiment.

The door controlling device 110 related to the embodiment is connected to a motor driving circuit L driving the motor M described above to control the motor M as illustrated in FIG. 12 and physically includes a central processing unit (CPU), a memory, an analog-digital (A/D) converter, etc. In addition, by a cooperation between the CPU and a peripheral device according to a program stored in a predetermined area of the memory, the door controlling device 110 is configured to serve as a zero setter 91, an opening angle detector 92, an induced voltage detector 93, a target induced voltage memory 94, and an applied voltage controller 95 as illustrated in FIG. 13.

Hereinafter, an operation of the door controlling device 110 will be described with a description of each of the elements above.

First, when a voltage is applied to the motor M via the motor driving circuit L with the door D closed, the driving gears 45 rotate by interlocking with the motor M as described above, and any one of the protrusions 72 presses the hook 71 such that the auxiliary apparatus 30 operates.

Here, since a load applied to the motor M increases once the auxiliary apparatus 30 begins operating and until the door D and the housing H are demagnetized, an operational speed of the motor decreases, and an voltage applied to the motor gradually increases to compensate for the decreased operational speed.

The zero setter 91 sets an opening angle of the door as a zero when the applied voltage for moving the door D toward the opening position reaches a predetermined threshold value with the door D closed. In other words, the zero setter 91 sets a time point at which the applied voltage has reached the predetermined threshold value as a detection start point for detecting the opening angle.

The opening angle detector 92 detects an opening angle from the opening angle set as zero by the zero setter 91. In other words, the detection of the opening angle begins from the detection start point set by the zero setter 91.

In the embodiment, as illustrated in FIGS. 3 and 6, a rotary switch RS is installed at the driving gear 45, and the opening angle detector 92 acquires a signal output from the rotary switch RS to calculate the opening angle. Here, the rotary switch RS may be a rotary encoder using a so-called absolute method in which a 4-bit signal, for example, is output according to rotation of the driving gear 45, and the opening angle detector 92 may calculate opening and closing directions and an opening angle of the door D based on the 4-bit signal.

The induced voltage detector 93 detects an induced voltage generated when the motor M is rotating and transmits an induced voltage signal that represents the induced voltage to the applied voltage controller 95 to be described below.

In the embodiment, as illustrated in FIG. 12, a divider resistance r installed at the motor driving circuit L is used to analog-input the induced voltage signal to the induced voltage detector 93.

The target induced voltage memory 94 is formed at a predetermined area of the memory and stores a target value of an induced voltage preset according to an opening angle of the door D.

The target value is set so that a movement speed of the door D becomes a predetermined speed according to the opening angle. For example, the target value is set so that the movement speed gradually decreases as the door D at the closing position moves toward the opening position.

In the embodiment, a movement angle range of the door D (hereinafter, also simply referred to as a movement range) is divided into a plurality of contiguously divided ranges, and the target value is stored for each of the divided ranges. The movement range may be divided so that sizes of the divided ranges are uniform or the sizes of the divided ranges are different.

The applied voltage controller 95 acquires the induced voltage signal from the induced voltage detector 93 and compares the detected induced voltage with the target value stored in the target induced voltage memory 94 to control the voltage applied to the motor M so that the detected induced voltage becomes the target value.

As illustrated in FIG. 13, the applied voltage controller 95 according to the embodiment may configure the motor driving circuit L by outputting an on/off signal to a switching device SW that is, for example, a MOSFET, and controlling an applied voltage by pulse width modulation (PWM) and change an impact coefficient so that the detected induced voltage becomes the target value.

According to the door opening and closing apparatus 100 related to the embodiment configured as above, since the chipped tooth gear rotation apparatus 80 allows the chipped tooth gear 46 to remain at the non-contacting position Q when the auxiliary apparatus 30 generates the auxiliary force, the door D and the housing H may be demagnetized while the driving gear 45 and the chipped tooth gear 46 is not engaged such that torque of the motor M required for demagnetization may be reduced, and, furthermore, the motor may be made smaller.

In addition, since the driving gear 45 has teeth formed along the entire circumference, the chipped tooth gear 46 may be securely engaged with the driving gear 45 regardless of a position (a rotational angle) of the driving gear 45.

In this way, a problem that may occur with the related art, i.e., a problem that may be caused by manually opening the door D, or an increase of the complexity of control may be prevented such that the door opening and closing apparatus 100 may be more practical compared to the related art.

In addition, since the motor M is installed at the upper portion of the door D, a link member required when the motor M is installed at the upper portion of the housing H may become unnecessary such that a user's hand may be prevented from being stuck in the link member, and the appearance of the refrigerator may be improved.

In addition, since the swing apparatus 50 may switch between the power transmitting state and the power non-transmitting state by moving the pair of idler gears 44 along a flat surface perpendicular to the rotation shaft of the center gear 43, an apparatus for moving a gear in a height direction such as a conventional clutch apparatus may become unnecessary such that the power transmission apparatus 40 may be compactly formed in the height direction.

In addition, since the pair of idler gears 44 move along the flat surface perpendicular to the rotation shaft of the center gear 43 by interlocking with rotation of the center gear 43, the power of the motor M may be used to move the idler gears 44 such that an actuator exclusively used for moving the idler gears 44 may become unnecessary.

In addition, since the power non-transmitting state maintenance apparatus 60 is configured using the idler gear pressing member 61, the power non-transmitting state maintenance apparatus may have a simple configuration, and the whole apparatus may be low-cost and lightweight.

In addition, even when the door is widely open due to inertia, e.g., due to a large number of articles stored at the door D, and the driving gear 45 is disengaged from the chipped tooth gear 46 when the door D is moved toward the opening position, the return apparatus 200 allows the driving gear 45 to be engaged with the chipped tooth gear 46 again such that, after the engagement, the door D may be automatically closed again.

Even when the user has manually opened the door D widely, the return apparatus 200 allows the disengaged driving gear 45 to be engaged with the chipped tooth gear 46 again such that the door D may be automatically closed again.

In addition, since the angle $\delta\theta$ formed between the tangential line LO and the straight line LC is 45°, the restoring force of the bending member 201 may be most efficiently used as a force for rotating the door D toward the closing position.

In addition, since the bending member 201 and the contacting member 202 are configured to continuously be in contact while the door D moves from the disengaging position J to the maximal opening position K, even when the door D is more widely open after the driving gear 45 is disengaged from the chipped tooth gear 46, the driving gear 45 may be securely engaged with the chipped tooth gear 46 again.

In addition, since the bending member 201 is installed at the lower surface of the door D and the contacting member 202 is installed at the lower side of the hinge shaft Z or the bottom surface of the housing H, the bending member 201 and the contacting member 202 are not exposed such that worsening of the appearance of the refrigerator may be prevented.

In addition, since the contact member 202 is configured using a part of the existing half-opening preventing cam 203, the return apparatus 200 may be configured without unnecessarily increasing the number of parts.

In addition, according to the door controlling device 110 related to the embodiment configured as above, since an induced voltage of the motor M is controlled to become a target value preset according to an opening angle of the door D, a movement speed of the door D may be a speed according to the target value such that the movement speed of the door D may be controlled as desired regardless of a number of articles stored at the door D.

In addition, since the movement speed of the door D is controlled to a desired speed by controlling the induced voltage to become the target value, a sensor exclusively used for detecting the movement speed of the door D is unnecessary.

However, since the door opening and closing apparatus 100 described above is configured such that the protrusion 72 presses the hook 71 to operate the auxiliary apparatus 30 by movement of the motor M when the door D at the closing position is moved toward the opening position, a standby position of the protrusion 72 for when the door D is closed is not the same every time. In this regard, time taken for the door to begin opening once the motor M has begun moving is not necessarily the same every time.

With such a configuration, according to the door controlling device 110 related to the embodiment, since the zero setter 91 sets an opening angle as zero when an applied voltage for opening the door D has reached a predetermined threshold value, the opening angle may be set as a zero at almost the same time points every time. Consequently, even when a time difference exists between the time point at which the motor M begins moving and the time point at which the door D begins opening, a variation does not occur in a detected opening angle relative to a zeroed opening angle such that the opening angle may be more precisely detected.

In addition, since the opening angle detector 92 detects the opening angle based on a signal output from the rotary switch RS, the configuration of the door controlling device 110 may be simple and low-cost. Furthermore, a moving direction (opening and closing directions) of the door D may be recognized.

Modified Example of the First Embodiment

In addition, the present disclosure is not limited to the embodiment above.

Although the guide surface configured to guide movement of the other end of the rotating member is a bent surface protruding outward in the embodiment above, the guide surface may also be a bent surface recessed inward or a flat surface.

In addition, although the motor-side gear and the door-side gear are installed in plurality in the embodiment above, the numbers thereof are not limited and a gear may also be singly provided.

In addition, although the rotation load member is an elastic member in the embodiment above, the rotation load member may also generate friction between the idler gear and the mounting member. Specifically, examples of the rotation load member may include a sheet member formed of felt and the like and magnetic resistance such as by a magnet.

In addition, although a bending member integrally rotates with the door and the contacting member is fixed to the hinge shaft or the housing in the return apparatus according to the embodiment above, the bending member may be fixed to the hinge shaft or the housing, and the contacting member may integrally rotate with the door.

In addition, the return apparatus may also be installed at an upper side of the refrigerator. Specifically, for example, the bending member may be installed at an upper side of the door, and the contacting member may be installed at an upper side of the hinge shaft or an upper surface of the housing.

In addition, the shape of the bending member is not limited to the plate shape and may also be suitably changed to a rod shape, a block shape, etc.

In addition, the contact surface is not limited to the shape designed according to the design method of the embodiment above and may also be an inclined surface inclined at a predetermined angle with respect to a rotating direction of the point in contact with the bending member, a bent surface, or a flat surface, for example.

With regards to the door controlling device, although the opening angle detector according to the embodiment above detects an opening angle based on a signal output from the rotary switch, an incremental type rotary encoder may also be installed at the driving gear, and the opening angle detector may also detect the opening angle based on a signal output from the encoder.

In addition, although the target value of an induced voltage is set so that the movement speed gradually decreases according to movement of the door toward the opening position in the embodiment above, the target value may also be set so that the movement speed initially increases according to the movement of the door toward the opening position and then gradually decreases, and may also be suitably changed in other ways.

In addition, although the chipped tooth gear rotation apparatus 80 is configured to rotate the chipped tooth gear 46 by rotation of the rotating member 82 in the embodiment above, the chipped tooth gear rotation apparatus 80 may also use a sliding member 83 instead of the rotating member 82 to rotate the chipped tooth gear 46.

In more detail, the chipped tooth gear rotation apparatus 80 rotates the chipped tooth gear 46 between the contacting position P at which the chipped tooth gear 46 is in contact with the driving gear 45 (here, the door-side gear 42 closest to the door) and the non-contacting position Q at which the chipped tooth gear 46 is not in contact with the driving gear 45 by interlocking the chipped tooth gear 46 with opening and closing of the door D. The chipped tooth gear rotation apparatus 80 includes the chipped tooth gear pressing member 81 configured to press the chipped tooth gear 46 from the non-contacting position Q toward the contacting position P and the sliding member 83 configured to slide by interlocking with rotation of the door D.

Since the chipped tooth gear pressing member 81 has the same configuration as in the embodiment above, description thereof will be omitted here.

The sliding member 83 presses the chipped tooth gear 46 to rotate the chipped tooth gear 46 from the contacting position P to the non-contacting position Q when the door D at the opening position is moved toward the closing position. The sliding member 83 is disposed so that one end 831 abuts the chipped tooth gear 46, and the other end 832 abuts the casing C when the door D is at the closing position.

Specifically, the sliding member 83 is formed in a flat plate shape, and a slider 833 configured to slide within a slot HPa installed at a hinge plate HP connecting the door D to the housing H is installed at each of the one end 831 and the other end 832, for example. In addition, a slot may be installed at the one end 831 and the other end 832 of the sliding member 83, and a slider may also be installed at the hinge plate HP.

Although a slot 83*a* into which a mounting portion for mounting the chipped tooth gear pressing member 81 is slidably inserted is formed at the sliding member 83 according to the embodiment, the shape of the sliding member 83 may also be suitably changed.

Figure 15A:
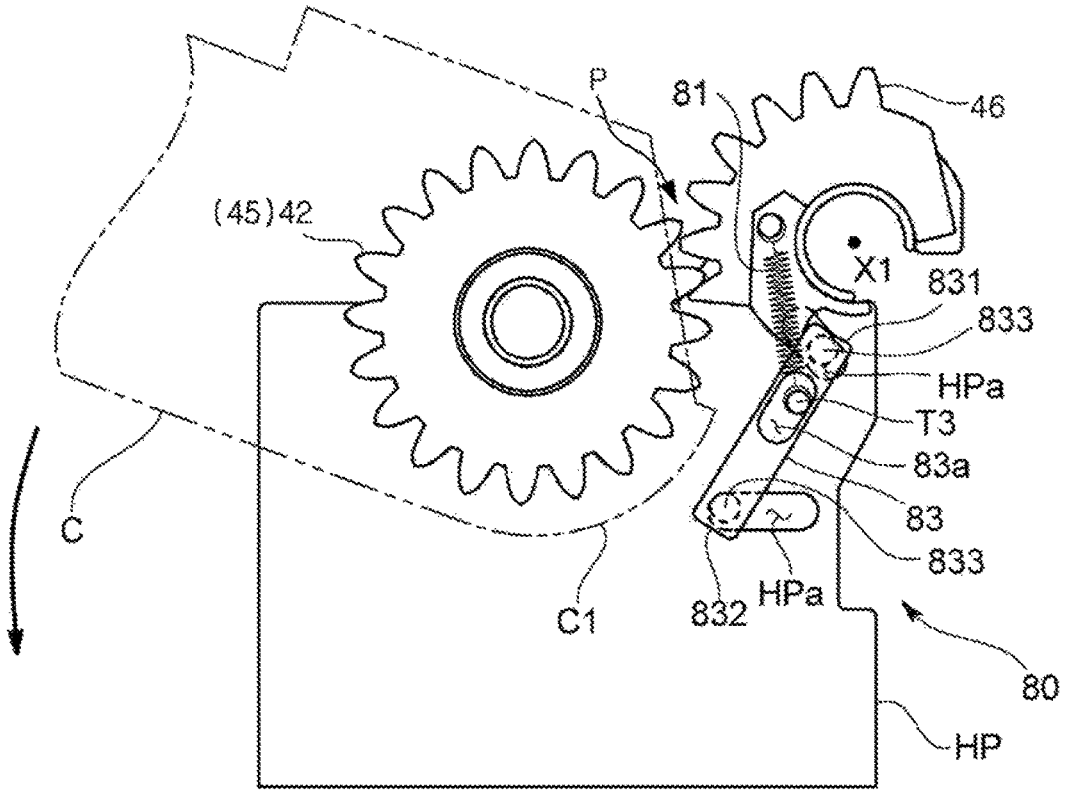
FIGS. 15A and 15B are views for describing an operation of the chipped tooth gear rotation apparatus according to the modified example of the first embodiment.

When the door D at the opening position begins rotating toward the closing position about the shaft center X1 of the hinge shaft Z with the configuration described above as illustrated in FIG. 15A, the other end 832 of the sliding member 83 is pressed to the guide surface C1 of the casing C, and each of the sliders 833 slides within the slot HPa. Here, the one end 831 of the sliding member 83 presses an end surface of the chipped tooth gear 46, and the pressing force opposes the pressing force of the chipped tooth gear pressing member 81 and rotates the chipped tooth gear 46 from the contacting position P toward the non-contacting position Q.

Figure 15B:
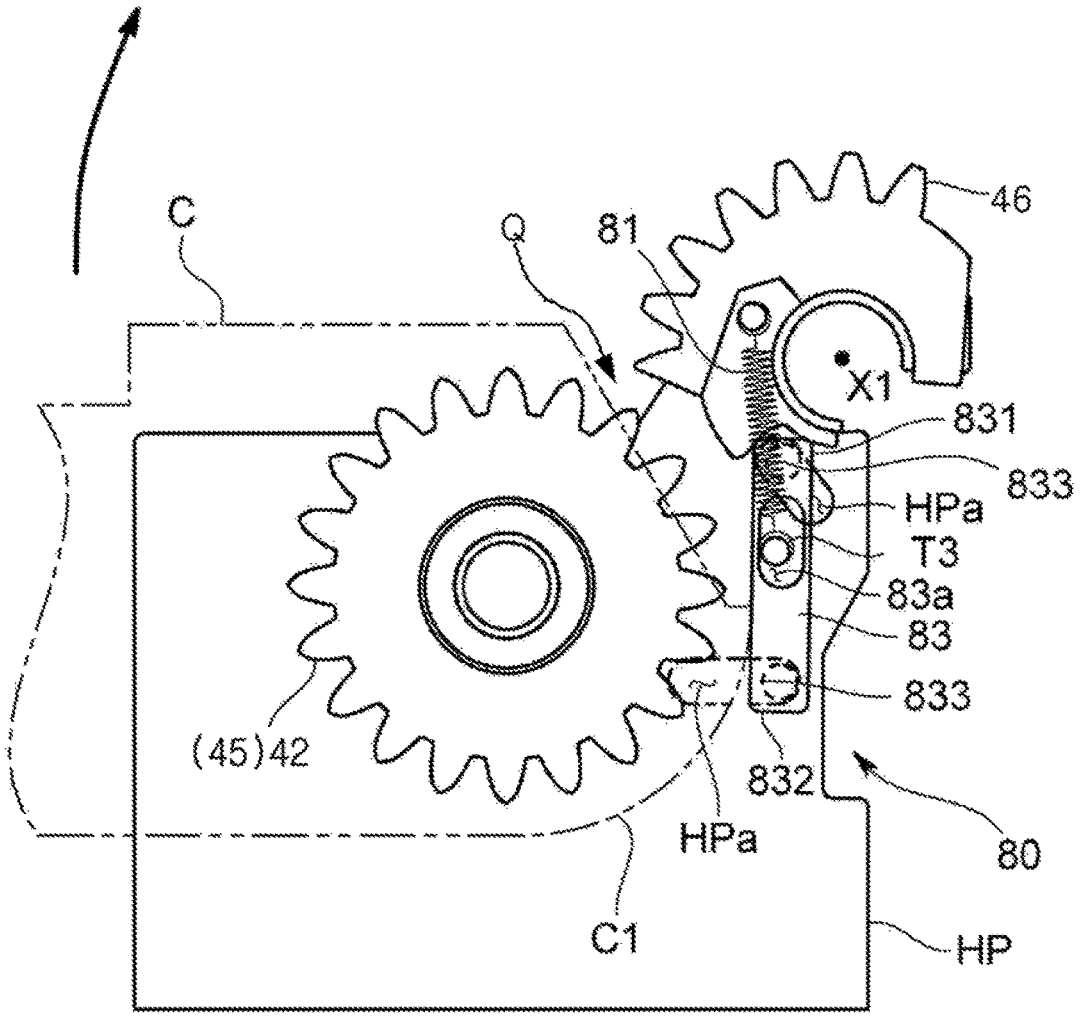

Meanwhile, when the door D at the closing position begins rotating toward the opening position about the shaft center X1 of the hinge shaft Z as illustrated in FIG. 15B, the chipped tooth gear 46 rotates from the non-contacting position Q toward the contacting position P by the chipped tooth gear pressing member 81, and the chipped tooth gear 46 comes into contact with the driving gear 45. Here, the one end 831 of the sliding member 83 slides in a direction of moving away from the chipped tooth gear 46, and, according to the sliding movement, the other end 832 slides along the guide surface C1 while abutting the guide surface C1.

In addition, the present disclosure is not limited to the embodiment above.

Second Embodiment

Hereinafter, a door opening and closing apparatus according to a second embodiment will be described with reference to FIGS. 16 to 17B. Unlike the first embodiment, the chipped tooth gear rotation apparatus 80 in the door opening and closing apparatus according to the second embodiment is configured using a magnetic force of a magnet instead of an elastic force of a spring and the like as in the first embodiment. Hereinafter, the chipped tooth gear rotation apparatus 80 will be described. In addition, movement of the chipped tooth gear 46 is the same as in the first embodiment.

Figure 16:
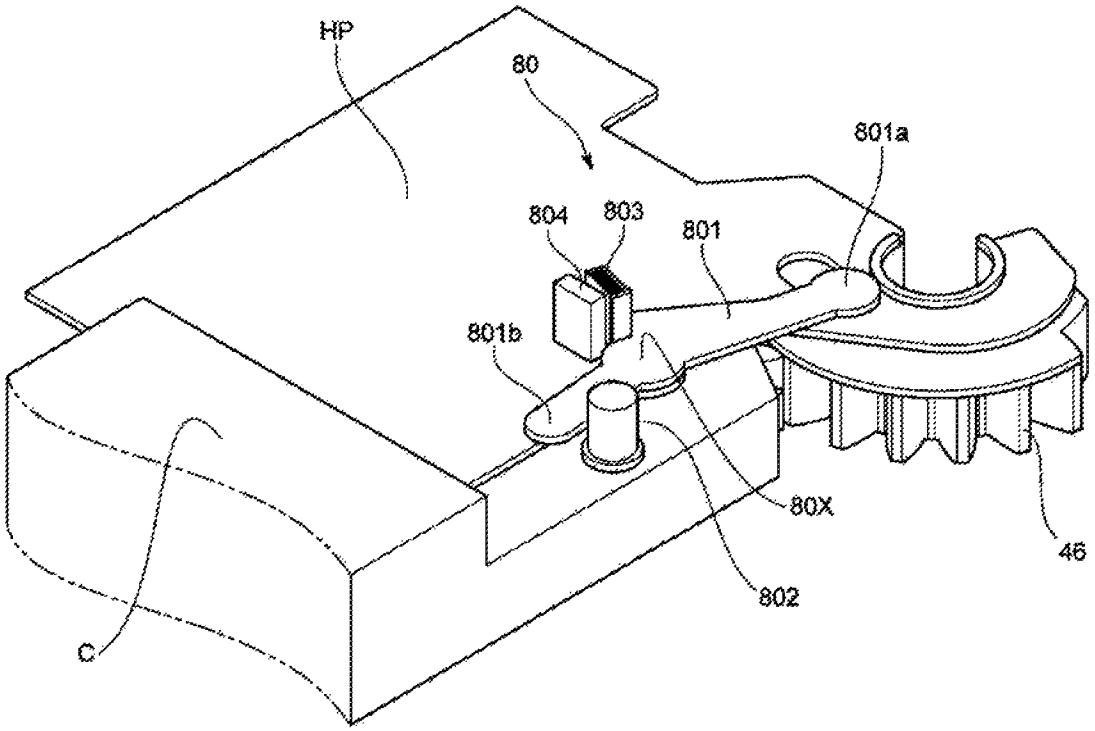
FIG. 16 is a view schematically illustrating a chipped tooth gear rotation apparatus according to a second embodiment.
Figure 17A:
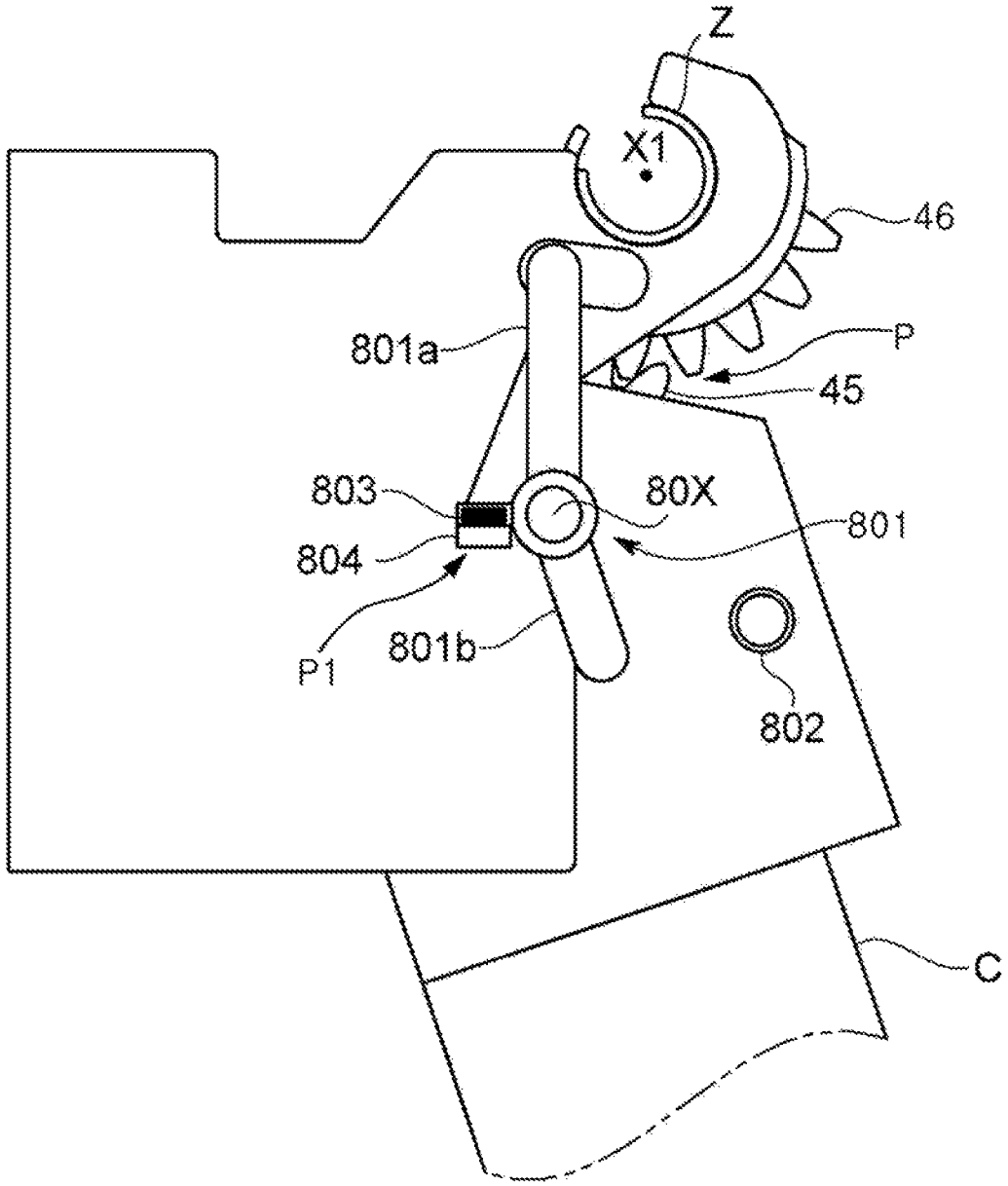
FIGS. 17A and 17B are views for describing an operation of the chipped tooth gear rotation apparatus according to the second embodiment.
Figure 17B:
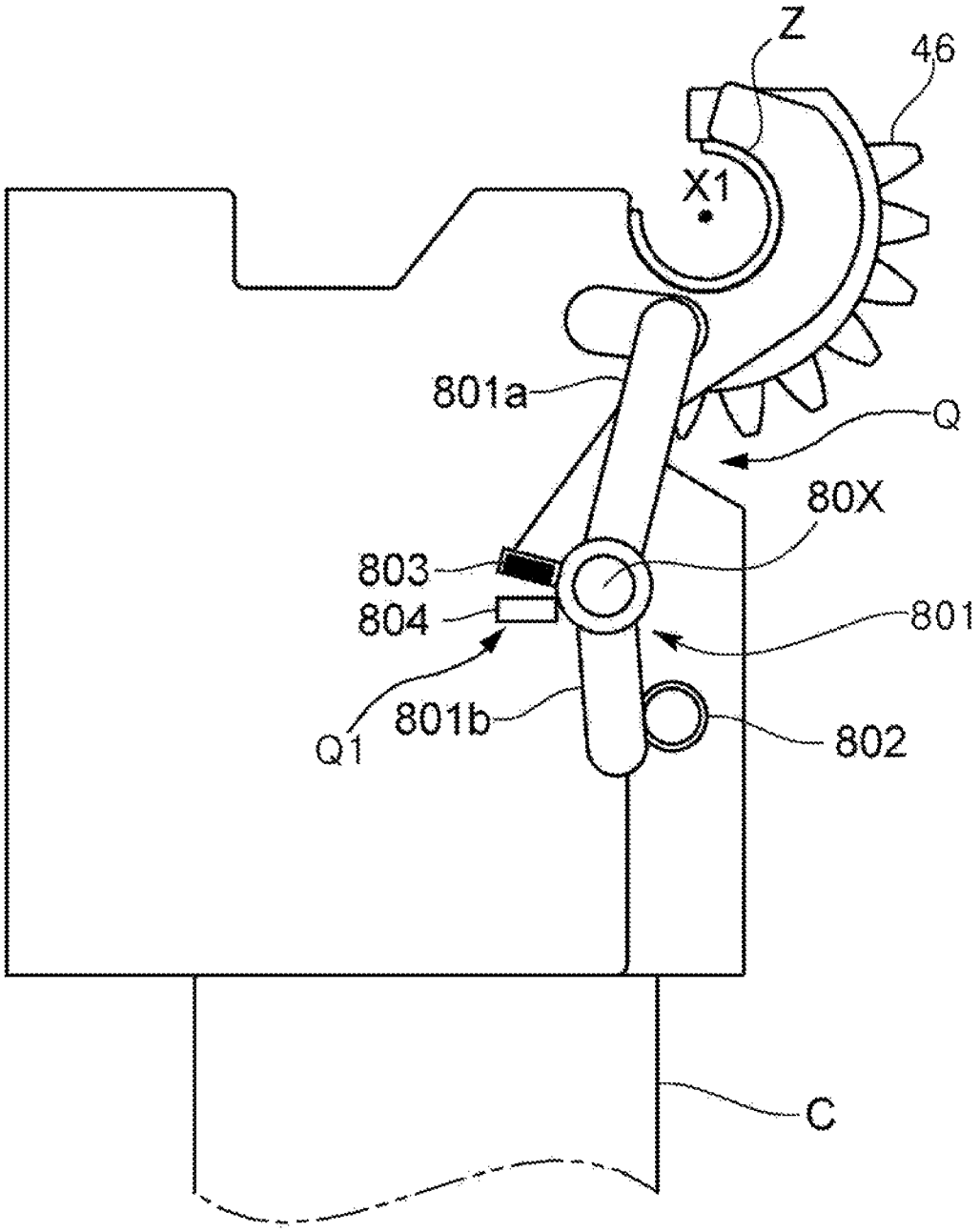

As illustrated in FIGS. 16 to 17B, the chipped tooth gear rotation apparatus 80 includes a link member 801 connected to the chipped tooth gear 46 and configured to move between an abutting position P1 at which the link member 801 abuts an abutted portion 804 fixed to the housing-side and a separating position Q1 at which the link member 801 is spaced apart from the abutted portion 804 by a magnetic force and a regulating member 802 installed at the door-side to come into contact with the link member 801 when the door is at the closing position to regulate movement of the link member.

The link member 801 is, for example, mounted on the hinge plate HP connecting the door to the housing to be rotatable along a circumference of a predetermined rotation shaft 80X and has the chipped tooth gear 46 mounted on one end 801*a* thereof.

The link member 801 according to the embodiment is configured to rotate from the separating position Q1 to the abutting position P1 by being pulled toward the abutted portion 804 formed of metal installed at the hinge plate HP by a magnetic force and rotate the chipped tooth gear 46.

Specifically, the link member 801 has a magnet 803 configured not to abut the abutted portion 804 when the door is at the closing position and disposed near the abutted portion 804.

The regulating member 802 is, for example, installed at the casing C to move together with the door and abuts the other end 801*b* of the link member 801 when the door is at the closing position to prevent the magnet 803 from being pulled toward the abutted portion 804.

When the door at the opening position begins rotating toward the closing position about the shaft center X1 of the hinge shaft Z with the configuration described above as illustrated in FIG. 17A, the other end 801*b* of the link member 801 is pressed to the guide surface C1 of the casing C and rotates along the circumference of the rotation shaft 80X while sliding along the guide surface C1. Here, the one end 801*a* of the link member 801 presses the end surface of the chipped tooth gear 46 and rotates the chipped tooth gear 46 from the contacting position P toward the non-contacting position Q.

Meanwhile, when the door at the closing position begins rotating toward the opening position about the shaft center X1 of the hinge shaft Z as illustrated in FIG. 17B, the regulating member 802 moves away from the other end 801*b* of the link member 801. In this way, the magnet 803 is pulled toward the abutted portion 804 by a magnetic force. Thus, the link member 801 rotates from the separating position Q1 to the abutting position P1, and, according to the rotation, the chipped tooth gear 46 rotates from the non-contacting position Q to the contacting position P to be engaged with the driving gear 45.

Modified Example of the Second Embodiment

Figure 18A:
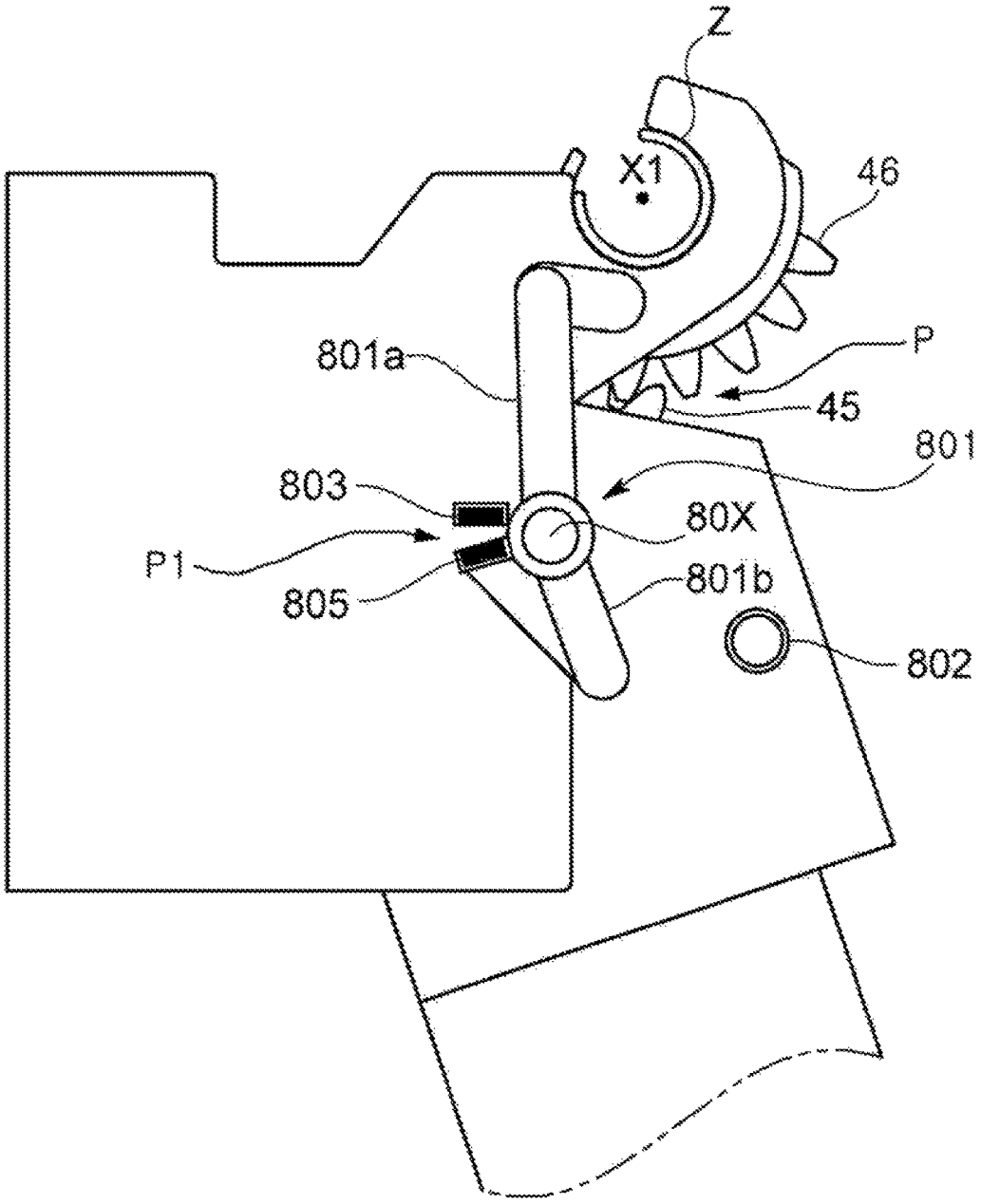
FIGS. 18A and 18B are views schematically illustrating a chipped tooth gear rotation apparatus according to a modified example of the second embodiment.
Figure 18B:
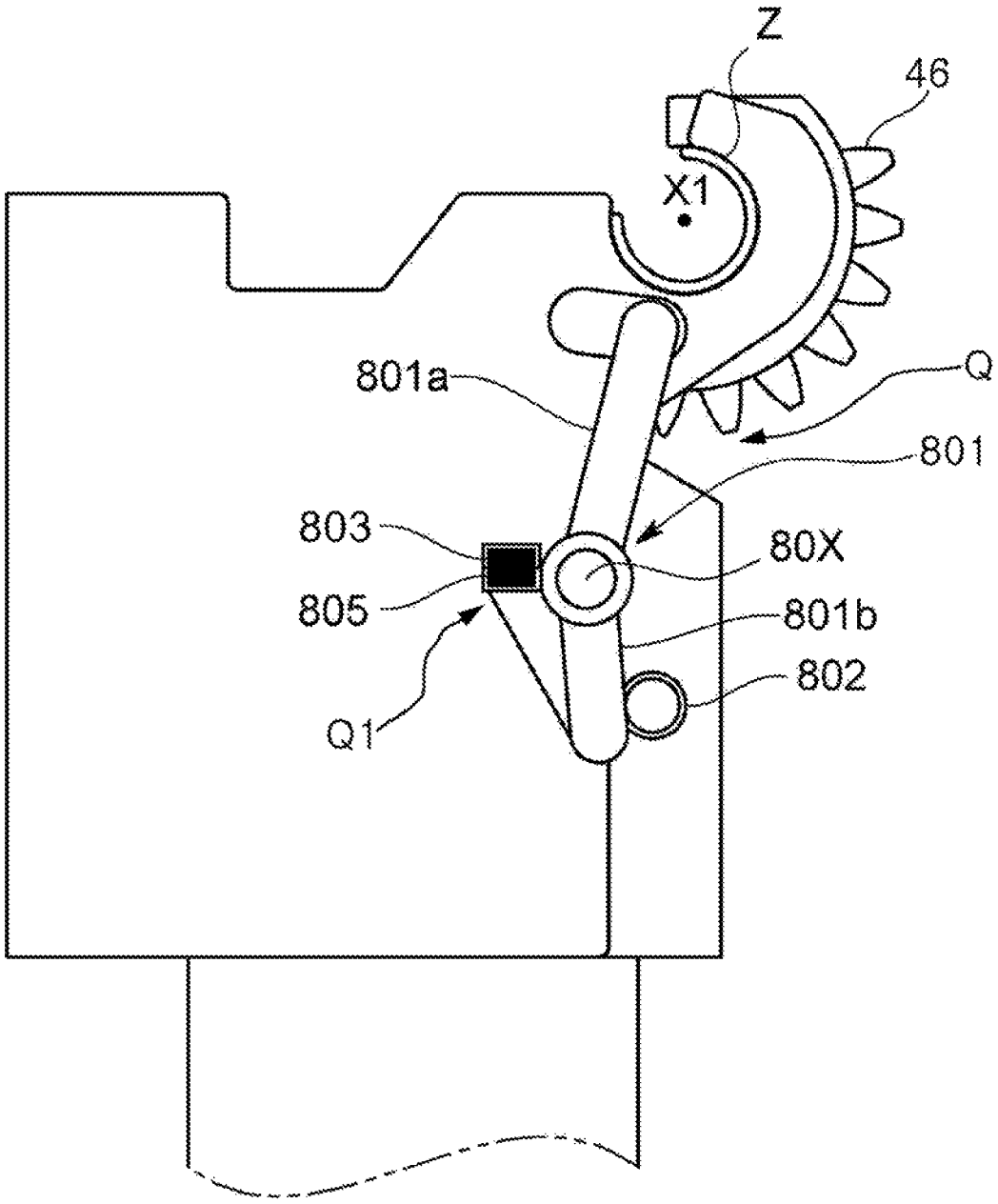

Although the chipped tooth gear rotation apparatus 80 according to the embodiment above is configured so that the chipped tooth gear 46 rotates due to the magnet 803 being pulled toward the abutted portion 804, a second magnet 805 configured to resist the magnet 803 of the link member 801 may also be installed at the abutted portion 804 as illustrated in FIGS. 18A and 18B to rotate the chipped tooth gear 46 by resisting the magnets 803 and 805 at two sides.

Third Embodiment

Hereinafter, the swing apparatus 50 and the power non-transmitting state maintenance apparatus 60 of the door opening and closing apparatus 100 according to a third embodiment which are different from the embodiments above will be described.

Figure 19:
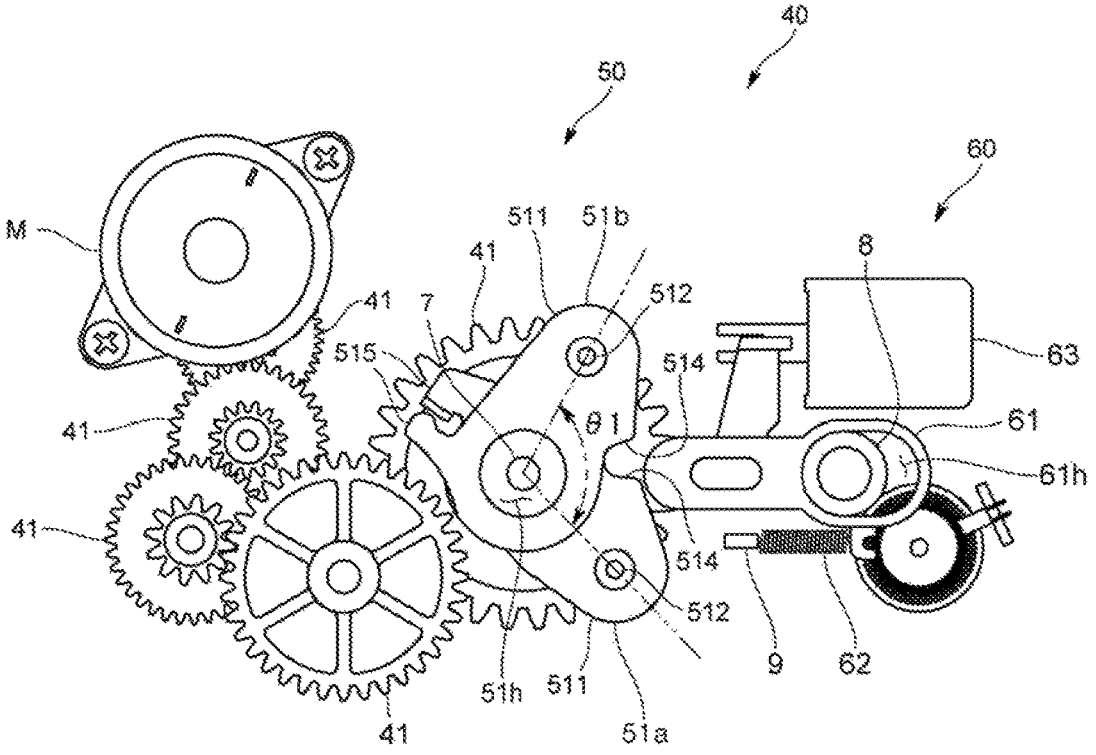
FIG. 19 is a view schematically illustrating a swing apparatus according to a third embodiment.
Figure 20:
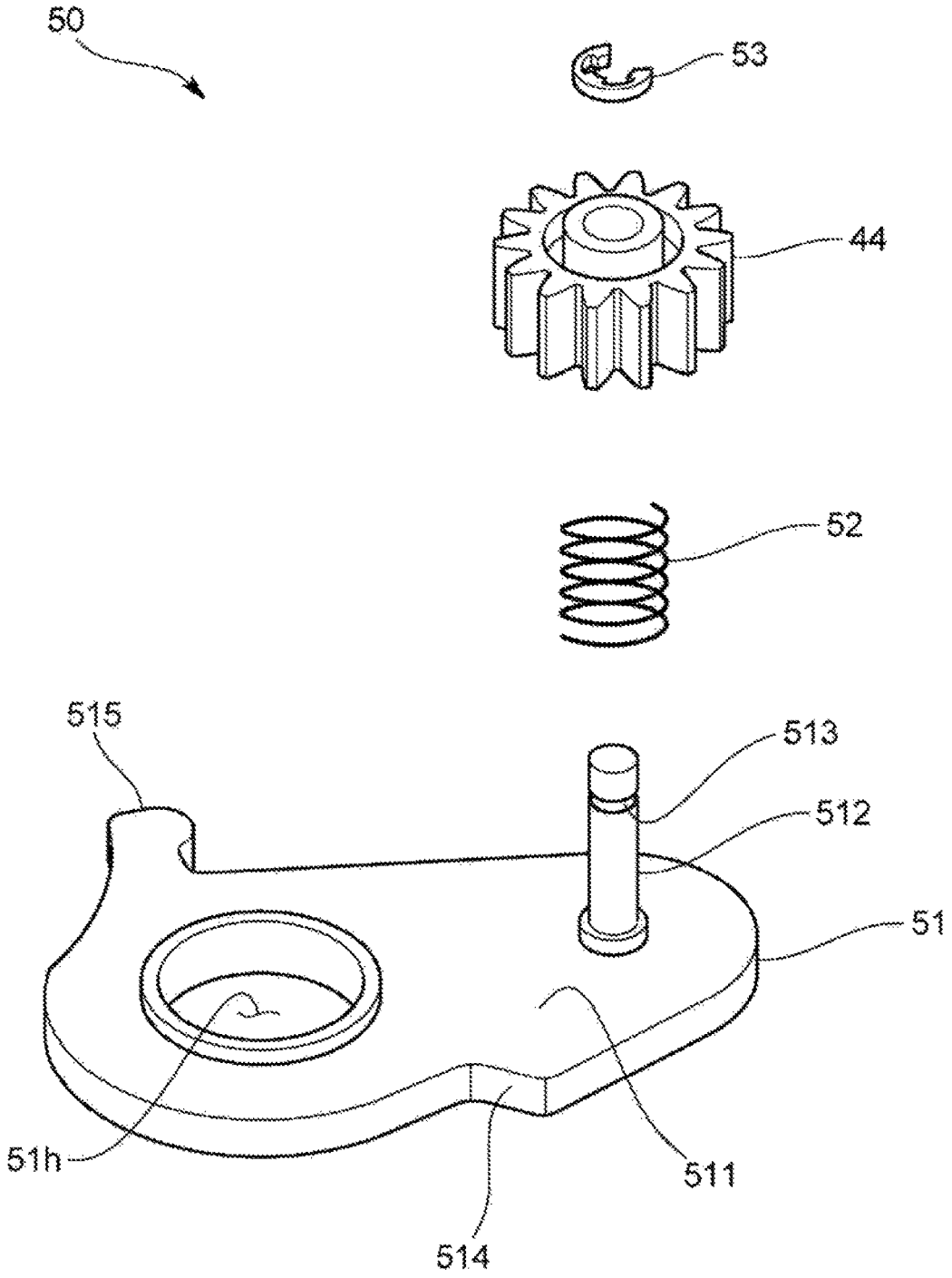
FIG. 20 is a view schematically illustrating the swing apparatus according to the third embodiment.

Although the swing apparatus according to the embodiments above has a single mounting member, the swing apparatus according to the third embodiment has a pair of mounting members 51 (hereinafter, to distinguish each of the pair of mounting members 51, each of the pair of mounting members 51 may also be referred as a first mounting member 51*a* and a second mounting member 51*b*) as illustrated in FIGS. 19 and 20.

In addition, since configurations of the rotation load member 52 and the pressing member 53 are the same as in the embodiments above, descriptions thereof will be omitted.

Specifically, as illustrated in FIG. 20, each of the pair of mounting members 51 includes a flat plate member 511 having a through-hole 51*h* formed by penetrating in the thickness direction and an idler gear mounting shaft 512 configured to vertically stand on the flat plate member 511 and have an idler gear mounted thereon.

The through-hole 51*h* is formed in a substantially circular shape and is formed larger than a size of a diameter of the center gear mounting shaft 7 on which the center gear 43 is mounted. In this way, since the mounting member 51 may pass through the center gear mounting shaft 7 via the through-hole 51*h*, the mounting member 51 is rotatable about the center gear mounting shaft 7.

While assembled as described above, the swing apparatus 50 according to the embodiment is configured such that the first mounting member 51*a* and the second mounting member 51*b* form a predetermined opening angle θ1 toward the door-side gear 42 as illustrated in FIG. 19. The opening angle θ1 is, in other words, an angle formed by rotation shafts of the idler gears 44*a* and 44*b* about the rotation shaft of the center gear 43.

In the third embodiment, an end portion 514 formed at the flat plate member 511 of each of the mounting members 51 is disposed within the opening angle 91. In addition, an angle regulator 515 formed at the opposite side of the end portion 514 around the center gear mounting shaft 7 and configured to regulate the opening angle θ1 is installed at each of the mounting members 51.

Specifically, as illustrated in FIGS. 19 and 20, the angle regulator 515 is a protrusion protruding outward from an outer surface of the flat plate member 511. The distance between the angle regulators 515 decreases when the opening angle θ1 becomes smaller, and the angle regulators 515 come into contact with each other when the opening angle θ1 reaches a predetermined angle.

Due to the configuration described above, the idler gears 44*a* and 44*b* remain spaced apart by at least a predetermined distance, and a case in which both of the idler gears 44*a* and 44*b* at two sides are engaged with the door-side gear 42 may be prevented.

Next, the power non-transmitting state maintenance apparatus 60 according to the third embodiment will be described.

As illustrated in FIG. 19, the power non-transmitting state maintenance apparatus 60 regulates movements of the pair of idler gears 44 due to the swing apparatus 50 described above. Since neither of the idler gears 44 is engaged with the door-side gear 42, the power non-transmitting state in which the power of the motor M is not transmitted to the door-side gear 42 is reached. In the power non-transmitting state, the door opening and closing apparatus 100 is in a manual mode in which the door D may be manually opened and closed.

Figure 21A:
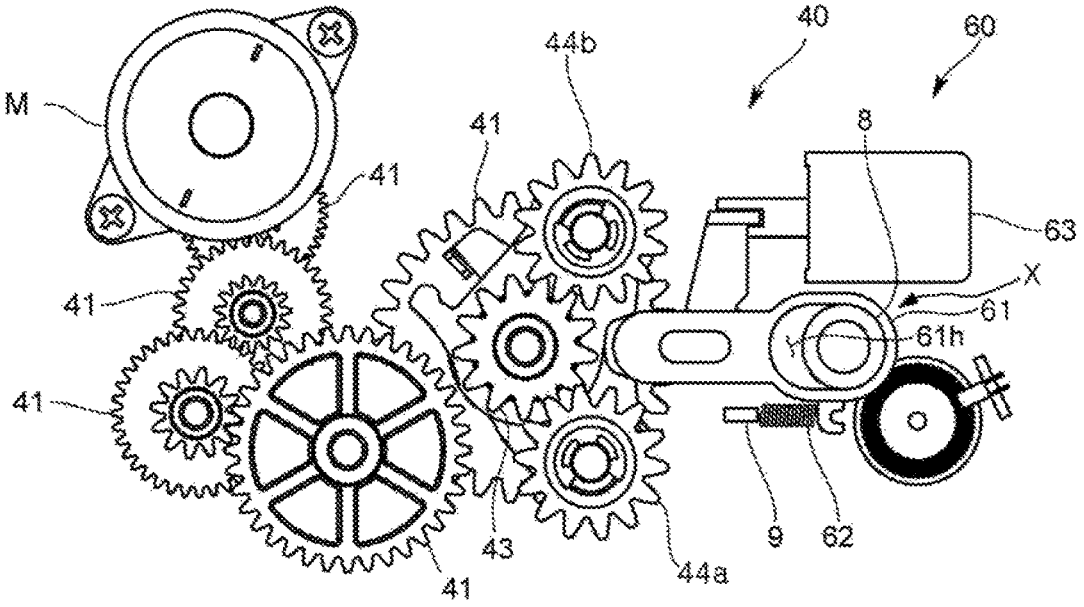
FIGS. 21A and 21B are views schematically illustrating a configuration of a power non-transmitting state maintenance apparatus according to the third embodiment.
Figure 21B:
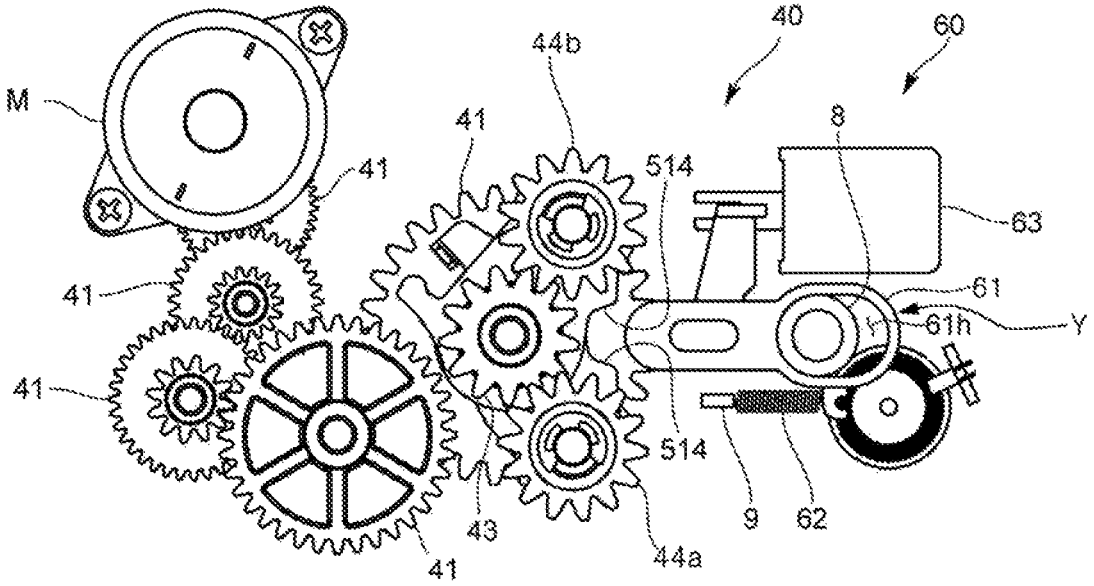

Specifically, the power non-transmitting state maintenance apparatus 60 includes a regulating member 61 configured to move between a regulating position X illustrated in FIG. 21A at which movements of the pair of idler gears 44 due to the swing apparatus 50 is regulated and a removing position Y illustrated in FIG. 21B at which the regulation at the regulating position X is removed, a pressing member 62 configured to press the regulating member 61 to the regulating position X, and a regulation removing apparatus 63 configured to move the regulating member 61 from the regulating position X to the removing position Y.

The regulating member 61 is configured to be able to reciprocate with respect to a door-side gear mounting shaft 8 on which the door-side gear 42 is mounted. Specifically, one end of the regulating member 61 is formed in a semicircular shape, and a through-hole 61*h* penetrating in the thickness direction is formed at the other end thereof.

The through-hole 61*h* is formed in a substantially slot-like shape and is formed larger than a size of a diameter of the door-side gear mounting shaft 8. In this way, since the regulating member 61 may pass through the door-side gear mounting shaft 8 via the through-hole 61*h*, the regulating member 61 may reciprocate with respect to the door-side gear mounting shaft 8.

The regulating member 61 moves between the regulating position X and the removing position Y by the reciprocating movement described above. At the regulating position X, the one end of the regulating member 61 is interposed between the first mounting member 51*a* and the second mounting member 51*b* to regulate revolution of the pair of idler gears 44. At the removing position Y, the one end is not in contact with either the first mounting member 51*a* or the second mounting member 51*b* and allows the revolution of the pair of idler gears 44.

In addition, at the regulating position X, the one end of the regulating member 61 is configured to fit into a gap formed between the end portions 514 of the flat plate members 511 described above.

The pressing member 62 assigns a pressing force from the removing position Y toward the regulating position X with respect to the regulating member 61. In the embodiment, the pressing member 62 is an elastic member such as spring having one end mounted on the regulating member 61 and the other end mounted on a fixing member 9 fixed to the casing, for example.

The regulation removing apparatus 63 moves the regulating member 61 from the regulating position X to the removing position Y. Here, the regulation removing apparatus 63 is mounted on the regulating member 61 and receives a control signal from an unillustrated controller, for example, to assign a removing force in the opposite direction of the pressing force with respect to the regulating member 61.

In more detail, the regulation removing apparatus 63 according to the embodiment is configured to instantaneously operate a solenoid (unillustrated) when the control signal is received and assign the removing force to the regulating member 61 by the instantaneous conduction.

According to the configuration described above, the regulation removing apparatus 63 moves the regulating member 61 from the regulating position X to the removing position Y by instantaneously operating the solenoid (unillustrated) such that the pair of idler gears 44 revolve due to torque that attempts to revolve along the circumference of the center gear 43, the idler gear 44*a* at one side or the idler gear 44*b* at the other side is engaged with the door-side gear 42, and the power non-transmitting state is switched to the power transmitting state.

Here, when the idler gear 44*a* at one side or the idler gear 44*b* at the other side is engaged with the door-side gear 42, a tangential force is applied to the idler gear 44 from the center gear 43 and the door-side gear 42 via an engaged portion. In this way, when the power non-transmitting state is switched to the power transmitting state, the torque applied to the idler gear 44 increases, and the torque opposes the pressing force applied to the regulating member 61 such that the regulating member 61 remains at the removing position Y, and the power transmitting state is maintained.

Fourth Embodiment

Hereinafter, the door opening and closing apparatus 100 according to a fourth embodiment will be described with reference to FIGS. 22 to 32D.

In addition, marks shown in FIGS. 22 to 32D are used in describing the fourth embodiment.

First, the refrigerator R related to the embodiment will be described.

Figure 22:
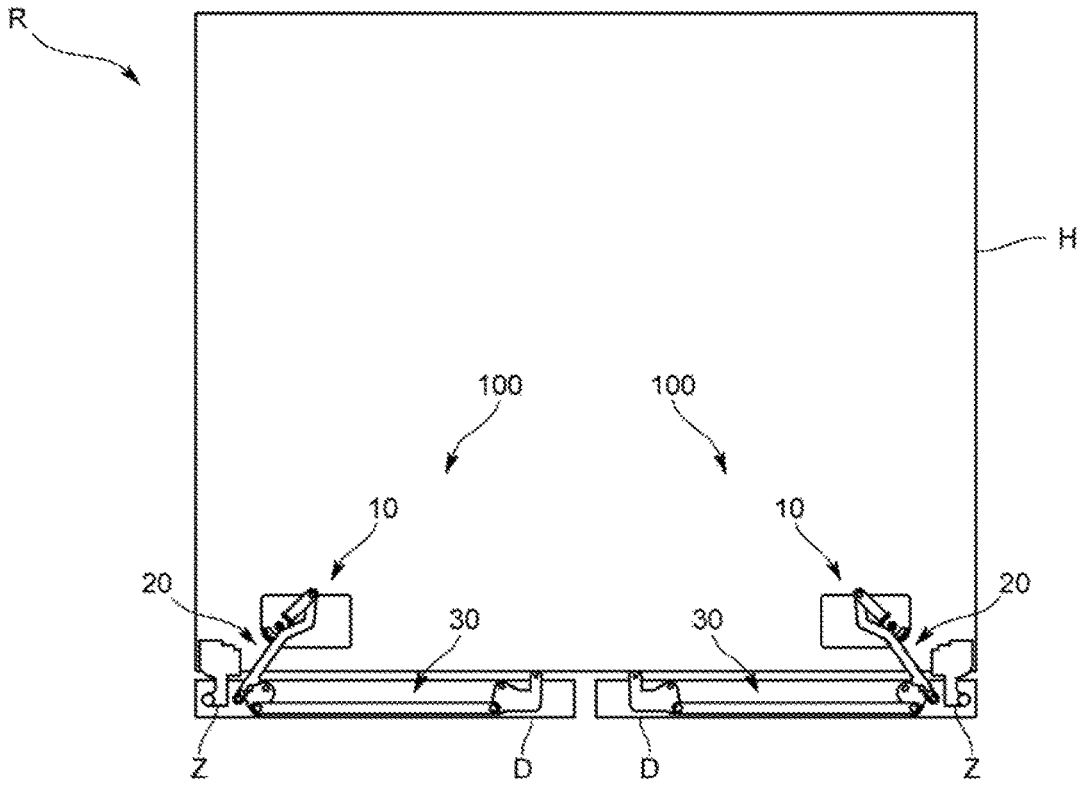
FIG. 22 is a view schematically illustrating a configuration of a refrigerator according to a fourth embodiment.

As illustrated in FIG. 22, the refrigerator R includes the housing H with an open front surface and the left and right doors D installed at the opening of the housing H, wherein the left and right doors D are configured to rotate about a predetermined rotation shaft.

In addition, each of the left and right doors D is connected to the housing H via the hinge Z, for example.

The door opening and closing apparatus 100 is for independently opening and closing the left and right doors D of the refrigerator R described above. Here, the door opening and closing apparatus 100 is installed at each of the left and right doors D at an upper surface of the refrigerator R.

In the embodiment, the door opening and closing apparatus 100 installed at the left and right doors D have the same configuration. Hereinafter, only the door opening and closing apparatus 100 for opening and closing the right door D will be representatively described.

Figure 23:
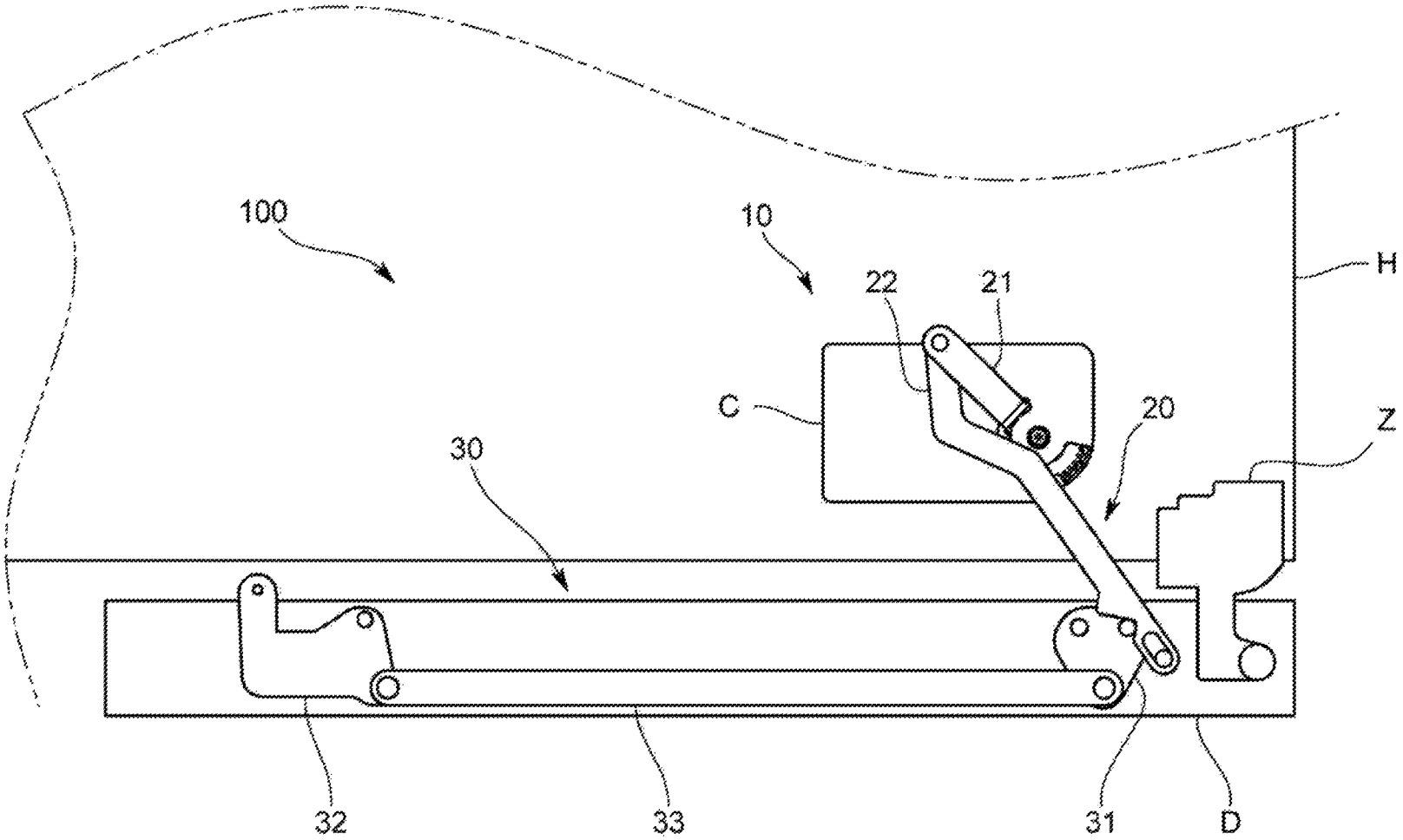
FIG. 23 is a view schematically illustrating a configuration of a door opening and closing apparatus according to the fourth embodiment.

Specifically, as illustrated in FIG. 23, the door opening and closing apparatus 100 includes the driving apparatus 10 installed at the upper surface of the housing H, a link apparatus 20 configured to transmit power of the driving apparatus 10 to the door D, and the auxiliary apparatus 30 configured to assist the link apparatus 20 opening the door D.

Hereinafter, each of the apparatus will be described.

<Driving Apparatus>

The driving apparatus 10 outputs power for opening and closing the door D. Here, as illustrated in FIG. 23, the driving apparatus 10 is housed in the casing C and mounted on the upper surface of the housing H.

Figure 24A:
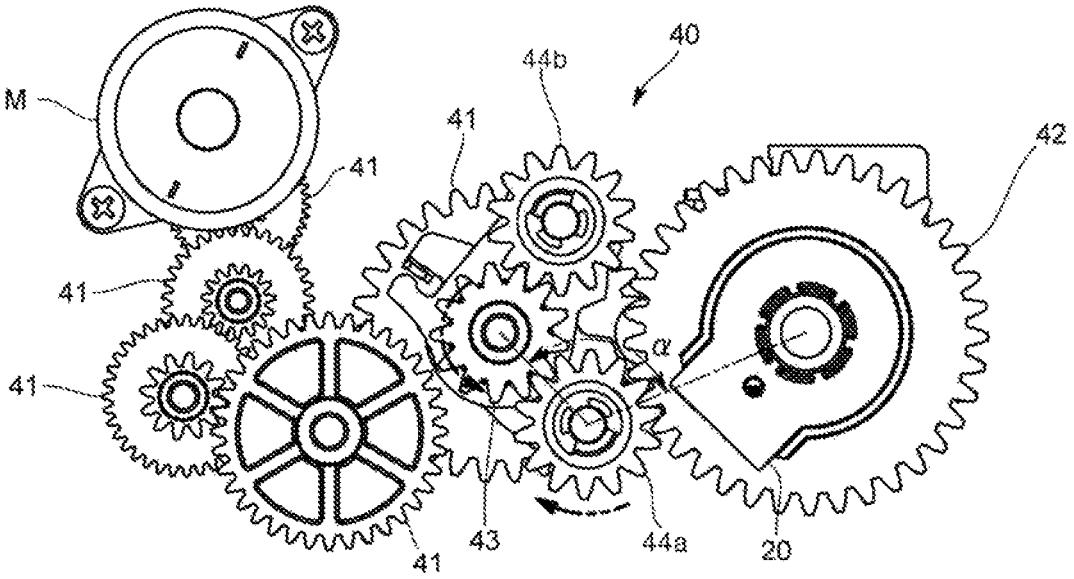
FIGS. 24A and 24B are views schematically illustrating a power transmitting state according to the fourth embodiment.
Figure 24B:
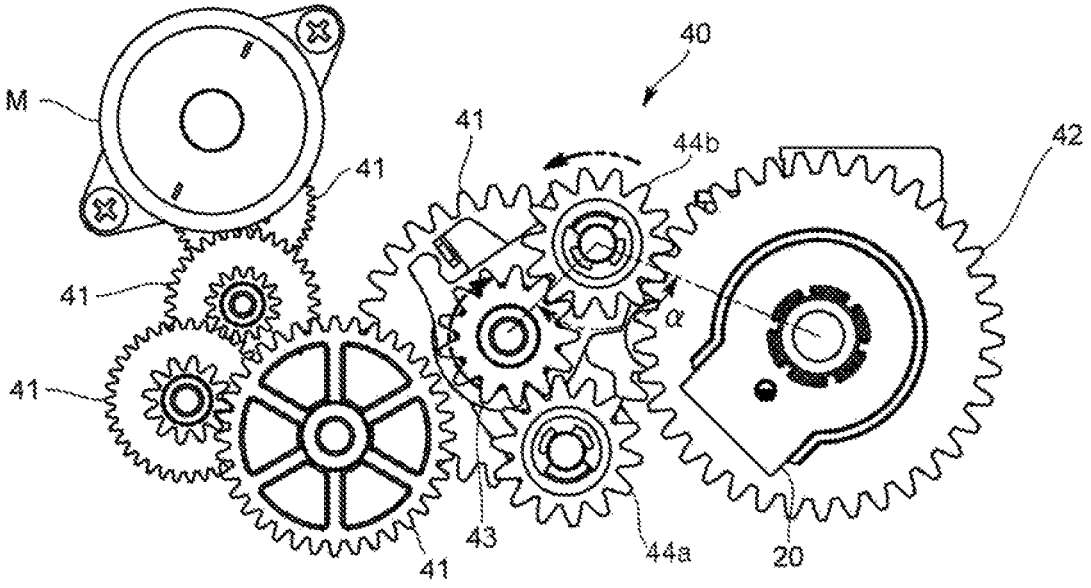
Figure 25:
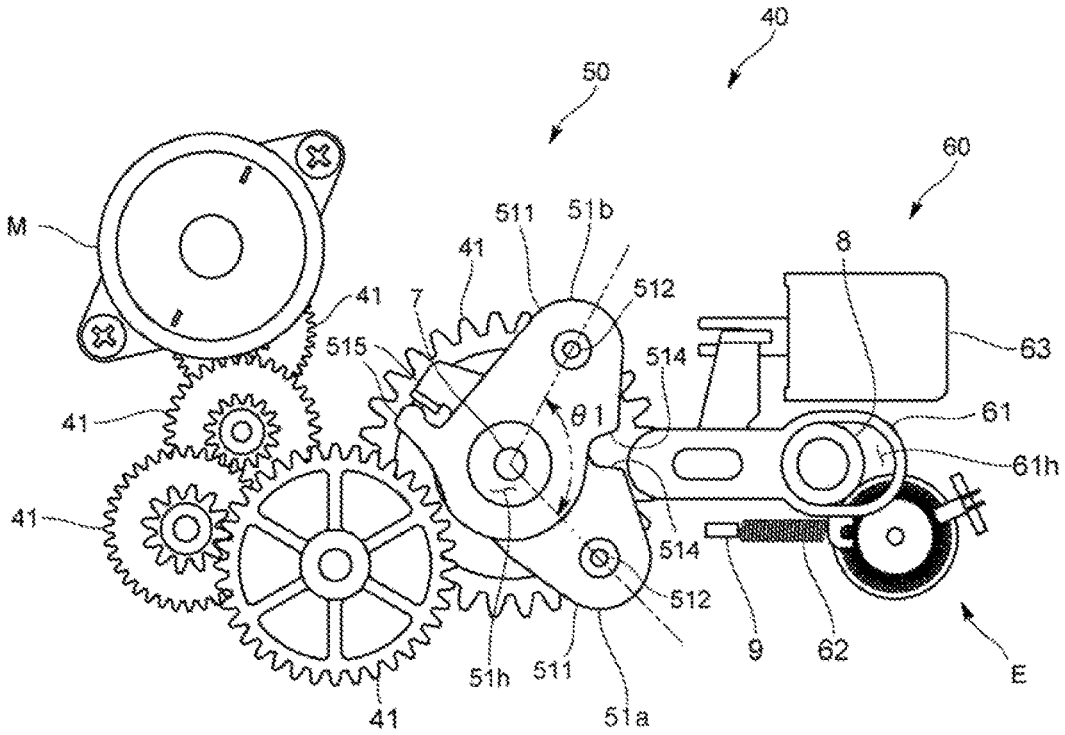
FIG. 25 is a view schematically illustrating a power transmission apparatus according to the fourth embodiment.

Specifically, as illustrated in FIGS. 24A to 25, the driving apparatus 10 includes the motor M and the power transmission apparatus 40 configured to transmit power of the motor M to the link apparatus 20.

The motor M receives a control signal from a controller (unillustrated) and rotates in the forward direction or the reverse direction. Here, for example, the motor M is configured to rotate at predetermined revolutions per minute based on the control signal.

The power transmission apparatus 40 is configured to switch between a power transmitting state in which the power of the motor M is transmitted to the link apparatus 20 and a power non-transmitting state in which the power is not transmitted to the link apparatus 20. Specifically, the power transmission apparatus 40 includes the motor-side gear 41 configured to rotate by interlocking with the motor M, the door-side gear 42 configured to rotate by interlocking with opening and closing of the door D, i.e., the link apparatus 20, the center gear 43 engaged with the motor-side gear 41, and the pair of idler gears 44 engaged with the center gear 43 (hereinafter, to distinguish each of the pair of idler gears 44, each of the pair of idler gears 44 is also referred to as the idler gear 44*a* at one side and the idler gear 44*b* at the other side).

In the embodiment, a plurality of motor-side gears 41 are serially connected, and the motor-side gear 41 closest to the door among the plurality of motor-side gears 41 is connected to the center gear 43. The pair of idler gears 44 engaged with the center gear 43 are disposed to therebetween have a straight line connecting the rotation shaft of the center gear 43 to the rotation shaft of the door-side gear 42 and rotate by interlocking with the center gear 43.

In addition, as illustrated in FIGS. 24A to 25, the power transmission apparatus 40 further includes the swing apparatus 50 configured to move the pair of idler gears 44 about the center gear 43 and along a flat surface perpendicular to the rotation shaft of the center gear 43 by rotation of the center gear 43 and the power non-transmitting state maintenance apparatus 60 configured to maintain the power non-transmitting state in which neither of the idler gears 44 is engaged with the door-side gear 42.

In addition, the power transmission apparatus 40 illustrated in FIG. 25 is in a state in which the center gear 43, the pair of idler gears 44, and the door-side gear 42 are detached, in the automatically opening mode described above.

The swing apparatus 50 moves the pair of idler gears 44 among the forward rotation power transmitting position at which the idler gear 44*a* at one side is engaged with the door-side gear 42, the reverse rotation power transmitting position at which the idler gear 44*b* at the other side is engaged with the door-side gear 42, and the power non-transmitting position at which neither of the pair of idler gears 44 is engaged with the door-side gear 42.

The swing apparatus 50 according to the embodiment allows the pair of idler gears 44 to revolve along the circumference of the rotation shaft of the center gear 43 and along a rotating direction of the center gear 43. In this way, the swing apparatus 50 is configured to allow the idler gear 44*a* at one side to be engaged with the door-side gear 42 and the idler gear 44*b* at the other side to be detached from the door-side gear 42 or allow the idler gear 44*b* at the other side to be engaged with the door-side gear 42 and the idler gear 44*a* at one side to be detached from the door-side gear 42.

In more detail, as illustrated in FIG. 24A, when the center gear 43 rotates in the forward direction (in the embodiment, counterclockwise when viewed from the top) by interlocking with rotation of the motor M, the pair of idler gears 44 revolve around the rotation shaft of the center gear 43 counterclockwise when viewed from the top such that the idler gear 44*a* at one side is engaged with the door-side gear 42. In this way, the door opening and closing apparatus 100 according to the embodiment is in the automatically opening mode in which the door D is automatically opened by the power of the motor M.

Meanwhile, as illustrated in FIG. 24B, when the center gear 43 rotates in the reverse direction (in the embodiment, clockwise when viewed from the top) by interlocking with rotation of the motor M, the pair of idler gears 44 revolve around the rotation shaft of the center gear 43 clockwise when viewed from the top such that the idler gear 44*b* at the other side is engaged with the door-side gear 42. In this way, the door opening and closing apparatus 100 according to the embodiment is in the automatically closing mode in which the door D is automatically closed by the power of the motor M.

In the automatically opening mode and the automatically closing mode described above, the door-side gear 42, the idler gear 44 at one or the other side engaged with the door-side gear 42, and the center gear 43 are disposed so that an angle $\alpha$ formed therebetween is 90° to 130°. In the embodiment, the angle $\alpha$ is designed to be 110° to 120°.

Next, a detailed configuration of the swing apparatus 50 will be described.

Figure 26:
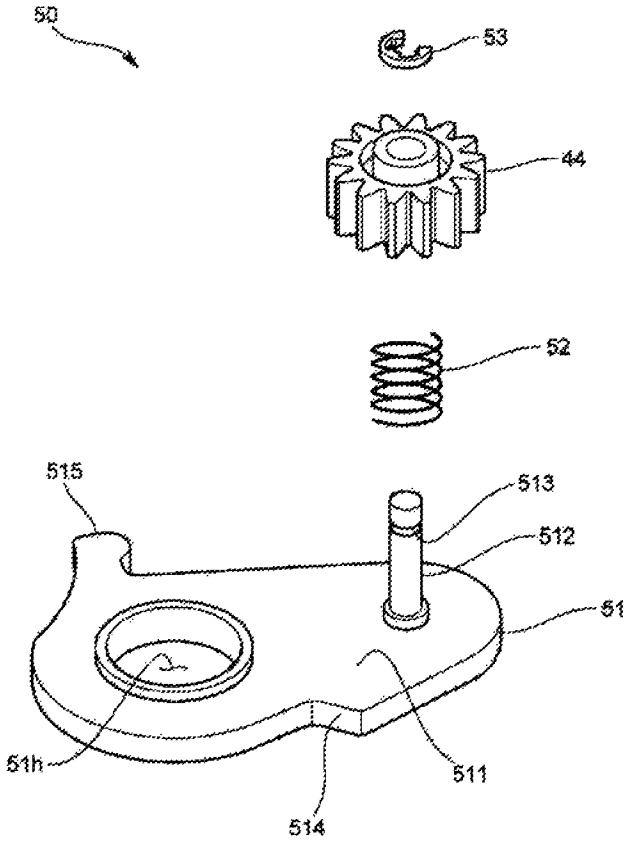
FIG. 26 is a view schematically illustrating a swing apparatus according to the fourth embodiment.

As illustrated in FIGS. 25 and 26, the swing apparatus 50 includes the mounting member 51 configured to rotate about the rotation shaft of the center gear 43 and have the idler gears mounted thereon and the rotation load member 52 interposed between the mounting member 51 and the idler gears 44 and configured to assign a load to rotation of each of the idler gears 44.

Particularly, as illustrated in FIG. 26, the mounting member 51 includes the flat plate member 511 having the through-hole 51*h* penetrating in the thickness direction formed and the idler gear mounting shaft 512 configured to vertically stand on the flat plate member 511 and have an idler gear mounted thereon.

The through-hole 51*h* is formed in a substantially circular shape and is formed larger than the size of the diameter of the center gear mounting shaft 7 on which the center gear 43 is mounted. In this way, the mounting member 51 may pass through the center gear mounting shaft 7 via the through-hole 51*h*, and the mounting member 51 is rotatable about the center gear mounting shaft 7.

The rotation load member 52 assigns a load to rotation of the idler gears 44 to generate torque that makes the pair of idler gears 44 revolve along the circumference of the rotation shaft of the center gear 43. Here, the rotation load member 52 is an elastic member such as a spring configured to pass through the idler gear mounting shaft 512 and apply an upward force along the rotation shaft to the idler gears 44.

In the embodiment, as illustrated in FIG. 26, the rotation load member 52 is fitted to the idler gear mounting shaft 512, the idler gear 44 is fitted to the idler gear mounting shaft 512 above the rotation load member 52, and the pressing member 53 configured to press the idler gear 44 is fitted to the idler gear mounting shaft 512 above the idler gear 44 so that an upward force is applied by the rotation load member 52 on the idler gear.

In addition, the pressing member 53 is configured to be coupled to the recessed groove 513 formed along the circumferential direction of the outer circumferential surface of the idler gear mounting shaft 512.

Here, as illustrated in FIGS. 24 and 25, the power transmission apparatus 40 according to the embodiment is assembled by allowing the first mounting member 51*a* on which the idler gear 44*a* at one side is mounted to be fitted to the center gear mounting shaft 7, allowing the second mounting member 51*b* on which the idler gear 44*b* at the other side is mounted to be fitted to the center gear mounting shaft 7 above the first mounting member 51*a* and allowing the center gear 43 to be fitted to the center gear mounting shaft 7 above the second mounting member 51*b*.

Particularly, as illustrated in FIG. 25, the swing apparatus 50 according to the present embodiment assembled as described above is configured such that the first mounting member 51*a* and the second mounting member 51*b* form a predetermined opening angle $\theta 1$ toward the door-side gear 42. The opening angle $\theta 1$ is, in other words, an angle formed by the rotation shafts of the idler gears 44*a* and 44*b* about the rotation shaft of the center gear 43.

In the embodiment, the end portion 514 formed at the flat plate member 511 of each of the mounting members 51 is disposed within the opening angle 91. In addition, the angle regulator 515 formed at the opposite side of the end portion 514 around the center gear mounting shaft 7 and configured to regulate the opening angle $\theta 1$ is installed at each of the mounting members 51.

Specifically, as illustrated in FIGS. 25 and 26, the angle regulator 515 is a protrusion protruding outward from the outer surface of the flat plate member 511. The distance between the angle regulators 515 decreases when the opening angle $\theta 1$ becomes smaller, and the angle regulators 515 come into contact with each other when the opening angle $\theta 1$ reaches a predetermined angle.

Due to the configuration described above, the idler gears 44*a* and 44*b* remain spaced apart by at least a predetermined distance, and a case in which both of the idler gears 44*a* and 44*b* at two sides are engaged with the door-side gear 42 may be prevented.

Next, the power non-transmitting state maintenance apparatus 60 will be described.

Figure 28A:
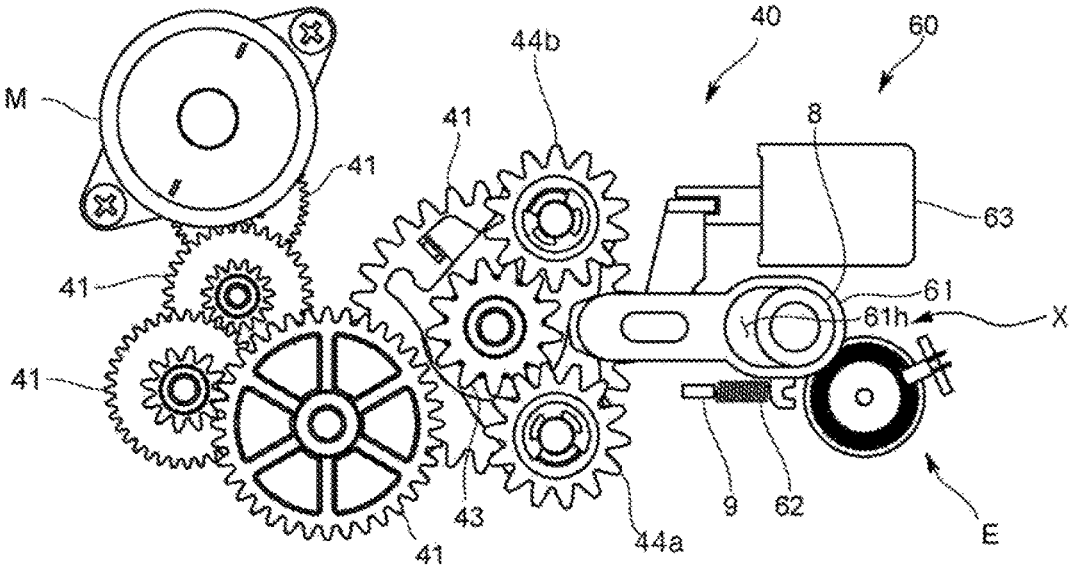
FIGS. 28A and 28B are views schematically illustrating a power non-transmitting state maintenance apparatus according to the fourth embodiment.
Figure 28B:
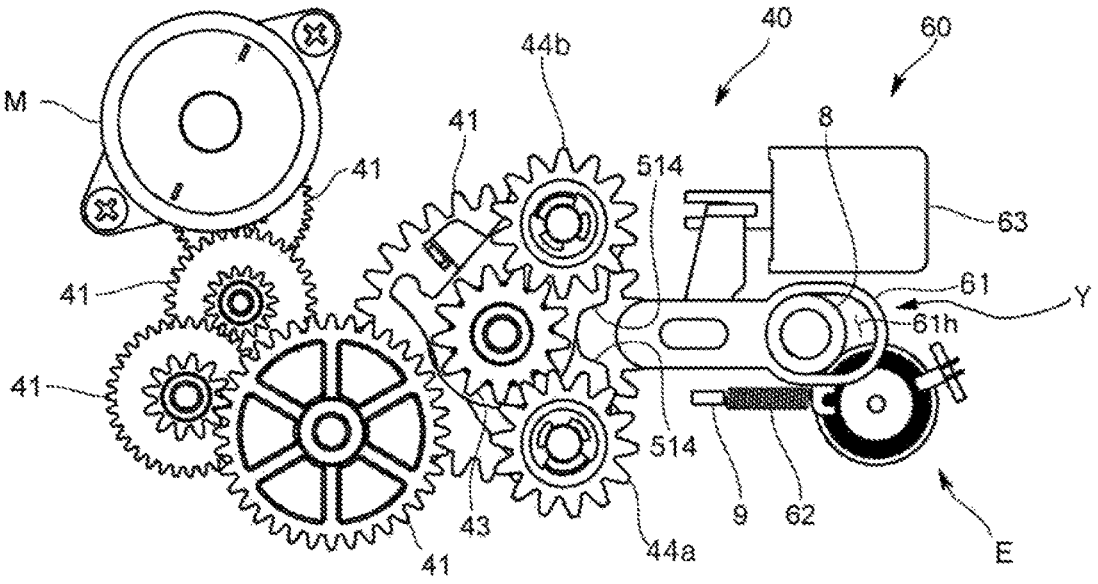

As illustrated in FIGS. 28A and 28B, the power non-transmitting state maintenance apparatus 60 regulates movements of the pair of idler gears 44 due to the swing apparatus 50 described above. Since neither of the idler gears 44 is engaged with the door-side gear 42, the power non-transmitting state in which the power of the motor M is not transmitted to the door-side gear 42 is reached. According to the embodiment, in the power non-transmitting state, the door opening and closing apparatus 100 is in the manual mode in which the door D may be manually opened and closed.

Specifically, the power non-transmitting state maintenance apparatus 60 includes the regulating member 61 configured to move between the regulating position X at which movements of the pair of idler gears 44 due to the swing apparatus 50 is regulated as illustrated in FIG. 28A and the removing position Y at which the regulation at the regulating position X is removed as illustrated in FIG. 28B, the pressing member 62 configured to press the regulating member 61 to the regulating position X, and the regulation removing apparatus 63 configured to move the regulating member 61 from the regulating position X to the removing position Y.

The regulating member 61 is configured to be able to reciprocate with respect to the door-side gear mounting shaft 8 on which the door-side gear 42 is mounted. Specifically, the one end of the regulating member 61 is formed in a semicircular shape, and the through-hole 61*h* penetrating in the thickness direction is formed at the other end thereof.

The through-hole 61*h* is formed in a substantially slot-like shape and is formed larger than the size of the diameter of the door-side gear mounting shaft 8. In this way, since the regulating member 61 may pass through the door-side gear mounting shaft 8 via the through-hole 61*h*, the regulating member 61 may reciprocate with respect to the door-side gear mounting shaft 8.

The regulating member 61 moves between the regulating position X and the removing position Y by the reciprocating movement described above. At the regulating position X, the one end of the regulating member 61 is interposed between the first mounting member 51*a* and the second mounting member 51*b* to regulate revolution of the pair of idler gears 44. At the removing position Y, the one end is not in contact with either the first mounting member 51*a* or the second mounting member 51*b* and allows the revolution of the pair of idler gears 44.

In more detail, at the regulating position X, the one end of the regulating member 61 is configured to fit into the gap formed between the end portions 514 of the flat plate members 511 described above.

The pressing member 62 assigns a pressing force from the removing position Y toward the regulating position X with respect to the regulating member 61. In the embodiment, the pressing member 62 is an elastic member such as a spring having one end mounted on the regulating member 61 and the other end mounted on the fixing member 9 fixed to the casing, for example.

The regulation removing apparatus 63 moves the regulating member 61 from the regulating position X to the removing position Y. Here, the regulation removing apparatus 63 is mounted on the regulating member 61 and receives a control signal from a controller (unillustrated), for example, to assign a removing force in the opposite direction of the pressing force with respect to the regulating member 61.

In more detail, the regulation removing apparatus 63 according to the embodiment is configured to instantaneously operate a solenoid (unillustrated) when the control signal is received and assign the removing force to the regulating member 61 by the instantaneous conduction.

According to the power transmission apparatus 40 configured as above, the door D may be automatically or manually opened and closed by switching between the power transmitting state and the power non-transmitting state.

Hereinafter, an operation for when the power transmission apparatus 40 is switched to the power transmitting state or the power non-transmitting state will be described.

First, an operation in which the power non-transmitting state is switched to the power transmitting state will be described.

In addition, the idler gear 44 disposed at which side of one side and the other side would be engaged with the door-side gear 42 when the power non-transmitting state is switched to the power transmitting state is determined according to a rotating direction of the motor M. Since operation principles of a case in which the idler gear 44*a* at one side is engaged with the door-side gear 42 and a case in which the idler gear 44*b* at the other side is engaged with the door-side gear 42 are the same, only the case in which the power non-transmitting state is switched to the power transmitting state due to the idler gear 44*a* at one side being engaged with the door-side gear 42 will be representatively described.

Figure 27:
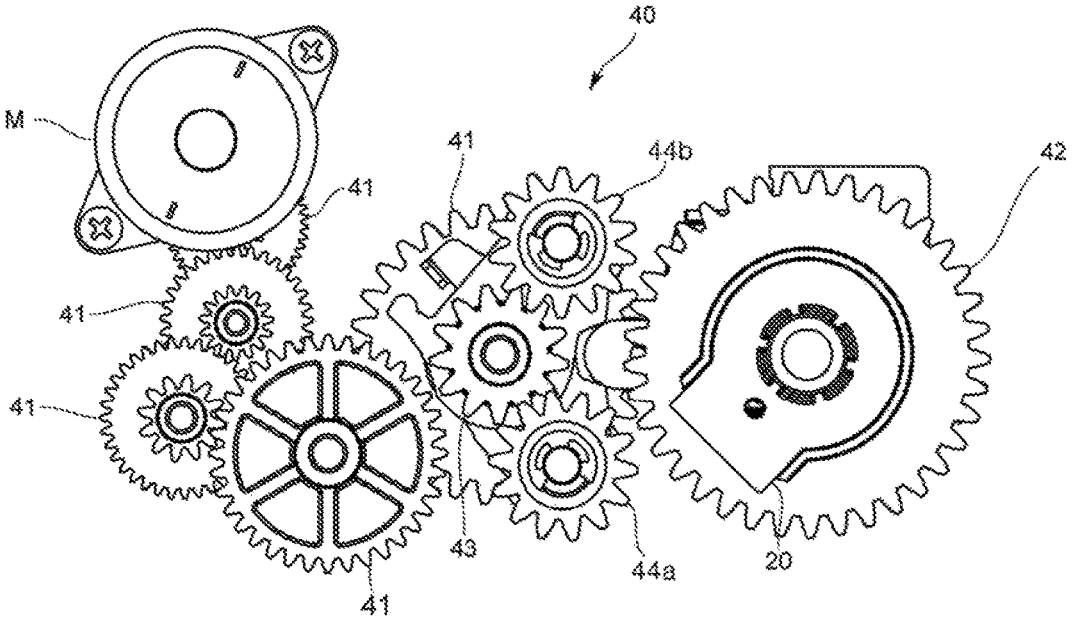
FIG. 27 is a view schematically illustrating a power non-transmitting state according to the fourth embodiment.

As illustrated in FIG. 27, in the power non-transmitting state, the regulating member 61 is pressed to the regulating position X, and neither of the pair of idler gears 44 is engaged with the door-side gear 42.

Here, when the center gear 43 rotates in the forward direction due to a predetermined voltage applied to the motor M, a tangential force is applied to the pair of idler gears 44 via a portion engaged with the center gear 43.

Due to the tangential force, each of the idler gears 44 begins rotating about a rotation shaft. However, since the rotation load member 52 assigns load to rotation of the idler gears, the tangential force is divided into rotation torque that rotates the idler gears about the rotation shaft and swing torque that revolves the idler gears along the circumference of the center gear 43.

Here, in the embodiment, the pressing force applied from the pressing member 62 to the regulating member 61 opposes the swing torque, and the regulating member 61 maintains a state in which movement of the pair of idler gears 44 due to the swing apparatus 50 is regulated (i.e., the power non-transmitting state).

In the power non-transmitting state, when, for example, a switching signal for switching the power non-transmitting state to the power transmitting state is transmitted to the unillustrated controller, the controller controls a voltage applied to the solenoid of the regulation removing apparatus 63 so that the regulation removing apparatus 63 instantaneously operates the solenoid and applies an instantaneous removing force to the regulating member 61.

In this way, the regulating member 61 moves from the regulating position X to the removing position Y, and the pair of idler gears 44 revolve along the circumference of the center gear 43 by the swing torque such that the idler gear 44*a* at one side is engaged with the door-side gear 42, and the power non-transmitting state is switched to the power transmitting state.

As above, when the power non-transmitting state is switched to the power transmitting state due to the idler gear 44*a* at one side being engaged with the door-side gear 42, the tangential force is applied to the idler gear 44*a* at one side via a portion engaged with the door-side gear 42.

In this way, the swing torque described above increases, and the regulating member 61 may remain at the removing position Y since the swing torque opposes the pressing force and conduction to the solenoid does not occur.

Next, an operation in which the power transmitting state is switched to the power non-transmitting state will be described.

As described above, in the power transmitting state, the swing torque opposes the pressing force, and the power transmitting state is maintained.

In the power transmitting state, when, for example, a switching signal for switching the power transmitting state to the power non-transmitting state is transmitted to the controller (unillustrated), the controller controls a voltage applied to the motor M and stops rotation of the motor M or instantaneously rotates the motor M in the reverse direction.

In this way, the center gear 43 stops rotating or instantaneously rotates in the reverse direction by interlocking with the motor M, and the swing torque described above decreases.

In this way, the pressing force opposes the swing torque, the regulating member 61 moves from the removing position Y to the regulating position X, and the idler gears and the door-side gear 42 are disengaged such that the power transmitting state is switched to the power non-transmitting state.

<Link Apparatus>

Next, the link apparatus 20 configured to transmit power output from the driving apparatus 10 described above to the door D will be described.

Figure 29:
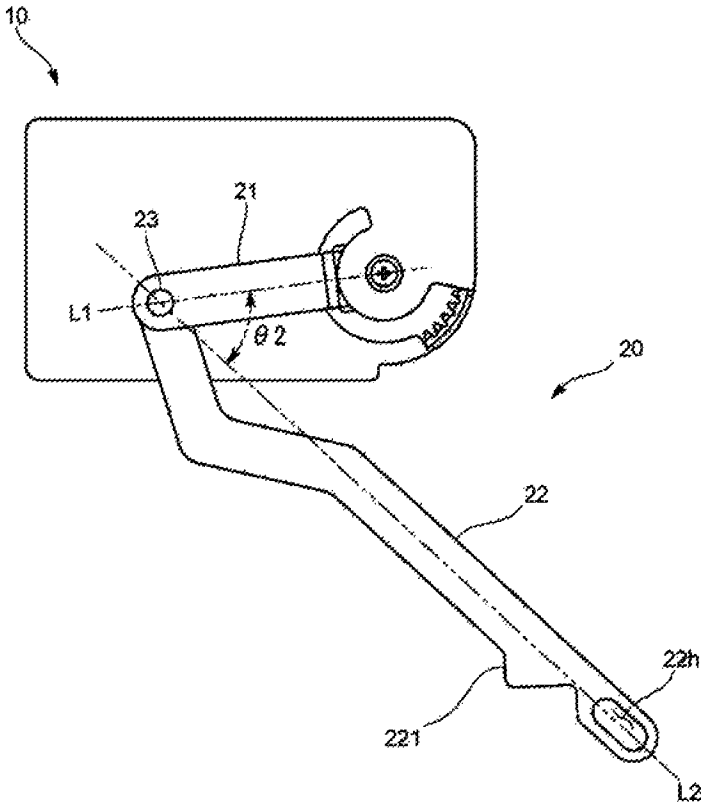
FIG. 29 is a view schematically illustrating a link apparatus according to the fourth embodiment.
Figure 30:
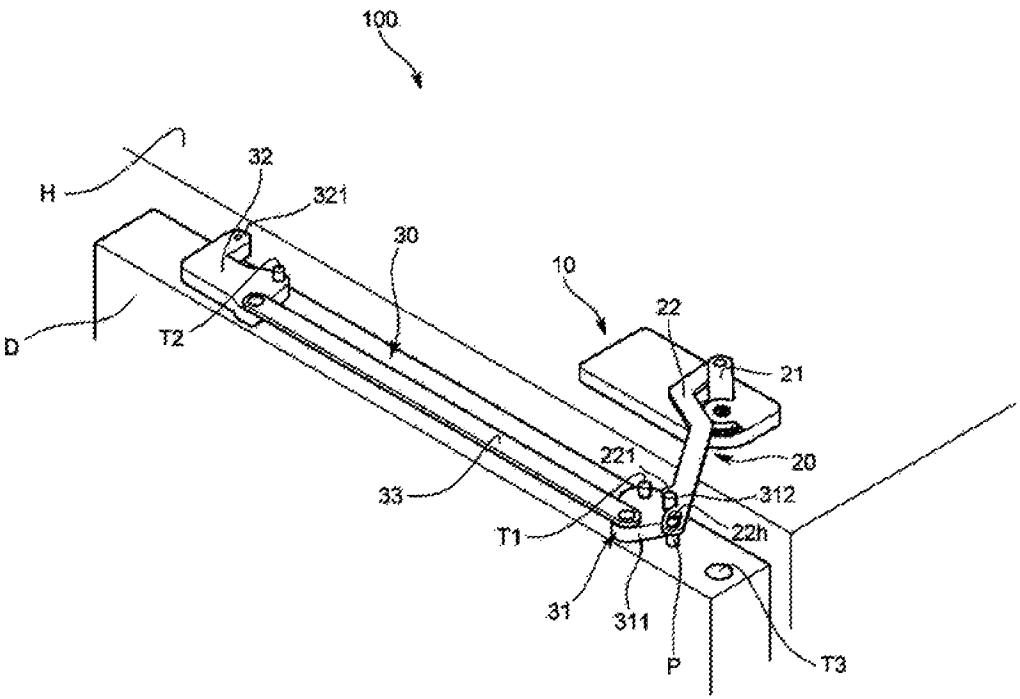
FIG. 30 is a view schematically illustrating an auxiliary apparatus according to the fourth embodiment.

The link apparatus 20 has one end connected to an output shaft of the driving apparatus 10 (in the embodiment, an output shaft of the door-side gear 42) and the other end connected to the door D. Specifically, as illustrated in FIGS. 29 and 30, the link apparatus 20 includes a first arm 21 configured to rotate by power of the driving apparatus 10 and a second arm 22 configured to move by interlocking with rotation of the first arm 21.

The first arm 21 has one end fixed to the door-side gear 42 by a screw and the like and the other end to which the second arm 22 is connected such that the first arm 21 is configured to rotate about the rotation shaft of the door-side gear 42 by interlocking with the door-side gear 42.

In the embodiment, with the door D closed, a first elongating direction L1 from the one end to the other end of the first arm 21 is set to face a rear portion of the housing H.

The second arm 22 has one end connected to the first arm 21 and is configured to rotate about a connection portion 23 at which the one end of the second arm 22 is connected to the first arm 21 and reciprocate along a second elongating direction L2 from the one end to the other end of the second arm 22.

In more detail, the second arm 22 has effort at which force is received from the first arm 21 and load at which the force is applied to the door D and opens and closes the door D while rotating and reciprocating.

In the embodiment, when the door D is closed as in FIG. 30, the second elongating direction L2 faces the front of the housing H.

Here, in the first embodiment, the first elongating direction L1 is a direction from the rotation shaft of the door-side gear 42 toward a rotation shaft of the second arm 22 installed at the other end of the first arm 21. In addition, the second elongating direction L2 is a direction from the effort toward the load and, specifically, is a direction from the rotation shaft of the second arm 22 installed at the other end of the first arm 21 toward a connection portion connected to the door D installed at the other end of the second arm.

In addition, as illustrated in FIG. 30, the link apparatus 20 according to the embodiment is configured such that, while the door D is closed, the load is disposed closer to a rotation shaft of the door D (in the embodiment, the hinge Z) than a direction perpendicular to the door D when viewed from the effort.

The link apparatus 20 according to the embodiment is configured such that an angle formed between the first arm 21 and the second arm 22, i.e., an angle 92 formed between the first elongating direction L1 and the second elongating direction L2, is 180° or smaller when the door D is open.

<Auxiliary Apparatus>

The door opening and closing apparatus 100 according to the embodiment further includes the auxiliary apparatus 30 configured to assist the link apparatus 20 described above opening the door D.

The auxiliary apparatus 30 generates an auxiliary force for opening the door D. Here, the auxiliary apparatus 30 is housed in the casing and is mounted on the upper surface of the door D.

Specifically, as illustrated in FIG. 30, the auxiliary apparatus 30 includes a rotating member 31 configured to rotate about a predetermined rotation shaft T1, the auxiliary force assigning member 32 configured to assign the auxiliary force to the door D by applying a force on the housing H, and a contacting member 33 configured to connect the rotating member 31 to the auxiliary force assigning member 32.

The rotating member 31 includes a rotating body 311 and a protrusion 312 configured to protrude upward from the rotating body 311. In the embodiment, the rotating member 31 is configured such that the rotating body 311 rotates about the rotation shaft T1 due to the second arm 22 described above coming into contact with the protrusion 312.

In detail, as illustrated in FIGS. 29 and 30, the second arm 22 according to the embodiment includes a slot 22*h* penetrating in the thickness direction formed at the other end, and a protruding pin P vertically standing on the upper surface of the door D penetrates through the slot 22*h*. In addition, the second arm 22 includes an extension 221 formed closer to the one end of the second arm 22 than the slot 22*h* to extend in a direction crossing the second elongating direction L2.

By the configuration described above, the second arm 22 according to the embodiment reciprocates along the second elongating direction L2 so that the protruding pin P slides along the slot 22*h*, and the extension 221 collides against the protrusion 312 of the rotating body 311 when the second arm 22 reciprocates from the one end toward the other end to rotate the rotating body 311.

The auxiliary force assigning member 32 rotates about the rotation shaft T2 by interlocking with the rotating member 31 and has the collider 321 configured to collide with the front surface of the housing H due to the rotation of the auxiliary force assigning member 32.

The auxiliary force assigning member 32 according to the embodiment is configured to have the collider 321 installed at a position spaced a predetermined distance apart from the rotation shaft T3 of the door D and apply an auxiliary force having a size according to the predetermined distance on the door D.

The contacting member 33 connects the rotating member 31 to the auxiliary force assigning member 32 to allow the rotating member 31 and the auxiliary force assigning member 32 to rotate by interlocking with each other and has a longitudinal direction elongating along the longitudinal direction of the door D.

<Controller>

Next, a controller configured to control an operation of the door opening and closing apparatus 100 will be described.

Figure 31:
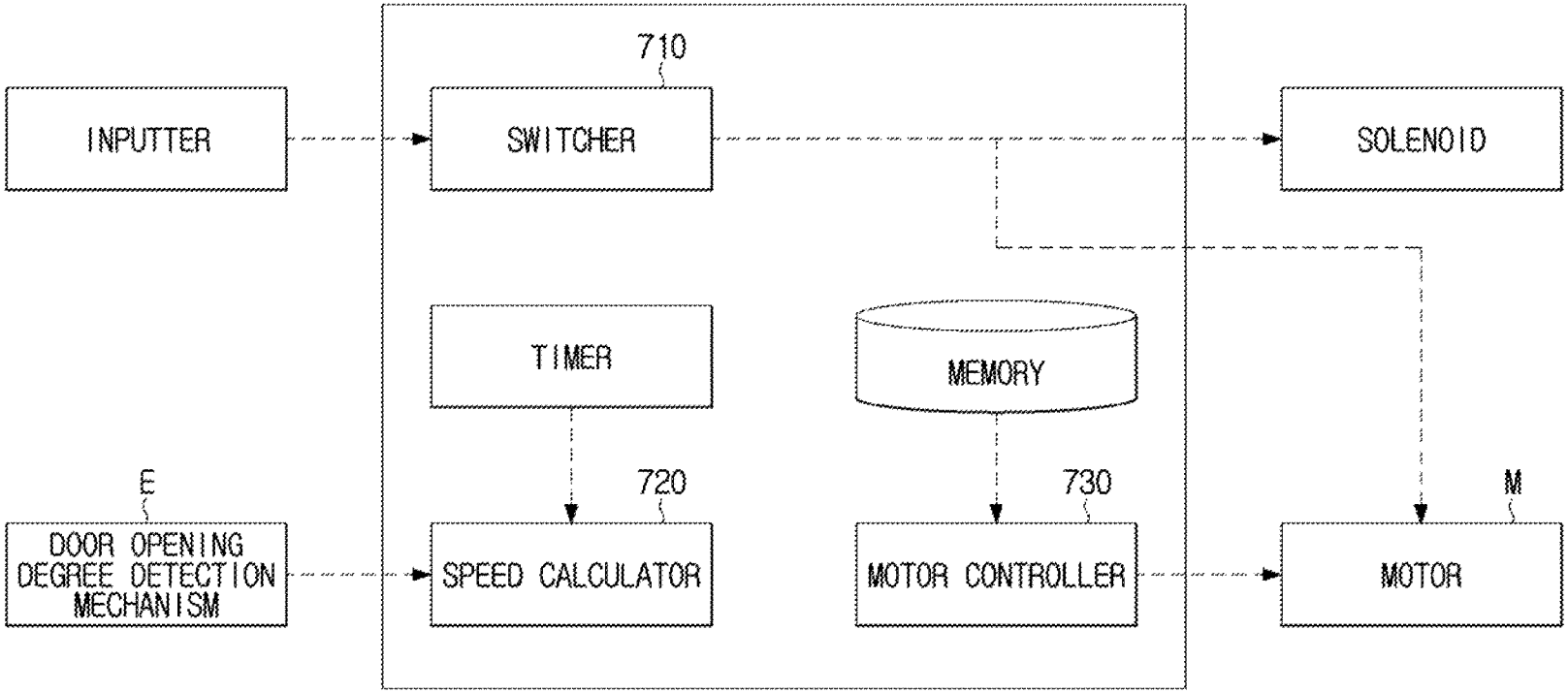
FIG. 31 is a function block diagram illustrating a function of a controller according to the fourth embodiment.
Figure 32A:
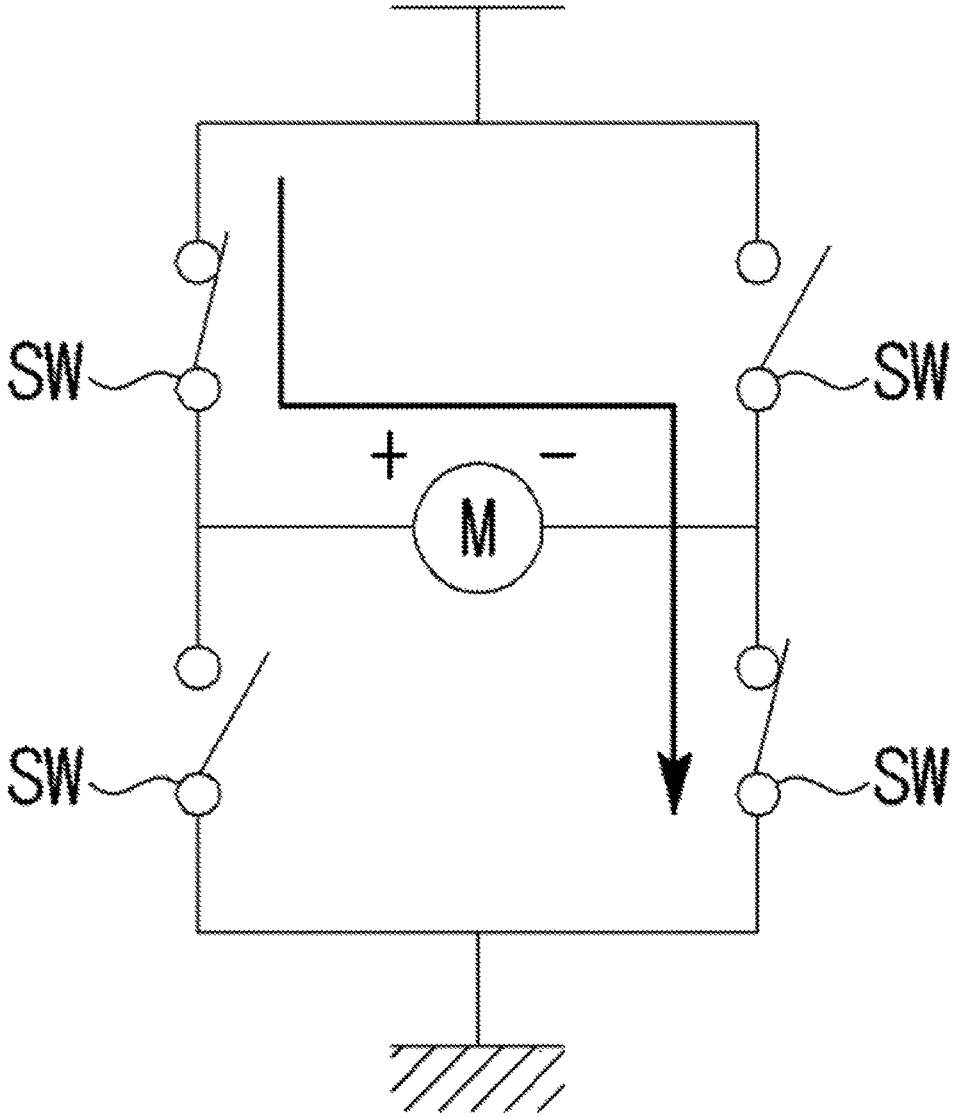
FIGS. 32A, 32B, 32C and 32D (32A to 32D) are electrical circuit diagrams illustrating a control circuit for controlling a motor according to the fourth embodiment.
Figure 32B:
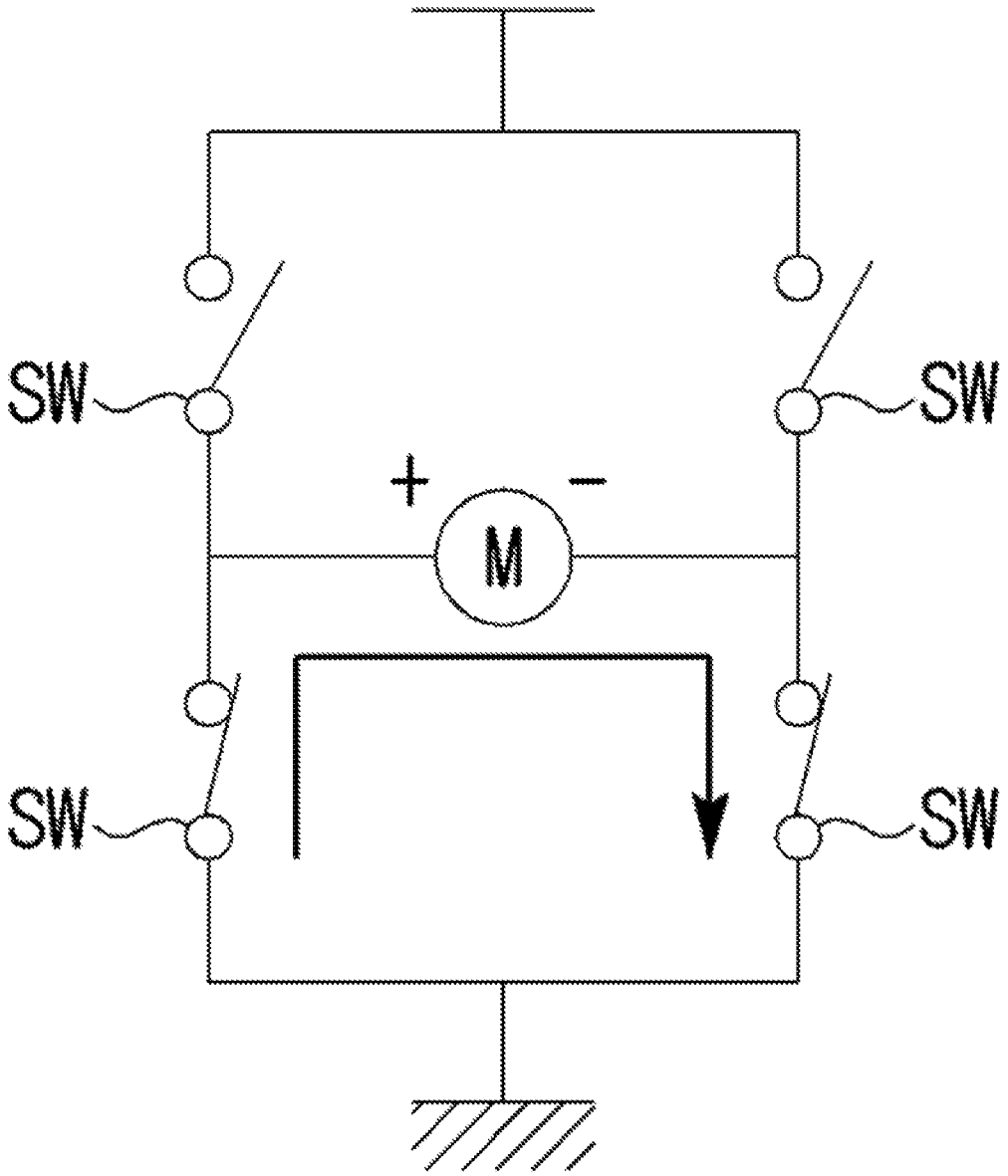
Figure 32C:
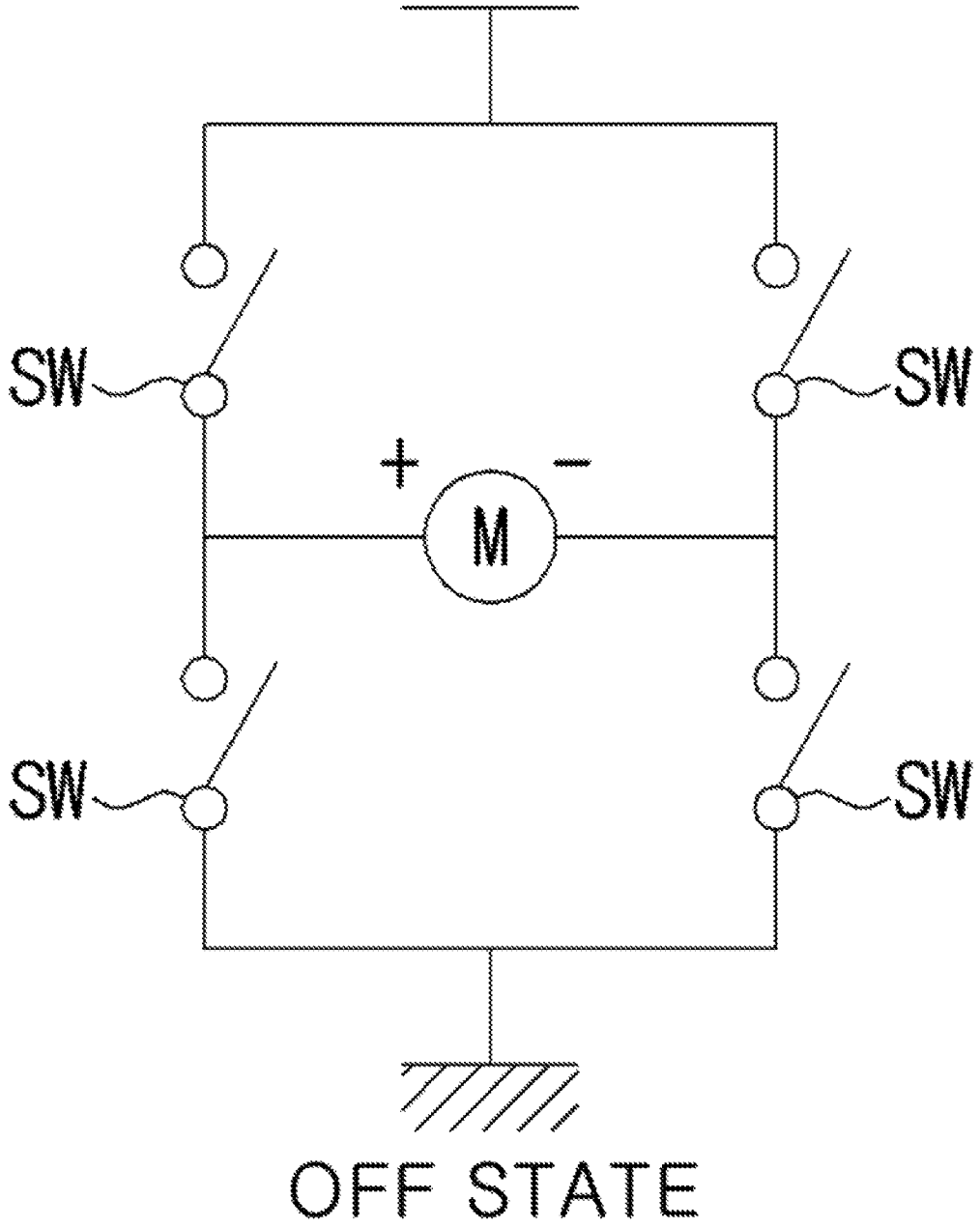
Figure 32D:
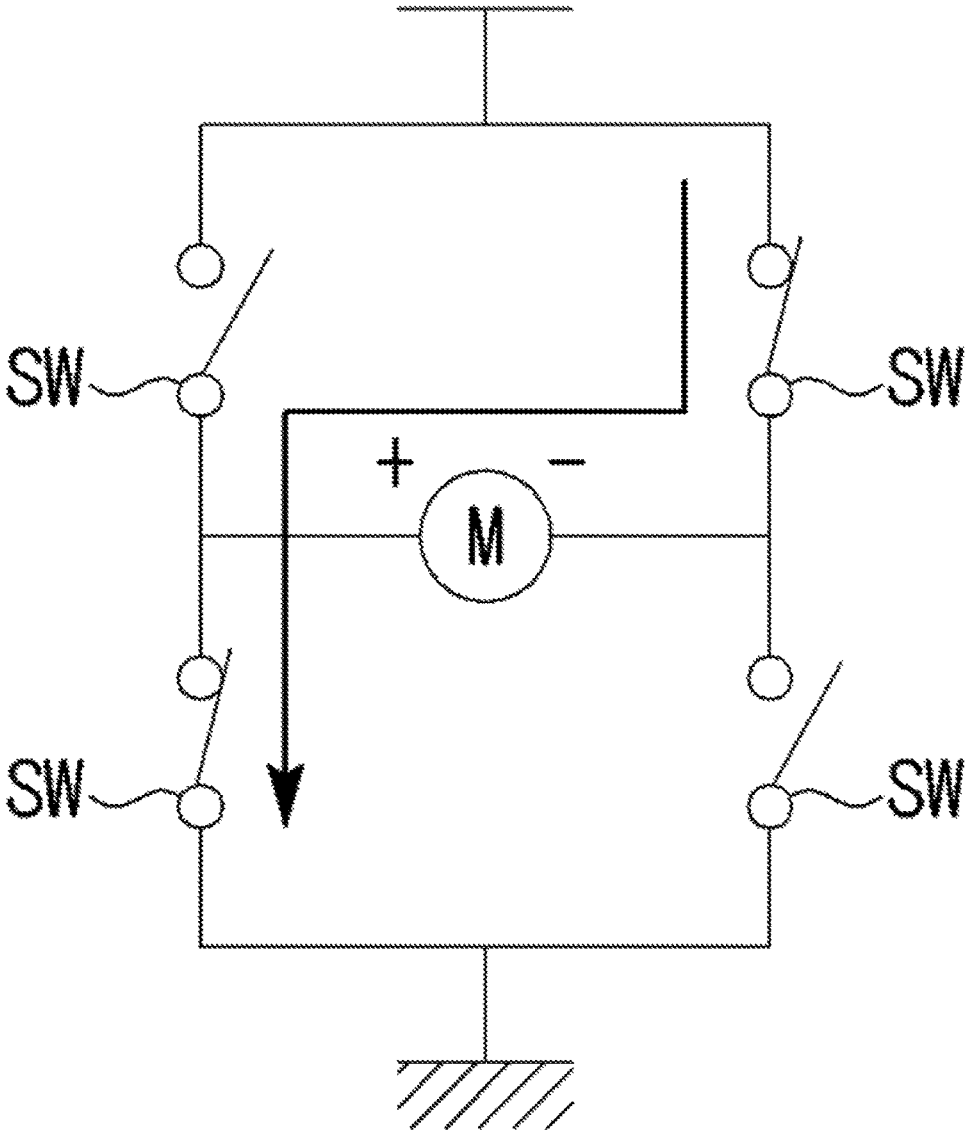

The controller controls opening and closing of the door D or an operation of the power transmission apparatus 40, physically includes a CPU, a memory, a timer, an A/D converter, a D/A converter, and the like, and, as illustrated in FIG. 31, functionally includes a switcher 710 configured to switch the power transmission apparatus 40 to the power transmitting state or the power non-transmitting state, a speed calculator 720 configured to calculate a movement speed of the door D, and a motor controller 730 configured to control an output of the motor M.

Hereinafter, each of the elements will be described.

The switcher 710 acquires a switching signal input by the user using an inputter installed at the door D, for example. Specifically, the switcher 710 is configured to switch the power transmission apparatus 40 to the power transmitting state or the power non-transmitting state by controlling a voltage applied to the motor M or a voltage applied to the solenoid of the regulation removing apparatus 63 based on the switching signal.

The speed calculator 720 calculates a movement speed of the door D based on a movement amount and a movement time of the door D.

The speed calculator 720 according to the embodiment is configured to acquire an opening degree signal that represents an opening degree of the door from a door opening degree detection apparatus E configured to detect an opening degree of the door D and acquire a time signal that represents a movement time of the door D from a CPU-embedded timer to output the movement speed calculated based on each of the signals as a calculated speed to the motor controller 73.

In the embodiment, as illustrated in FIGS. 28A and 28B, the door opening degree detection apparatus E is mounted on the door-side gear 42 by a gear and outputs a pulse signal according to a rotational amount of the door-side gear 42 as the opening degree signal to the speed calculator 720. Specifically, the door opening degree detection apparatus E uses an encoder and the like that rotates by synchronizing with the door-side gear 42.

In addition, the timer measures a time taken for the pulse signal to be output from the door opening degree detection apparatus E, sets the measured time as the movement time of the door D, and outputs the time signal to the speed calculator 720.

The motor controller 730 is configured to acquire the calculated speed output by the speed calculator 720 and a target speed pre-stored in a predetermined area of the memory, for example, and compare the calculated speed with the target speed to control the output to the motor M by PWM so that the calculated speed of the door D becomes closer to the target speed. In this way, the speed of the motor may be variably controlled.

In the embodiment, the speed calculator 720 is configured to calculate a movement speed at each of a plurality of steps which are from dividing the movement range of the door D, and the motor controller 730 is configured to control an output of the motor M in the next step based on the speed calculated by the speed calculator 720.

Here, the movement range of the door D is set as a range from a closed state of the door D to the opening degree of the door D at a predetermined target angle. In the embodiment, the movement range of the door D is a range for which the opening degree is 0° to 110°, for example.

In addition, each step is set by dividing the movement range of the door D at every predetermined opening angle. In the embodiment, a range of 0° to 110°, which is the movement range, is divided every 10° for each step.

Hereinafter, controlling by the controller with the settings described above will be described in detail.

In the embodiment, after the motor M is operated, the door opening degree detection apparatus E detects the opening degree of the door D, and the timer measures a time taken for the opening degree of the door D to increase by 10°.

In addition, the speed calculator 720 calculates the movement speed of the door D while the opening degree of the door D increases by 10°, i.e., a movement speed in each step, based on the opening degree signal from the door opening degree detection apparatus E and the time signal from the timer and outputs the calculated result as a calculated speed to the motor controller 730.

The motor controller 730 compares the calculated speed in each step with the target speed set in each step and, according to a difference therebetween, controls the output to the motor M in the next step by changing a conduction ratio (impact coefficient) of PWM control.

In more detail, as illustrated in FIGS. 32A to 32D, the motor controller 730 controls an operation of the motor M to a forward rotation state (FIG. 32A), a brake state (FIG. 32B), an off state (FIG. 32C), and a reverse rotation state (FIG. 32D) by switching four switches SW. For example, the motor controller 730 may switch between the forward rotation state and the reverse rotation state and between the brake state and the off state in short time by PWM control to decelerate the motor M. In addition, each of the switches SW includes a transistor, for example.

Due to the controlling described above, in the embodiment, after the door D begins opening, the motor controller 730 may move the door D at a target speed, e.g., 20 to 40 degrees per second, and then decelerate the door D toward 110°, which is a target angle.

In this way, since the door D may be stably opened and closed automatically regardless of a load being applied to the door D, the movement speed or the opening degree of the door D may be made uniform.

By the door opening and closing apparatus 100 related to the embodiment configured as above, since switching between the power transmitting state and the power non-transmitting state is possible by the swing apparatus 50 moving the pair of idler gears 44 along the flat surface perpendicular to the rotation shaft of the center gear 43, an apparatus, such as a clutch apparatus, configured to move the gears in the height direction may be unnecessary, and thus the power transmission apparatus 40 may be compactly formed in the height direction.

In addition, since the pair of idler gears 44 move along the flat surface perpendicular to the rotation shaft of the center gear 43 by interlocking with rotation of the center gear 43, the idler gears 44 may be moved using the power of the motor M such that an actuator exclusively used for moving the idler gears 44 may be unnecessary.

In addition, since the power non-transmitting state is switched to the power transmitting state by instantaneously operating the solenoid, a configuration of the regulation removing apparatus 63 may be simplified, and an amount of energy required for the switching may be small.

In addition, since the load of the second arm 22 is disposed closer to the rotation shaft of the door D than the direction perpendicular to the door D when viewed from the effort, the lengths of the arms 21 and 22 may not be unnecessarily increased, and the door D may be opened by 90° or more.

In addition, a demagnetizing force is required to open the door D when the door D and the housing H are magnetized using a magnet and the like. Since the auxiliary apparatus 30 generates an auxiliary force for opening the door D and the door D and the housing H may be demagnetized by the auxiliary force, the power of the motor M required for opening the door D may be decreased. In addition, the slot **22*h* is installed at the second arm 22, and the door D and the housing H are demagnetized while the protruding pin P moves along the slot 22*h*** such that a starting torque that causes the most load to be applied to the motor M may be decreased, and a load to the motor M is decreased.

In addition, since each gear is disposed so that an angle formed between the door-side gear 42, the idler gear 44 at one or the other side engaged to the door-side gear 42, and the center gear 43 is 110° to 120°, hunting and the like does not occur, and power may be securely transmitted.

In addition, since the controller (unillustrated) controls the movement speed of the door D to a predetermined speed, the opening and closing speed of the door D is not too fast or not too slow even when the weight of the door D changes due to weight of articles stored at the door D such that user manipulability is high.

In more detail, since the door D may move at a speed in the range of 20 to 40 degrees per second, which is an ideal movement speed, regardless of load applied to the door D to ensure easy user manipulation, and the door may be decelerated toward 110°, which is a target opening degree of the door D, the movement speed and the opening degree of the door D may be made uniform.

In addition, since the angle regulator 515 regulates an angle formed between rotation shafts of the idler gears around the rotation shaft of the center gear 43 to be a predetermined degree or smaller, a case in which both of the pair of idler gears 44 are engaged with the door-side gear 42 may be prevented.

Modified Example of the Fourth Embodiment

However, the present disclosure is not limited to the embodiment above.

For example, although the rotation load member is an elastic member in the embodiment above, the rotation load member may also generate friction between the idler gear and the mounting member. Specifically, examples of the rotation load member may include a sheet member formed of felt and the like and magnetic resistance such as by a magnet.

In addition, although the idler gears are mounted on different mounting members in the embodiment above, the pair of idler gears may also be mounted on the same mounting member.

In addition, although a single door-side gear is provided in the embodiment above, a plurality of door-side gears may also be provided.

In addition, although the power transmission apparatus of the embodiment above is used for opening and closing the door of the refrigerator, the use thereof is not necessarily limited to the door of the refrigerator.

In addition, although the movement range of the door is 0° to 110°, and each step is set by dividing the movement range every 10° in the controlling according to the embodiment above, the movement range and a way of setting each step may also be suitably changed.

The present disclosure is not limited to the embodiment and may be modified in various ways other than the above without departing from the intent of the present disclosure.

Fifth Embodiment

Hereinafter, the door opening and closing apparatus 100 according to a fifth embodiment will be described with reference to FIGS. 33 to 44B. In addition, the same reference numerals will be given to elements overlapping those in the first embodiment.

The door opening and closing apparatus 100 according to the embodiment includes the power transmission apparatus 40 configured to transmit power of the motor M to the hinge Z of the door only by rotation of the plurality of driving gears 45, and the auxiliary apparatus 30 configured to generate an auxiliary force for moving the door D at the closing position toward the opening position.

In addition, the door opening and closing apparatus 100 includes a power transmission state transition apparatus (a power transmitting state/power non-transmitting state switching apparatus) 101 configured to transition (switch) between the power transmitting state in which the power of the motor M is transmitted to the hinge Z and the power non-transmitting state in which the power of the motor M is not transmitted to the hinge Z.

Figure 33:
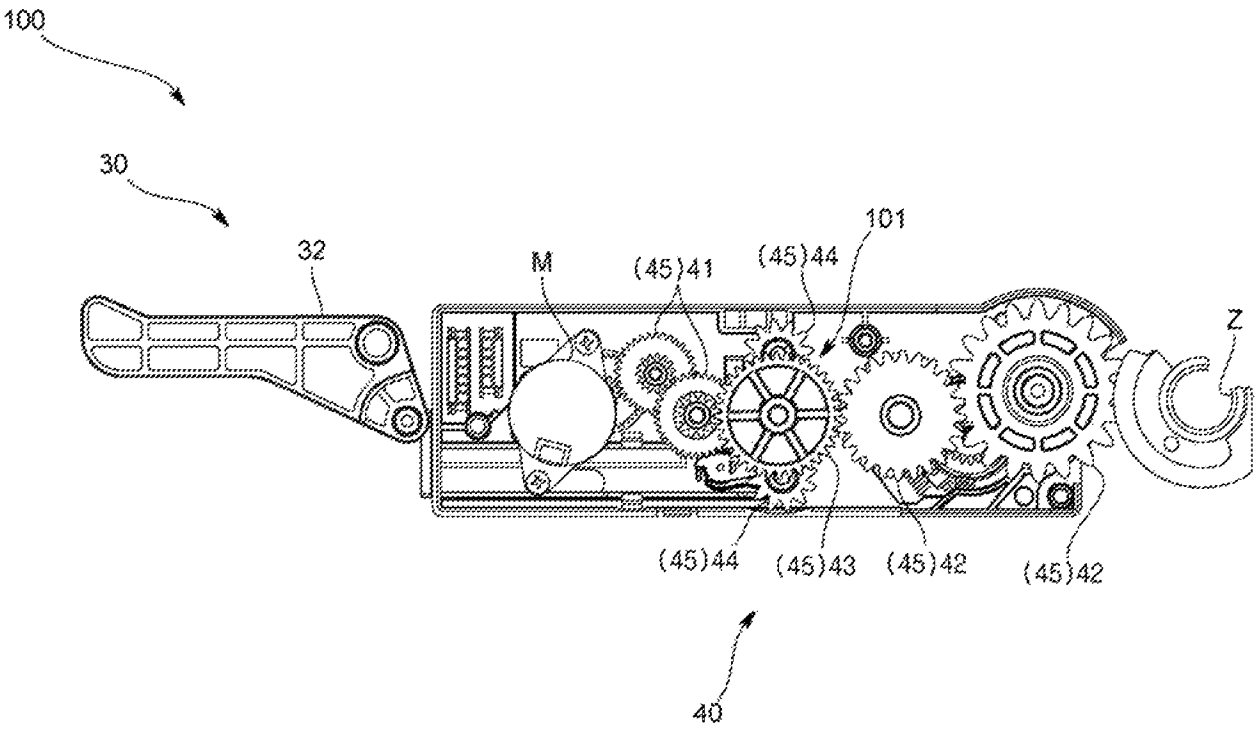
FIG. 33 is a view from the top of a door opening and closing apparatus according to a fifth embodiment.
Figure 34:
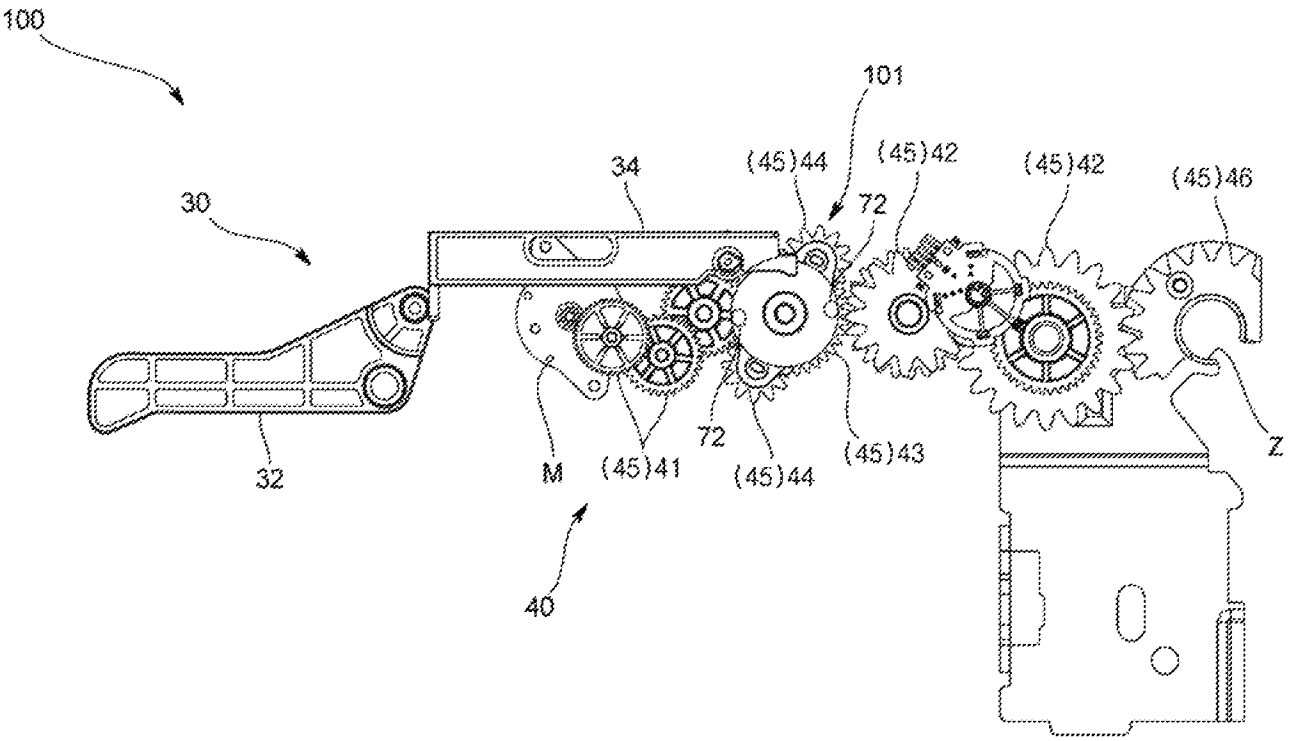
FIG. 34 is a view from the bottom of the door opening and closing apparatus according to the fifth embodiment.

As illustrated in FIGS. 33 and 34, the power transmission state transition apparatus 101 is interposed between the motor M and the hinge Z. Here, although the plurality of door-side gears 42 are interposed between the chipped tooth gear 46 connected to the hinge Z and the power transmission state transition apparatus 101, a single door-side gear 42 may also be interposed therebetween. In addition, the chipped tooth gear 46 connected to the hinge Z may have teeth formed along the entire circumference. In addition, the chipped tooth gear 46 according to the embodiment does not rotate as in the first embodiment but is fixed to the hinge Z and is a part of the driving gears 45.

Figure 35:
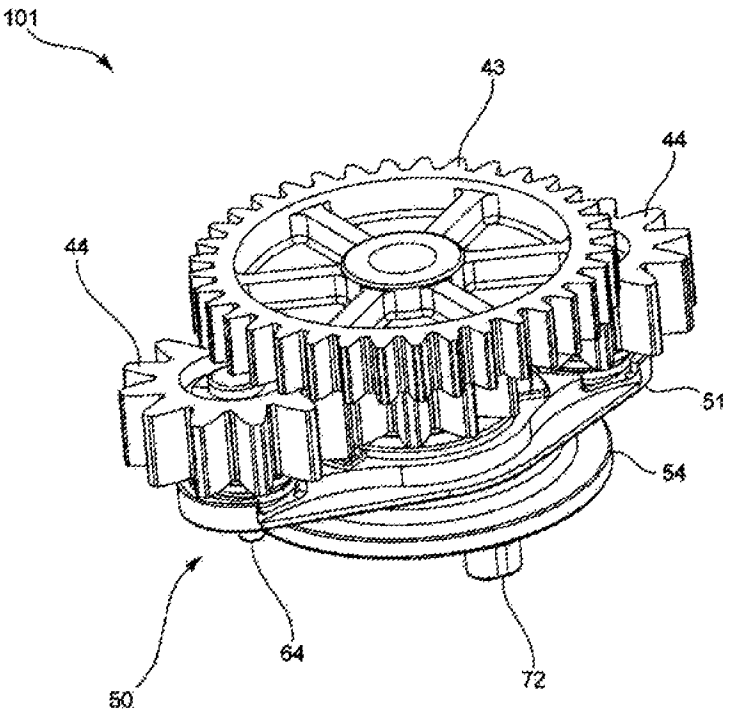
FIG. 35 is a view schematically illustrating a power transmission state transition apparatus according to the fifth embodiment.
Figure 36:
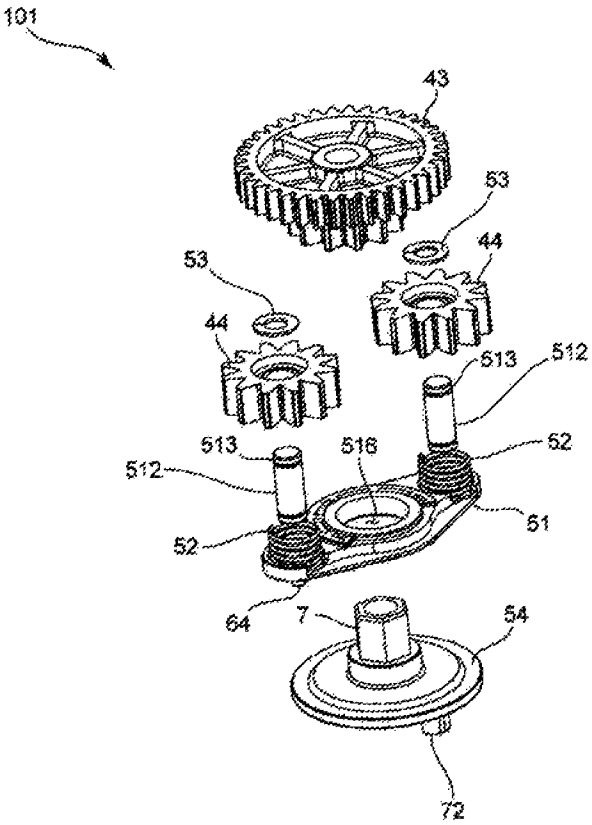
FIG. 36 is a view schematically illustrating the power transmission state transition apparatus according to the fifth embodiment.

Specifically, as illustrated in FIGS. 35 and 36, the power transmission state transition apparatus 101 includes the center gear 43 connected to the motor-side gear 41, the pair of idler gears 44 engaged with the center gear 43, and the swing apparatus 50 configured to revolve the pair of idler gears 44 along the circumference of the rotation shaft of the center gear.

As in the first embodiment, the swing apparatus 50 includes a first mounting member 51 configured to rotate about the rotation shaft of the center gear 43 and have the idler gears 44 mounted thereon and the rotation load member 52 interposed between the first mounting member 51 and the idler gears 44 and configured to assign load to rotation of the idler gears 44. In the embodiment, the swing apparatus 50 further includes a second mounting member 54 configured to have the center gear 43 mounted thereon.

The first mounting member 51 has the idler gear mounting shaft 512 and is formed in a flat plate shape having a through-hole 516 formed.

The rotation load member 52 assigns load to rotation of the idler gears 44 to generate torque that revolves the pair of idler gears 44 along the circumference of the rotation shaft of the center gear 43. Here, the rotation load member 52 is an elastic member such as a spring which passes through the idler gear mounting shaft 512.

The second mounting member 54 is a flat plate on which the center gear mounting shaft 7 is installed and is disposed below the first mounting member 51.

The second mounting member 54 rotates by interlocking with the center gear 43 and rotates independently from the first mounting member 51.

As illustrated in FIG. 36, in the embodiment, after placing the first mounting member 51 at an upper surface of the second mounting member 54 by allowing the center gear mounting shaft 7 to pass through the through-hole 516, each idler gear 44 is mounted on the idler gear mounting shaft 512, and the center gear 43 is mounted on the center gear mounting shaft 7.

When mounting each idler gear 44 on the idler gear mounting shaft 512, the rotation load member 52 is fitted to the idler gear mounting shaft 512, the idler gear 44 is fitted to the idler gear mounting shaft 512 above the rotation load member 52, and the pressing member 53 configured to press the idler gear 44 is fitted to the idler gear mounting shaft 512 above the idler gear 44 such that an upward force is applied by the rotation load member 52 on the idler gear.

In addition, the pressing member 53 is configured to be coupled to the recessed groove 513 formed along the circumferential direction of the outer circumferential surface of the idler gear mounting shaft 512.

Due to the configuration described above, the idler gear 44 moves among the forward rotation power transmitting position, the reverse rotation power transmitting position, and the power non-transmitting position by interlocking with the motor M. Since each of the positions and the detailed operation of the idler gear 44 are the same as in the first embodiment (see FIG. 4), descriptions thereof will be omitted.

As above, the power transmitting state transition apparatus 101 receives the power of the motor M and transitions between the power transmitting state and the power non-transmitting state using the power. In more detail, the swing apparatus 50 allows the pair of idler gears 44 to revolve, and the power transmitting state is reached by allowing the idler gear 44*a* at one side or the idler gear 44*b* at the other side to be engaged with the door-side gear 42, and the power non-transmitting state is reached by allowing the pair of idler gears 44 to be disengaged from the door-side gear 42. That is, a state in which the idler gear 44 is at the forward rotation power transmitting position or the reverse rotation power transmitting position is the power transmitting state, and a state in which the idler gear 44 is at the power non-transmitting position is the power non-transmitting state.

In addition, the door opening and closing apparatus 100 according to the embodiment is configured such that the auxiliary force is generated by the auxiliary apparatus 30 to move the door D at the closing position toward the opening position when the power transmission state transition apparatus 101 reaches the power non-transmitting state, and the power of the motor M is not transmitted to the hinge. In addition, as illustrated in FIG. 34, the auxiliary apparatus 30 includes the sliding member 34 and the auxiliary force assigning member 32. Since operations thereof are the same as in the first embodiment, detailed descriptions thereof will be omitted.

As in the first embodiment, the door opening and closing apparatus 100 according to the embodiment further includes the power non-transmitting state maintenance apparatus 60 and the power conversion apparatus 70. Since the power non-transmitting state maintenance apparatus 60 and the power conversion apparatus 70 or configurations related thereto according to the embodiment are different from other embodiments above, these will be described in detail below.

First, the power conversion apparatus 70 will be described.

Figure 37:
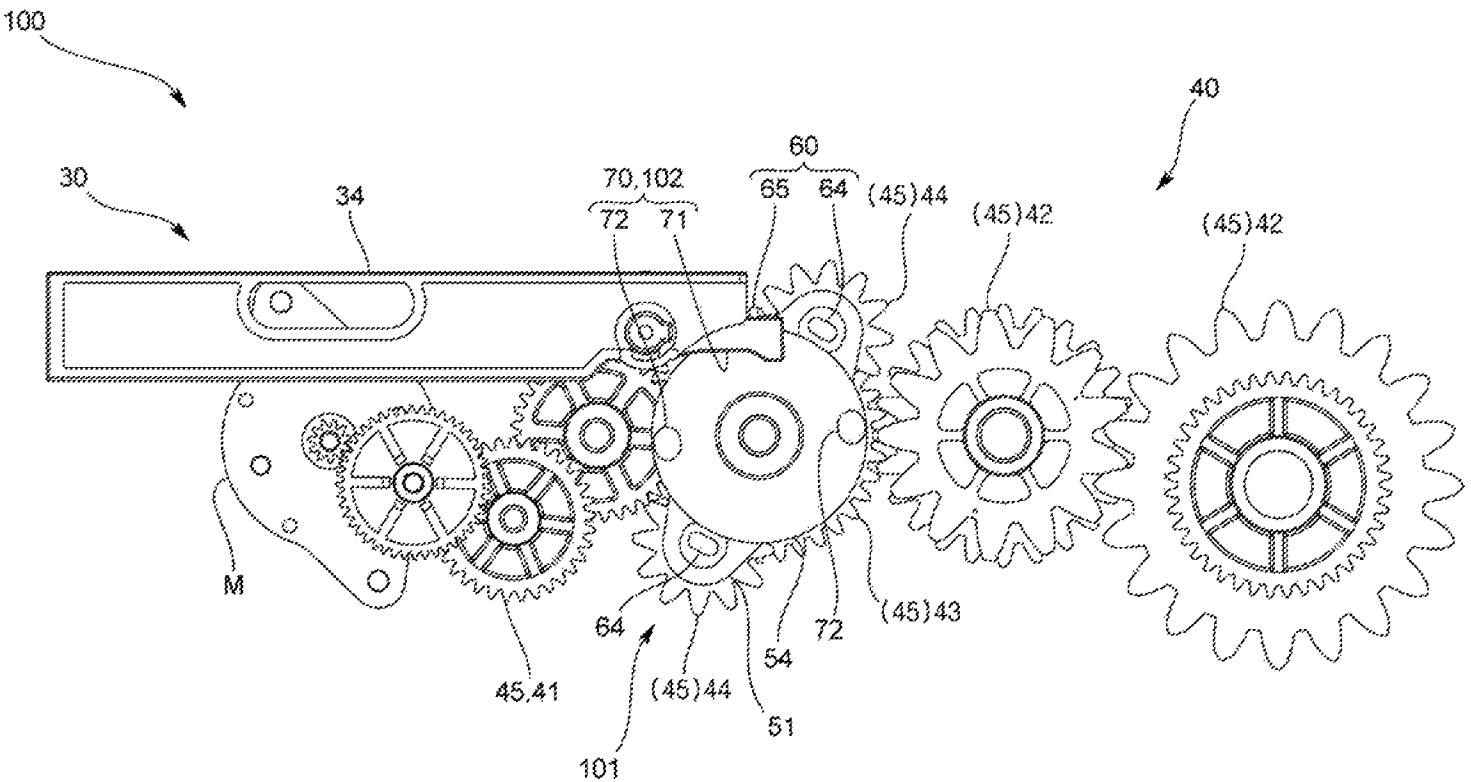
FIG. 37 is a view schematically illustrating a power non-transmitting state maintenance apparatus and a power conversion apparatus according to the fifth embodiment.

As illustrated in FIG. 37, the power conversion apparatus 70 is interposed between the sliding member 34 and the driving gear 45 to convert power directed in a rotating direction of the driving gear 45 to power directed in a sliding direction of the sliding member 34.

The power conversion apparatus 70 includes a ratchet apparatus 102 configured not to transmit the power of the motor M to the auxiliary apparatus 30 when the motor M rotates in the reverse direction and the door D is moved toward the closing position and configured to transmit the power of the motor M to the auxiliary apparatus 30 when the motor M rotates in the forward direction and the door D is moved toward the opening position.

The ratchet apparatus 102 includes a ratchet 71 (the hook 71 in the first embodiment) mounted on the sliding member 34 and a presser 72 (the protrusion 72 in the first embodiment) configured to rotate by interlocking with the driving gear 45.

Figure 38:
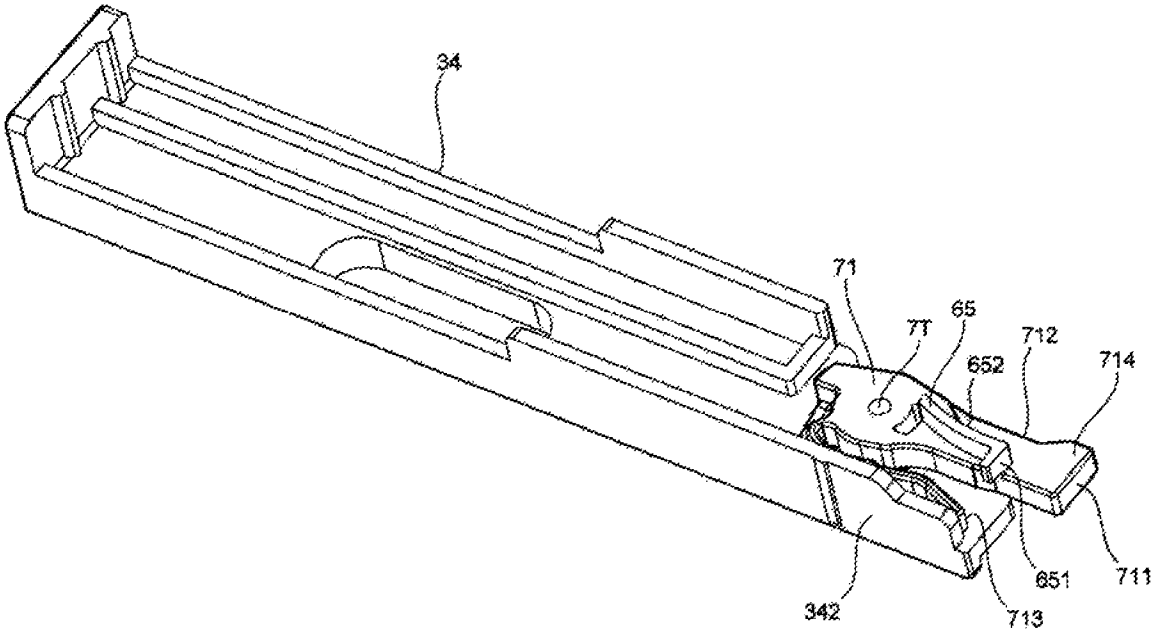
FIG. 38 is a view schematically illustrating a ratchet according to the fifth embodiment.
Figure 39A:
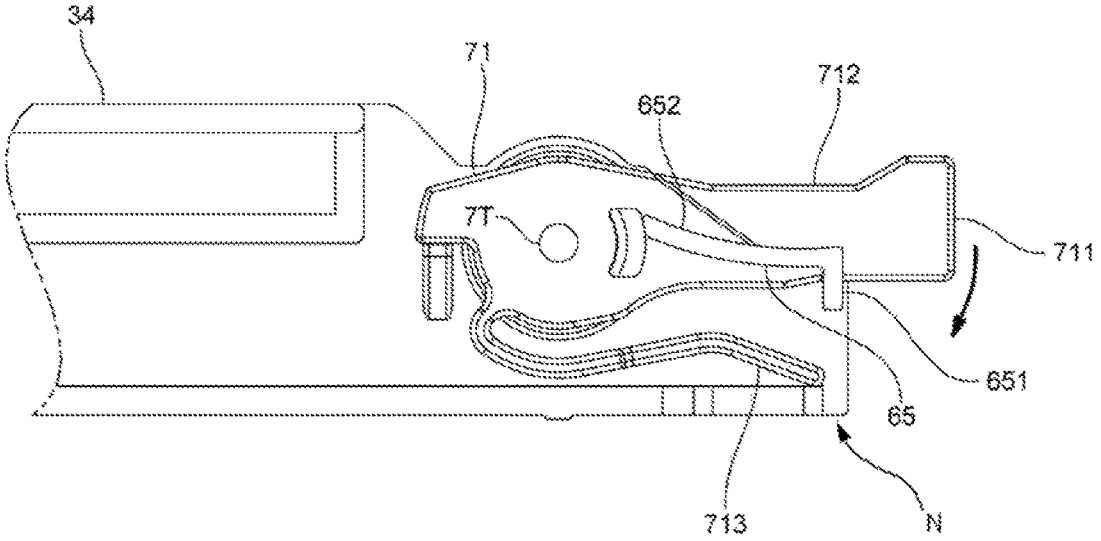
FIGS. 39A and 39B are views for describing an operation of the ratchet according to the fifth embodiment.
Figure 39B:
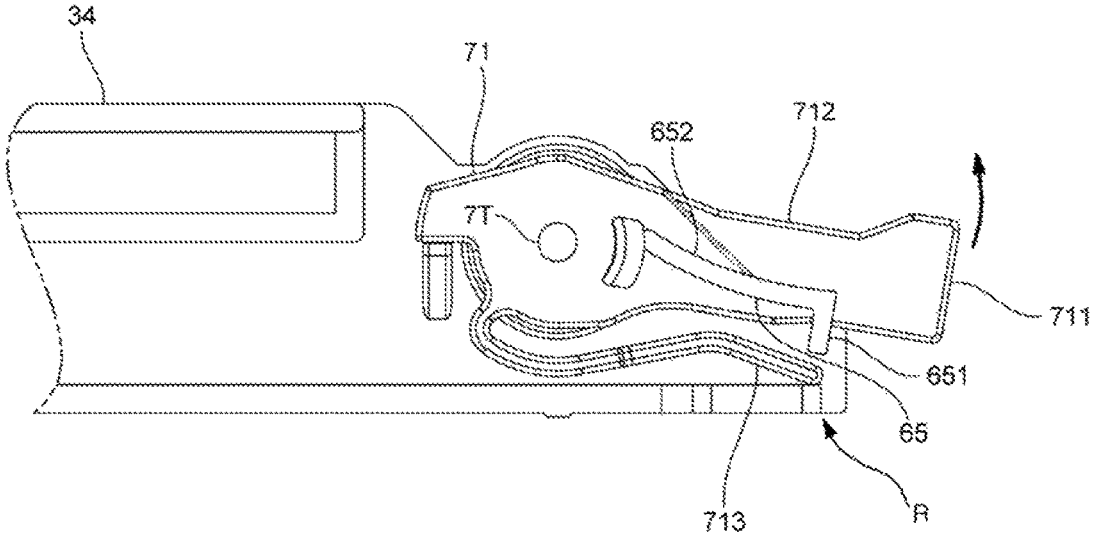

As illustrated in FIGS. 38 to 39B, the ratchet 71 is installed at the other end 342 of the sliding member 34 and includes a pressed end surface 711 configured to be pressed by the presser 72 when the motor M rotates in the forward direction and a guide surface 712 configured to guide movement of the presser 72 when the motor M rotates in the reverse direction.

As illustrated in FIGS. 39A and 39B, the ratchet 71 is configured to move between a normal position N in a state in which an external force is not applied (FIG. 39A) and a rotated position R resulting from the ratchet 71 rotating along a circumference of a rotation shaft 7T from the normal position N (FIG. 39B) and includes an elastic portion 713 configured to generate a pressing force toward the normal position N when the ratchet 71 is at the rotated position R. In addition, the rotated position R is a state in which the ratchet 71 has rotated from the normal position N in a direction away from the rotation shaft of the center gear 43.

The ratchet 71 according to the embodiment is disposed below the second mounting member 54 described above and is configured such that the pressed end surface 711 and the guide surface 712 are disposed on a rotational trajectory of the presser 72 while the ratchet 71 is at the normal position N.

As illustrated in FIG. 37, the presser 72 rotates by interlocking with the center gear 43 and applies the power directed in the sliding direction of the sliding member 34 to the ratchet 71. Specifically, a plurality of pressers 72 may be installed at the second mounting member 54, and two pressers 72 are installed at a back surface of the second mounting member 54 in the embodiment. In addition, the number of pressers 72 may also be suitably changed, e.g. to one.

Next, the power non-transmitting state maintenance apparatus 60 will be described.

The power non-transmitting state maintenance apparatus 60 regulates revolution of the swing apparatus 50 to maintain the power non-transmitting state in which neither of the pair of idler gears 44 is engaged with the door-side gear 42. Specifically, as illustrated in FIG. 37, the power non-transmitting state maintenance apparatus 60 includes an abutting portion 64 installed at the first mounting member 51 to rotate together with the first mounting member 51 and an abutted portion 65 abutted by the abutting portion 64 to regulate the revolution of the swing apparatus 50.

Figure 40:
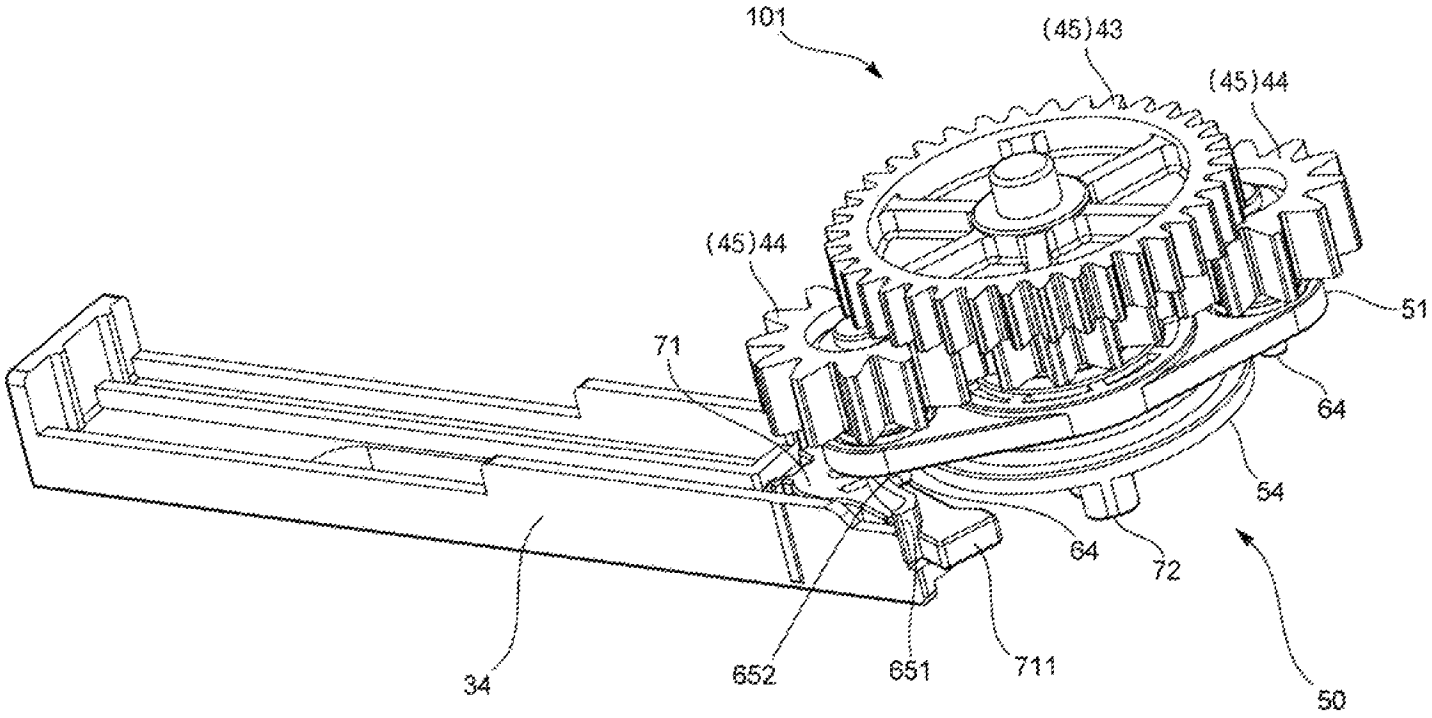
FIG. 40 is a view for describing an operation when a door according to the fifth embodiment is moved toward an opening position.

As illustrated in FIG. 40, the abutting portion 64 is a protrusion installed at a back surface of the first mounting member 51. Here, the abutting portion 64 is installed at each of the rotation shafts of the idler gears 44. The protruding length of the abutting portion 64 is set with a size that does not allow the abutting portion 64 to come into contact with the pressed end surface 711, i.e., a size that does not allow a front end of the abutting portion 64 to reach an upper surface 714 of the ratchet 71. That is, the abutting portion 64 is disposed above the upper surface 714 of the ratchet 71.

In addition, since the power non-transmitting state should be maintained until the door D and the housing H are demagnetized when the door D at the closing position is moving toward the opening position, the abutting portion 64 is installed near the idler gear 44 not engaged with the door-side gear 42 (the idler gear 44 at an upper side in FIG. 37) when the door D is moving toward the opening position. In this regard, a pair of abutting portions 64 are installed at the first mounting member 51 to allow each of the members to be assembled without paying attention to a direction of the first mounting member 51 and facilitate manufacturing of the door opening and closing apparatus 100.

The abutted portion 65 is installed at a position abutted by the abutting portion 64 before the pair of idler gears 44 reach the forward rotation power transmitting position when the pair of idler gears 44 head toward the forward rotation power transmitting position according to rotation of the first mounting member 51.

Specifically, as illustrated in FIGS. 38 to 39B, the abutted portion 65 is disposed above the upper surface 714 of the ratchet 71. Here, the abutted portion 65 has the shape of a rib vertically installed on the upper surface 714 of the ratchet 71. An abutted surface 651 abutted by the abutting portion 64 is formed at the abutted portion 65.

Next, operations of the power non-transmitting state maintenance apparatus 60 and the power conversion apparatus 70 configured as described above will be described with reference to FIGS. 41A to 43B.

First, a case in which the door D at the closing position is moved toward the opening position will be described.

Figure 41A:
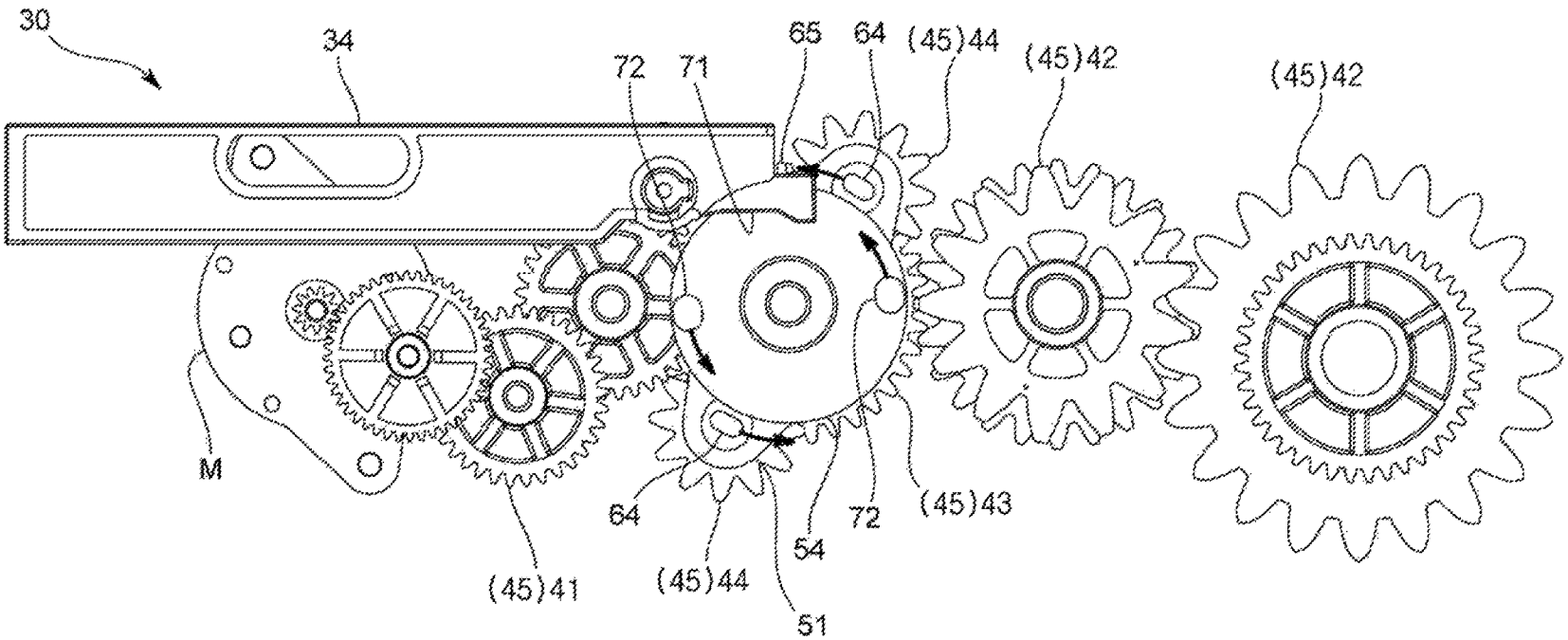
FIGS. 41A and 41B are views for describing the operation when the door according to the fifth embodiment is moved toward the opening position.

As illustrated in FIG. 41A, when the motor M rotates in the forward direction with the door D closed, the swing apparatus 50 revolves the pair of idler gears 44 from the power non-transmitting position to the forward rotation power transmitting position by interlocking with rotation of the center gear 43. Since the first mounting member 51 rotates by interlocking with the revolution, the abutting portion 64 installed at the first mounting member 51 rotates toward the abutted portion 65.

Figure 41B:
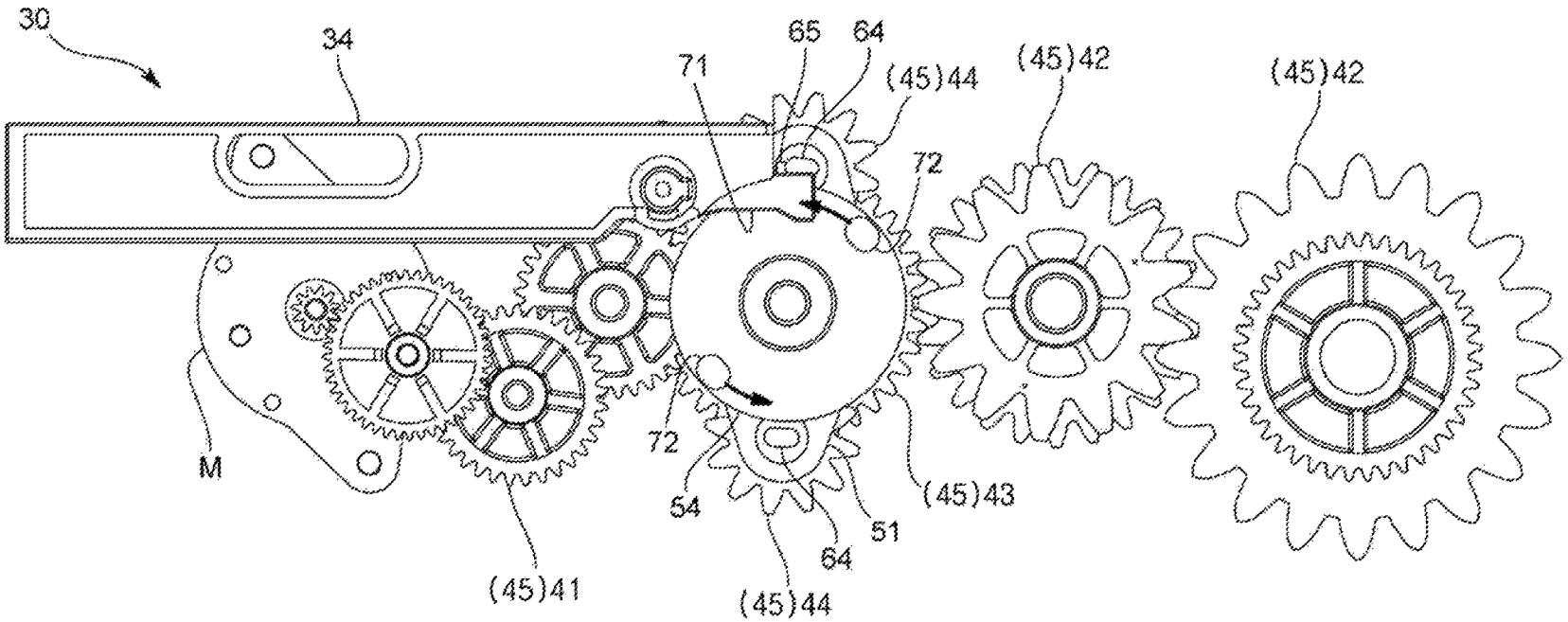

In addition, as illustrated in FIG. 41B, the power non-transmitting state is maintained by the abutting portion 64 abutting the abutted portion 65 (specifically, the abutted surface 651) and the rotation of the first mounting member 51, i.e. the revolution of the idler gears 44, being regulated. In addition, the revolution of the idler gears 44 is regulated since the idler gears 44 revolves due to relatively small torque caused by load of the rotation load member 52.

Figure 42A:
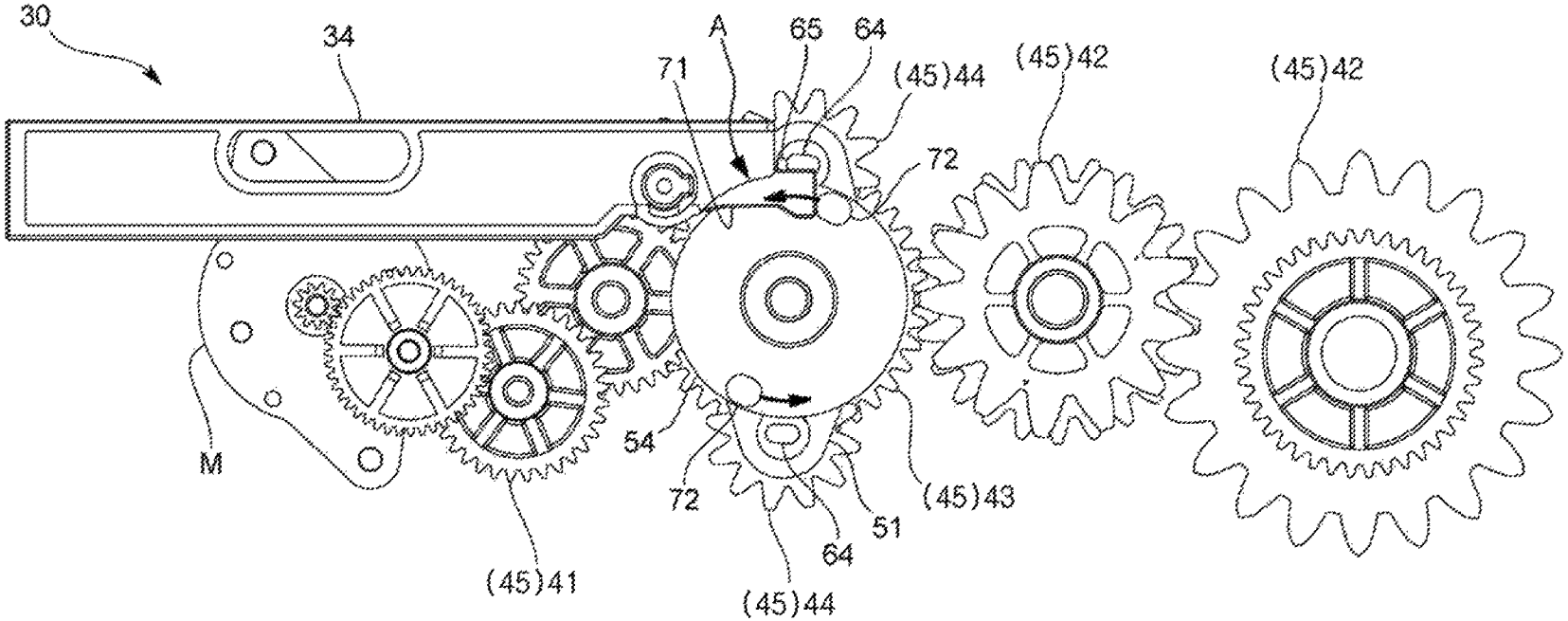
FIGS. 42A and 42B are views for describing an operation when the door according to the fifth embodiment is moved toward a closing position.

When the motor M further rotates in the forward direction from the above state, the second mounting member 54 rotates independently from the first mounting member 51. Thus, as illustrated in FIG. 42A, the pressers 72 installed at the second mounting member 54 rotate by interlocking with the center gear 43, and any one of the pressers 72 comes into contact with the ratchet 71 (specifically, the pressed end surface 711).

Figure 42B:
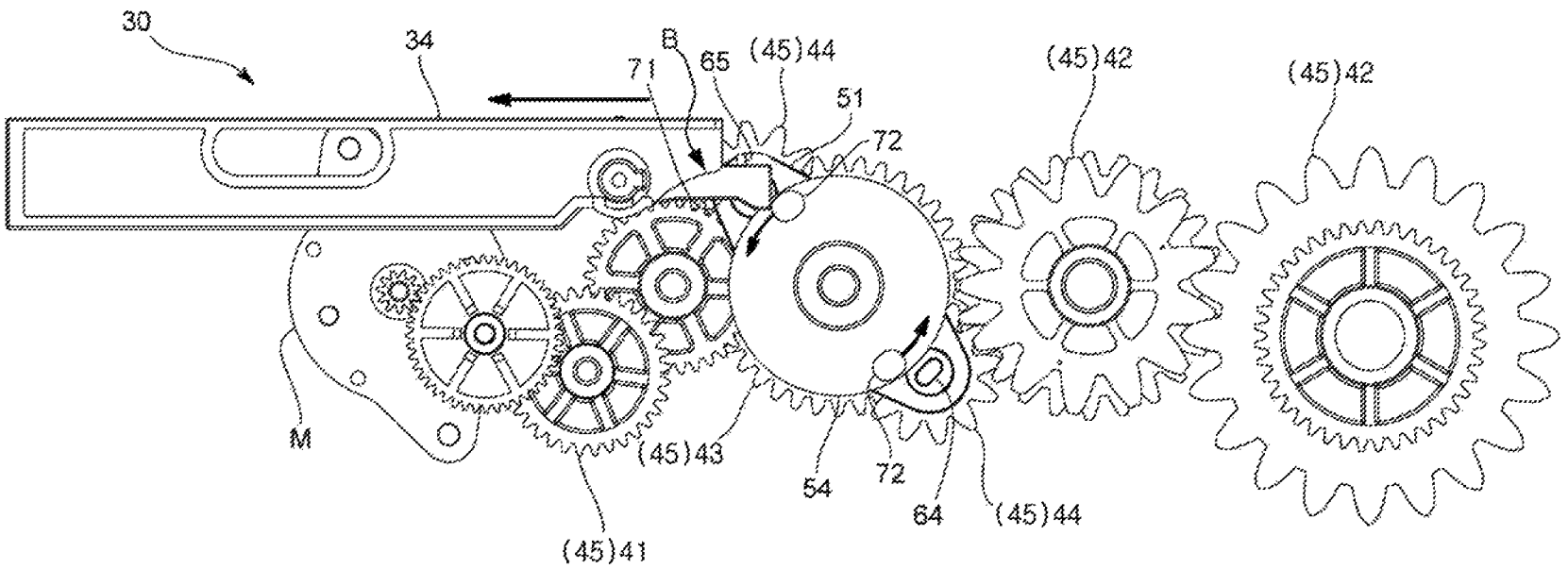

As illustrated in FIG. 42B, due to the motor M further rotating in the forward direction, the pressers 72 press the ratchet 71 through the pressed end surface 711, and power directed in the rotating direction of the center gear 43 is transmitted to the sliding member 34 as power directed in the sliding direction thereof through the ratchet 71 such that the sliding member 34 slides.

As a result, the door D and the housing H are demagnetized by the auxiliary force of the auxiliary apparatus 30, and the door D at the closing position moves toward the opening position.

Next, a case in which the door D at the opening position is moved toward the closing position will be described.

Figure 43A:
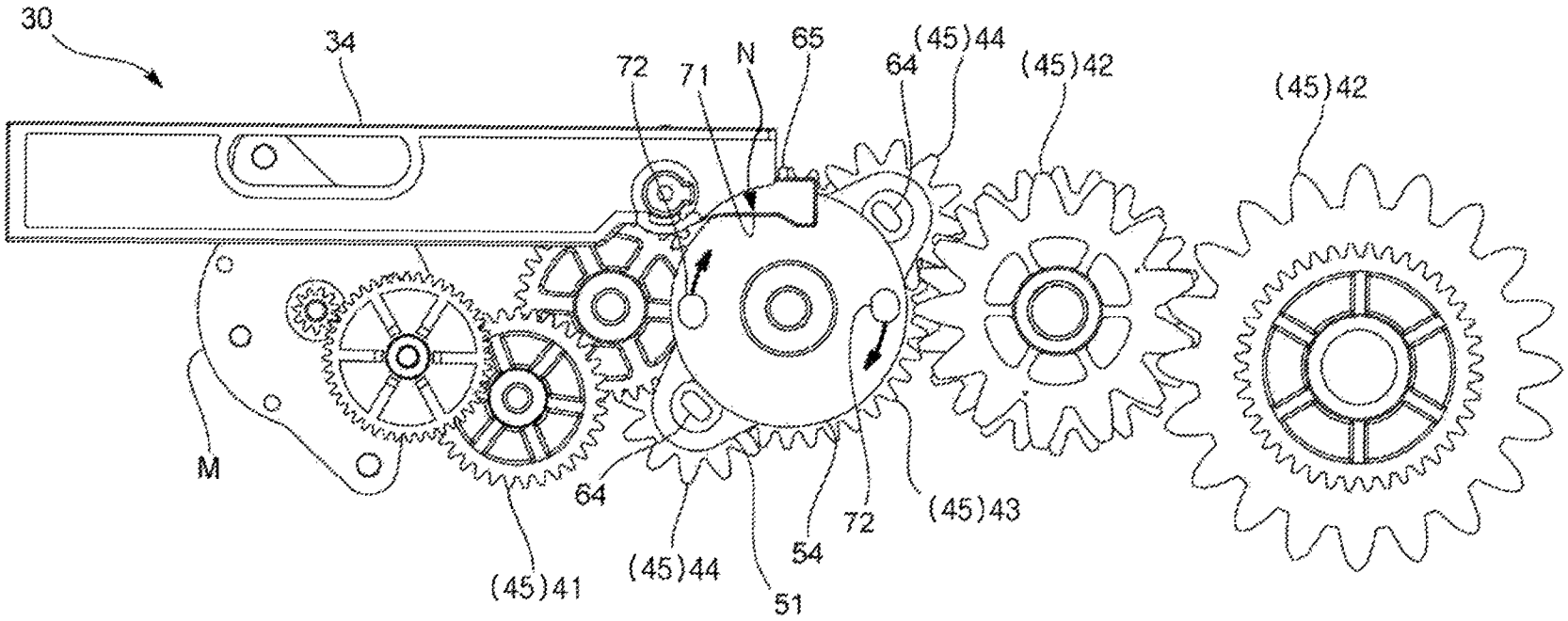
FIGS. 43A and 43B are views schematically illustrating the ratchet according to the fifth embodiment.

As illustrated in FIG. 43A, when the motor M rotates in the reverse direction with the door D open, the plurality of pressers 72 rotate toward the ratchet 71 (specifically, the guide surface 712) since the second mounting member 54 rotates by interlocking with the center gear 43.

Figure 43B:
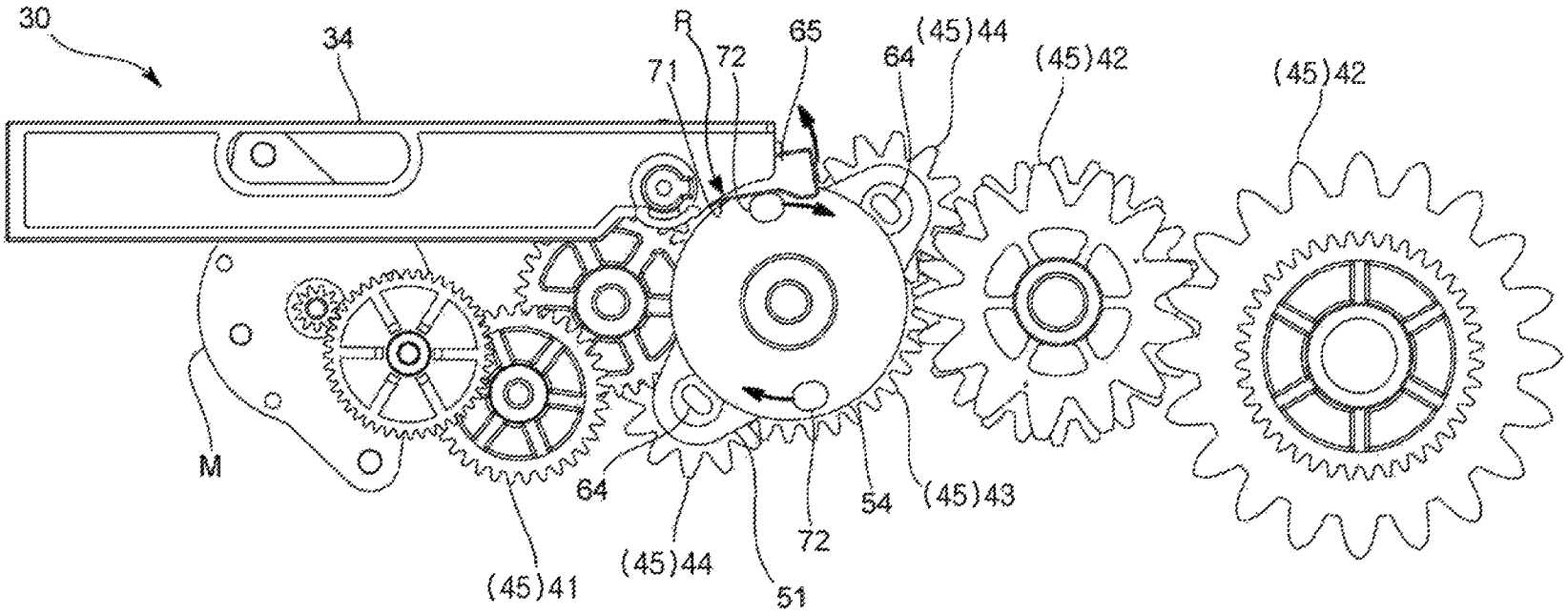

When the motor M further rotates in the reverse direction after the pressers 72 come into contact with the guide surface 712, the pressers 72 rotate while pressing the guide surface 712 to rotate the ratchet 71 along the circumference of the rotation shaft 7T as illustrated in FIG. 43B. In this way, the ratchet 71 rotates from the normal position N to the rotated position R and moves away from the pressers 72.

As a result, when the motor M rotates in the reverse direction, the pressers 72 continue to rotate without being interfered by the ratchet 71, and the door D moves toward the closing position.

However, when the door D is moved toward the opening position, the ratchet 71 moves from a standby position A to a press-fitting direction B according to the sliding of the sliding member 34 as illustrated in FIG. 42.

In addition, the standby position A is a position of the ratchet 71 right before the pressers 72 press the pressed end surface 711 due to forward rotation of the motor M. In addition, the press-fitting direction B is a position of the ratchet 71 right before the pressers 72 pressing the pressed end surface 711 are detached from the pressed end surface 711 due to forward rotation of the motor M.

In this regard, when the ratchet 71 remains in a state of being pressed by the pressers 72, i.e., at the press-fitting position B, the sliding member 34 and the like is visible to the user when the door D is moving toward the opening position, and it is not beneficial in terms of appearance of the refrigerator.

Consequently, the auxiliary apparatus 30 according to the embodiment includes a returning member (unillustrated) configured to return the sliding member 34 that has moved due to the ratchet 71 being pressed by the presser 72. Specifically, the returning member is for returning the ratchet 71 from the press-fitting position B to the standby position A by pressing the sliding member 34 in the direction opposite to the sliding direction. Here, the returning member is an elastic member such as a torsion bar or a spring.

However, by just simply installing the returning member, since the ratchet 71 moves from the press-fitting position B to the standby position A while keeping the normal position N when the returning member returns the sliding member 34, the pressers 72 press the ratchet 71 again, and the sliding member 34 slides again. That is, by just installing the returning member, the sliding member 34 merely repeats sliding and being returned while the door D moves toward the opening position, and thus it cannot be considered that the appearance of the refrigerator is improved enough.

Consequently, in the embodiment, as illustrated in FIGS. 38 to 40, a pressed surface 652 (hereinafter, also referred to as a pressed sliding surface 652) pressed by the pressers 72 when the sliding member 34 is being returned by the returning member is installed at the ratchet 71 described above.

The pressed sliding surface 652 is installed at the abutted portion 65 described above. Specifically, the pressed sliding surface 652 is extendingly formed from a side of the first mounting member 51 at the abutted surface 651. In the embodiment, the pressed sliding surface 652 is bent in a direction away from the rotation shaft of the center gear 43, and the abutting portion 64 slides the pressed sliding surface 652 such that the abutting portion 64 presses the ratchet 71 through the pressed sliding surface 652 to allow the ratchet 71 to move from the normal position N to the rotated position R.

Figure 44A:
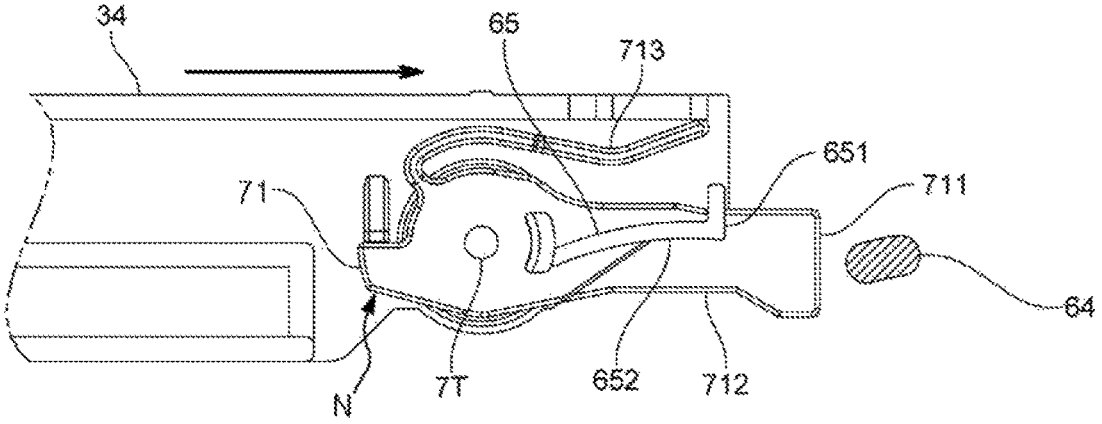
FIGS. 44A, 44B and 44C (44A to 44C) are views for describing an operation of the ratchet according to the fifth embodiment.
Figure 44B:
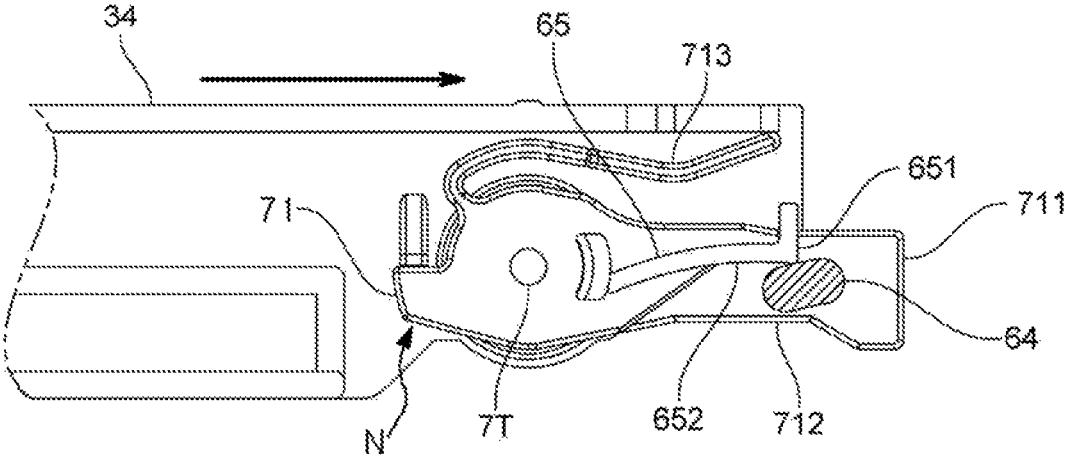

Due to the configuration described above, since the sliding member 34 is returned by the returning member (unillustrated) as illustrated in FIGS. 44A to 44B, the pressed sliding surface 652 comes into contact with the abutting portion 64 when the ratchet 71 is moved from the pressing-fitting position B to the standby position A.

Figure 44C:
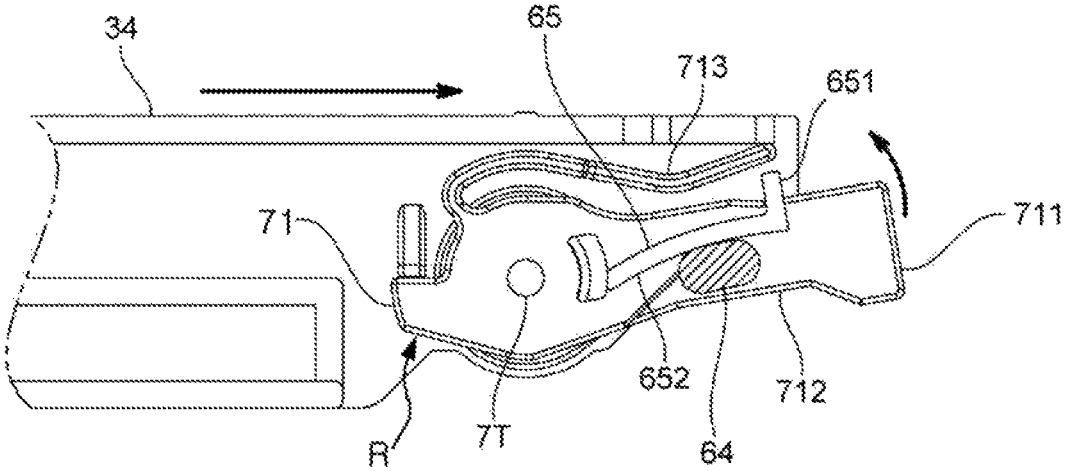

In addition, as illustrated in FIGS. 44B and 44C, the ratchet 71 further moves toward the standby position A such that the abutting portion 64 slides the pressed sliding surface 652 and presses the ratchet 71 through the pressed sliding surface 652. In this way, the ratchet 71 rotates from the normal position N to the rotated position R while moving from the press-fitting position B to the standby position A.

As a result, since the ratchet 71 keeps the rotated position R after moving to the standby position A, the ratchet 71 is not interfered by the pressers 72 afterwards and is not pressed by the pressers 72. In this way, since the sliding member 34 may be prevented from sliding again after being returned, the appearance of the refrigerator may be improved.

As described above, according to the door opening and closing apparatus 100 related to the embodiment, since the door D at the closing position is moved toward the opening position by the auxiliary force when the power of the motor M is not transmitted to the hinge Z due to the power non-transmitting state reached by the power transmitting state transition apparatus 101, torque of the motor M required to demagnetize the door D and the housing H may be reduced, and the motor M may be made smaller.

In addition, since the power of the motor M is transmitted to the hinge Z or the auxiliary apparatus 30 only with mechanical parts such as a gear, the door D may be automatically opened and closed without using electrical parts such as a switching device.

In addition, since the power conversion apparatus 70 includes the ratchet apparatus 102, the power conversion apparatus 70 may allow the auxiliary force to be generated when the door D at the closing position is moved toward the opening position and prevent movement of the door D from being interfered by the power conversion apparatus 70 when the door D is moved toward the closing position.

In addition, since the sliding member 34, which is slid, is returned by the returning member when the door D and the housing H are being demagnetized, the sliding member 34 may not be visible by the user while the door moves toward the opening position such that the appearance of the refrigerator is not worsened.

In addition, when returning the sliding member 34, since interference between the ratchet 71 and the pressers 72 is avoided by rotating the ratchet 71 from the normal position N to the rotated position R, the returned sliding member 34 may be prevented from sliding again.

Modified Example of the Fifth Embodiment

Figure 45:
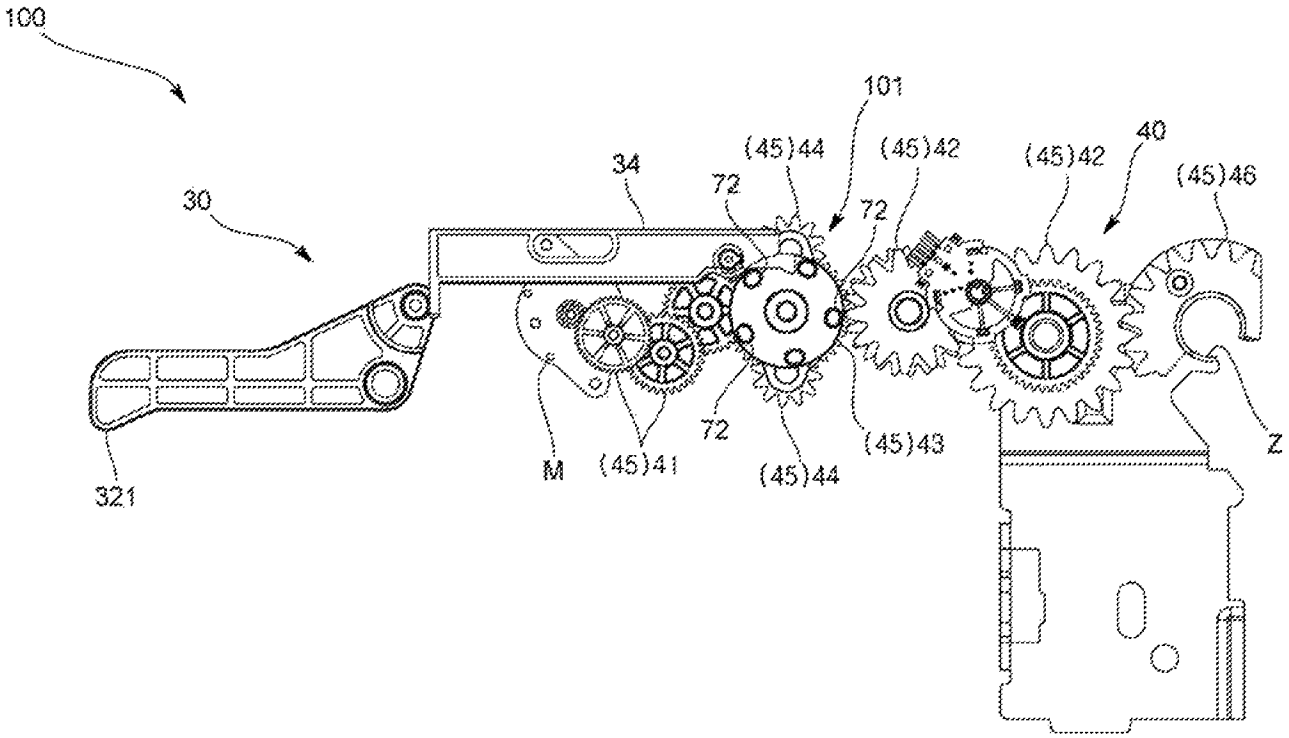
FIG. 45 is a view from the bottom of a door opening and closing apparatus according to a modified example of the fifth embodiment.

As another embodiment for moving the door at the closing position toward the opening position by the auxiliary force while the power of the motor is not transmitted to the hinge, a case in which the number of pressers 72 of the power conversion apparatus 70 is increased as illustrated in FIG. 45 (here, five pressers 72 are present) may be considered.

With such a configuration, compared to the case of the fifth embodiment in which two pressers 72 or one presser 72 is present, time taken for any one presser 72 to reach the ratchet 71 may be shortened. In this way, when the motor M rotates in the forward direction, since a possibility of the ratchet 71 being pressed by the presser 72 before the idler gear 44 at the power non-transmitting position moves to the forward rotation power transmitting position, i.e., is engaged with the door-side gear 42, is high, the auxiliary force may be generated with the power of the motor M not transmitted to the hinge Z.

Here, even with the configuration in which the number of pressers 72 is increased as above, since the idler gear 44 is engaged with the door-side gear 42 before the presser 72 presses the ratchet 71 in some cases, a configuration having the power non-transmitting state maintenance apparatus 60 as in the fifth embodiment is preferable to make sure that the auxiliary force is generated with the power of the motor M not transmitted to the hinge Z.

In addition, when the number of pressers 72 is increased at a time of returning the slid sliding member 34, since a possibility of the ratchet 71 moving from the press-fitting position B to the standby position A reaching the pressers 72 is high, the sliding member 34 is not necessarily returned. Even in this regard, the configuration of the fifth embodiment is preferable.

According to an embodiment of the present disclosure, a motor in a refrigerator may be made smaller by reducing torque of the motor required for demagnetizing a door and a housing.

Although the refrigerator has been described above with reference to the accompanying drawings by focusing on particular shapes and directions, the present disclosure may be modified and changed in various ways by those of ordinary skill in the art, and the modifications and changes should be construed as belonging to the scope of the present disclosure which is defined in the claims and their equivalents.

What is claimed is:

1. A refrigerator comprising:

a main body housing;

a door opening and closing the main body housing by rotating about a hinge shaft; and a door opening and closing apparatus configured to open and close the door, wherein the door opening and closing apparatus includes:

a motor configured to output power to open and close the door;

a first gear configured to rotate by interlocking with the motor;

a second gear configured to transmit a rotational force to the hinge shaft;

a third gear configured to be rotated with the first gear; and a pair of idler gears, each configured to transmit a rotational force of the third gear to the second gear when respectively moved as the third gear rotates;

wherein a first idler gear of the pair of idler gears moves to a first position and engages with the second gear as the third gear rotates in one direction;

a second idler gear of the pair of idler gears moves to a second position and engages with the second gear as the third gear rotates in the other direction; and the first idler gear and the second idler gear move to a third position which is spaced apart from the second gear when the third gear is at a standstill.

2. The refrigerator of claim 1, wherein the door opening and closing apparatus further includes:

a swing apparatus configured to selectively move the pair of idler gears, respectively, to a first position or a second position by respectively rotating the pair of idler gears as the third gear rotates in one direction or as the third gear rotates in the other direction about a rotation axis of the third gear by interlocking with the third gear.

3. The refrigerator of claim 2, wherein the door opening and closing apparatus further includes:

a pressing member configured to press the swing apparatus to allow the pair of idler gears to be disposed at a third position spaced apart from the second gear when the motor is at a standstill.

4. The refrigerator of claim 2, wherein the swing apparatus includes:

a mounting member configured to have the pair of idler gears rotatably mounted thereon, respectively; and a rotation load member disposed between the mounting member and the pair of idler gears, and the rotation load member configured to transmit at least a portion of the rotational force being transmitted from the third gear toward the pair of idler gears to the mounting member to allow the mounting member to rotate about the rotation axis of the third gear.

5. The refrigerator of claim 1, wherein:

when moved to the first position, the first idler gear transmits a rotational force in one direction of the motor to the second gear to allow the door to move toward an opening position; and when moved to the second position, the second idler gear transmits a rotational force in the other direction of the motor to the second gear to allow the door to move toward a closing position.

6. The refrigerator of claim 1, wherein the door opening and closing apparatus further includes:

a fourth gear disposed on the hinge shaft to rotate about the hinge shaft with the door and be engaged with the second gear; and a rotational force of the fourth gear is not transmitted to the first gear when the fourth gear rotates due to rotation of the door while the first idler gear and the second idler gear are at the third position.

7. The refrigerator of claim 6, wherein the door opening and closing apparatus is disposed at the door, and the door opening and closing apparatus further includes:

an auxiliary apparatus configured to move the door from a closing position to toward an opening position, the auxiliary apparatus includes:

a first auxiliary member configured to slide by interlocking with the third gear as the third gear rotates, and a second auxiliary member configured to rotate by interlocking with the sliding of the first auxiliary member and come into contact with the main body housing due to the rotation, and wherein, the second auxiliary member presses the main body housing while in contact with the main body housing to detach the door from the main body housing.

8. The refrigerator of claim 7, wherein the auxiliary apparatus further includes:

a power conversion apparatus configured to convert a rotational force of the motor transmitted through the third gear which rotates with the first gear into power directed in a sliding direction of the first auxiliary member; and wherein, no power from the motor is transmitted by the power conversion apparatus to the second auxiliary member when the first idler gear and the second idler gear are at the second position, and the power of the motor is transmitted by the power conversion apparatus to the second auxiliary member when the first idler gear and the second idler are at the first position.

9. The refrigerator of claim 8, wherein the power conversion apparatus includes:

a ratchet disposed at the first auxiliary member and a presser disposed at the third gear; and the ratchet slides the first auxiliary member by coming into contact with the presser rotating in one direction by interlocking with the third gear as the third gear rotates in the one direction.

10. The refrigerator of claim 6, wherein the door opening and closing apparatus further includes:

a fourth gear rotation apparatus configured to allow the fourth gear to be selectively engaged with the second gear by interlocking, with opening and closing of the door; and the fourth gear rotation apparatus allows the fourth gear to be spaced apart from the second gear when the door is at the closing position, and allows the fourth gear to be at a position coming into contact with the second gear as the door opens and moves toward an opening position.

11. The refrigerator of claim 1, further comprising:

a door controlling device configured to control the motor and automatically move the door, wherein the door controlling device includes:

an induced voltage detector configured to detect an induced voltage generated when the motor rotates, and an applied voltage controller configured to control an applied voltage to the motor to allow a value detected by the induced voltage detector to reach a target value preset according to an opening degree of the door.

12. The refrigerator of claim 11, wherein:

a movement range of the door is divided into a plurality of contiguously divided ranges; and the target value is set for each of the divided ranges.

13. The refrigerator of claim 12, wherein the door controlling device further includes:

a zero setter configured to set an opening angle as 0 when the applied voltage for moving the door toward the opening position while the door is closed has reached a predetermined threshold value; and an opening angle detector configured to detect the opening angle from the opening angle set as 0 by the zero setter.

14. The refrigerator of claim 13, wherein the door controlling device further includes:

an encoder or a rotary switch provided adjacent to any one or more of the first gear, the second gear and the third gear; and the opening angle detector detects the opening angle based on an output from the encoder or the rotary switch.

15. A refrigerator comprising:

a motor configured to output power for opening and closing a door of a main body housing;

a first gear configured to rotate by interlocking with the motor;

a second gear configured to transmit a rotational force to a hinge shaft of the door;

a third gear configured to come into contact with the first gear, the third gear being between the first gear and the second gear; and a pair of idler gears configured to selectively transmit a rotational force of the third gear to the second gear when respectively moved by rotation of the third gear, wherein:

one of the pair of idler gears transmits power for rotating the door toward an opening position to the hinge shaft by being engaged with the second gear by interlocking with rotation of the third gear in a forward direction when the motor rotates in the forward direction;

the other of the pair of idler gears transmits power for rotating the door toward a closing position to the hinge shaft by being engaged with the second gear by interlocking with rotation of the third gear in a reverse direction when the motor rotates in the reverse direction; and each of the pair of idler gears is spaced apart from the second gear during which no power is transmitted to the second gear while the motor is at a standstill.

* * * * *